US008933636B2

(12) United States Patent
Egawa et al.

(10) Patent No.: US 8,933,636 B2
(45) Date of Patent: Jan. 13, 2015

(54) LED DRIVING CIRCUIT

(75) Inventors: Shunji Egawa, Tokorozawa (JP); Keisuke Sakai, Matsudo (JP); Isao Ochi, Tokorozawa (JP)

(73) Assignee: Citizen Holdings Co., Ltd., Tokyo (JP)

( * ) Notice: Subject to any disclaimer, the term of this patent is extended or adjusted under 35 U.S.C. 154(b) by 116 days.

(21) Appl. No.: 13/576,627

(22) PCT Filed: Feb. 2, 2011

(86) PCT No.: PCT/JP2011/052677

§ 371 (c)(1),
(2), (4) Date: Aug. 1, 2012

(87) PCT Pub. No.: WO2011/096585

PCT Pub. Date: Aug. 11, 2011

(65) Prior Publication Data

US 2012/0299492 A1 Nov. 29, 2012

(30) Foreign Application Priority Data

Feb. 3, 2010 (JP) ..... 2010-022099
Aug. 23, 2010 (JP) ..... 2010-186251

(51) Int. Cl.
*H05B 37/02* (2006.01)
*H05B 33/08* (2006.01)

(52) U.S. Cl.
CPC ..... *H05B 33/083* (2013.01); *H05B 33/0827* (2013.01)
USPC ..... 315/192

(58) Field of Classification Search
None
See application file for complete search history.

(56) References Cited

U.S. PATENT DOCUMENTS

2009/0174343 A1* 7/2009 Lenz et al. ..... 315/292
2011/0109228 A1* 5/2011 Shimomura et al. ..... 315/113

FOREIGN PATENT DOCUMENTS

DE 103 24 609 A1 12/2004
JP 2004-114968 4/2004

(Continued)

OTHER PUBLICATIONS

International Search Report from the Japanese Patent Office, mailed May 10, 2011, for International Application No. PCT/JP2011/052677.

(Continued)

*Primary Examiner* — Crystal L Hammond
(74) *Attorney, Agent, or Firm* — Finnegan, Henderson, Farabow, Garrett & Dunner, L.L.P.

(57) ABSTRACT

The invention is directed to the provision of an LED driving circuit that switches the connection of LED blocks with proper timing in accordance with the supply voltage and the Vf's specific to individual LEDs contained in each LED block. The LED driving circuit includes a rectifier, a first circuit which includes a first current detection unit for detecting current flowing through a first LED array, and a first current control unit for controlling current flowing from the first LED array to a negative power supply output in accordance with the current detected by the first current detection unit, and a second circuit which includes a second current detection unit for detecting current flowing through a second LED array, and a second current control unit for controlling current flowing from a positive power supply output to the second LED array in accordance with the current detected by the second current detection unit, and wherein a current path connecting the first LED array and the second LED array in parallel relative to the rectifier and a current path connecting the first LED array and the second LED array in series relative to the rectifier are formed.

14 Claims, 34 Drawing Sheets

(56) References Cited

FOREIGN PATENT DOCUMENTS

| | | |
|---|---|---|
| JP | 2009-259622 | 11/2009 |
| JP | 2009-283775 | 12/2009 |
| JP | 2010-225742 | 10/2010 |
| JP | 2011-14836 | 1/2011 |
| JP | 2011-40701 | 2/2011 |

OTHER PUBLICATIONS

European Search Report dated Oct. 17, 2013 issued in corresponding European Appiication No. 1173993.1.

* cited by examiner

LED DRIVING CIRCUIT

This application is a 371 National phase application of International Patent Application PCT/JP2011/052677 filed Feb. 2, 2011 which in turn claims the benefit of foreign priority of the following Japanese applications:

JP 2010-186251, filed Aug. 23, 2010; and

JP 2010-022099. Filed Feb. 3, 2010;

The contents of the prior applications are incorporated herein by reference.

TECHNICAL FIELD

The present invention relates to an LED driving circuit, and more particularly to an LED driving circuit for producing efficient LED light emission using an AC power supply.

BACKGROUND

A method is known in which when applying to a plurality of LED blocks a rectified voltage that a diode bridge outputs by full-wave rectifying the AC power supplied from a commercial power supply, the connection mode of the plurality of LED blocks is switched between a parallel connection and a series connection in accordance with the supply voltage (refer, for example, to patent document 1).

LEDs have nonlinear characteristics such that, when the voltage being applied across the LED reaches or exceeds its forward voltage drop, a current suddenly begins to flow. Light with a desired luminous intensity is produced by flowing a prescribed forward current (If) using a method that inserts a current limiting resistor or that forms a constant current circuit using some other kind of active device. The forward voltage drop that occurs is the forward voltage (Vf). Accordingly, in the case of a plurality, n, of LEDs connected in series, the plurality of LEDs emit light when a voltage equal to or greater than n×Vf is applied across the plurality of LEDs. On the other hand, the rectified voltage that the diode bridge outputs by full-wave rectifying the AC power supplied from the commercial power supply varies between 0 (v) and the maximum output voltage periodically at a frequency twice the frequency of the commercial power supply. This means that the plurality of LEDs emit light only when the rectified voltage is equal to or greater than n×Vf (v), but do not emit light when the voltage is less than n×Vf (v).

To address this deficiency, two LED blocks, each containing n LEDs, for example, are provided and, when the supply voltage reaches or exceeds 2×n×Vf (v), the two LED blocks are connected in series, causing the LEDs in both blocks to emit light; on the other hand, when the supply voltage is less than 2×n×Vf (v), the two LED blocks are connected in parallel so as to cause the LEDs in both blocks to emit light. By thus switching the connection of the plurality of LED blocks between the series connection and the parallel connection in accordance with the supplied voltage, the light-emission period of the LEDs can be lengthened despite the variation of the commercial power supply voltage.

However, since this method requires the provision of a switch circuit for switching the connection mode of the plurality of LED blocks, there has been the problem that not only does the overall size and cost of the LED driving circuit increase, but the power consumption also increases because of the power required to drive the switch circuit. In particular, if the light-emission period of the LEDs is to be further lengthened, the number of LED blocks has to be increased, but if the number of LED blocks is increased, the number of switch circuits required correspondingly increases.

Further, the switching timing of the switch circuit is set based on the predicted value of n×Vf (v), but since Vf somewhat varies from LED to LED, the actual value of n×Vf (v) of each LED block differs from the preset value of n×Vf (v). This has led to the problem that even if the switch circuit is set to operate in accordance with the supply voltage, the LEDs in both blocks may not emit light as expected, or conversely, even if the switching is made earlier than the preset timing, the LEDs may emit light; hence, the difficulty in optimizing the light-emission efficiency and the power consumption of the LEDs.

Furthermore, if LED blocks having different impedances are connected in parallel relative to the supply voltage, there arises a need to regulate the current using a current regulating unit because the LEDs contained in each group must be driven at constant current, and hence the problem that power loss occurs.

Patent document 1: Japanese Unexamined Patent Publication No. 2009-283775 (FIG. 1)

SUMMARY

Accordingly, it is an object of the present invention to provide an LED driving circuit that solves the above problems.

It is also an object of the present invention to provide an LED driving circuit that switches the connection of LED blocks with proper timing by switching a current path without the need for a digitally controlled switch circuit.

It is a further object of the present invention to provide an LED driving circuit that switches the connection of LED blocks with proper timing by switching a current path without the need for a digitally controlled switch circuit, while preventing the occurrence of power loss.

An LED driving circuit according to the present invention comprises: a rectifier having a positive power supply output and a negative power supply output; a first circuit which is connected to the rectifier, and which includes a first LED array, a first current detection unit for detecting current flowing through the first LED array, and a first current control unit for controlling current flowing from the first LED array to the negative power supply output in accordance with the current detected by the first current detection unit; and a second circuit which is connected to the rectifier, and which includes a second LED array, a second current detection unit for detecting current flowing through the second LED array, and a second current control unit for controlling current flowing from the positive power supply output to the second LED array in accordance with the current detected by the second current detection unit, and wherein: a current path connecting the first LED array and the second LED array in parallel relative to the rectifier and a current path connecting the first LED array and the second LED array in series relative to the rectifier are formed in accordance with an output voltage of the rectifier.

In the above LED driving circuit, since provisions are made to switch the current path in accordance with the output voltage of the full-wave rectification circuit, there is no need to provide a large number of switch circuits.

Furthermore, in the LED driving circuit according to the present invention, since the switching of the current path is automatically determined in accordance with the output voltage of the full-wave rectification circuit and the sum of the actual Vf's of the individual LEDs contained in each LED block, there is no need to perform control by predicting the switching timing of each LED block from the number of LEDs contained in the LED block, and it thus becomes possible to switch the connection of the respective LED blocks between a series connection and a parallel connection with the most efficient timing.

An alternative LED driving circuit according to present invention comprises: a rectifier; a first LED array connected to the rectifier; a second LED array connected to the rectifier; a third LED array connected to the rectifier; a detection unit which detects current flowing through two adjacent LED arrays selected from among the first, second, and third LED arrays when the two adjacent LED arrays are connected in series; and a current limiting unit which, based on a detection result from the detection unit, limits current flowing from the rectifier to the other one of the first, second, and third LED arrays.

In the above LED driving circuit, since limiting means for limiting the current flowing to the designated LED array is provided in order to prevent the LED arrays having different impedances from being connected in parallel relative to the full-wave rectification circuit, it becomes possible to reduce the power loss and enhance the conversion efficiency of the LED driving circuit.

Further, in the above LED driving circuit, since provisions are made to switch the current path in accordance with the output voltage of the full-wave rectification circuit, there is no need to provide a large number of switch circuits.

Furthermore, in the above LED driving circuit, since the switching of the current path is automatically determined in accordance with the output voltage of the full-wave rectification circuit and the sum of the actual Vf's of the individual LEDs contained in each LED block, there is no need to perform control by predicting the switching timing of each LED block from the number of LEDs contained in the LED block, and it is thus possible to switch the connection of the respective LED blocks between a series connection and a parallel connection with the most efficient timing.

DESCRIPTION OF EMBODIMENTS

LED driving circuits will be described below with reference to the accompanying drawings. It will, however, be noted that the technical scope of the present invention is not limited to the specific embodiments described herein but extends to the inventions described in the appended claims and their equivalents.

Figure 1:
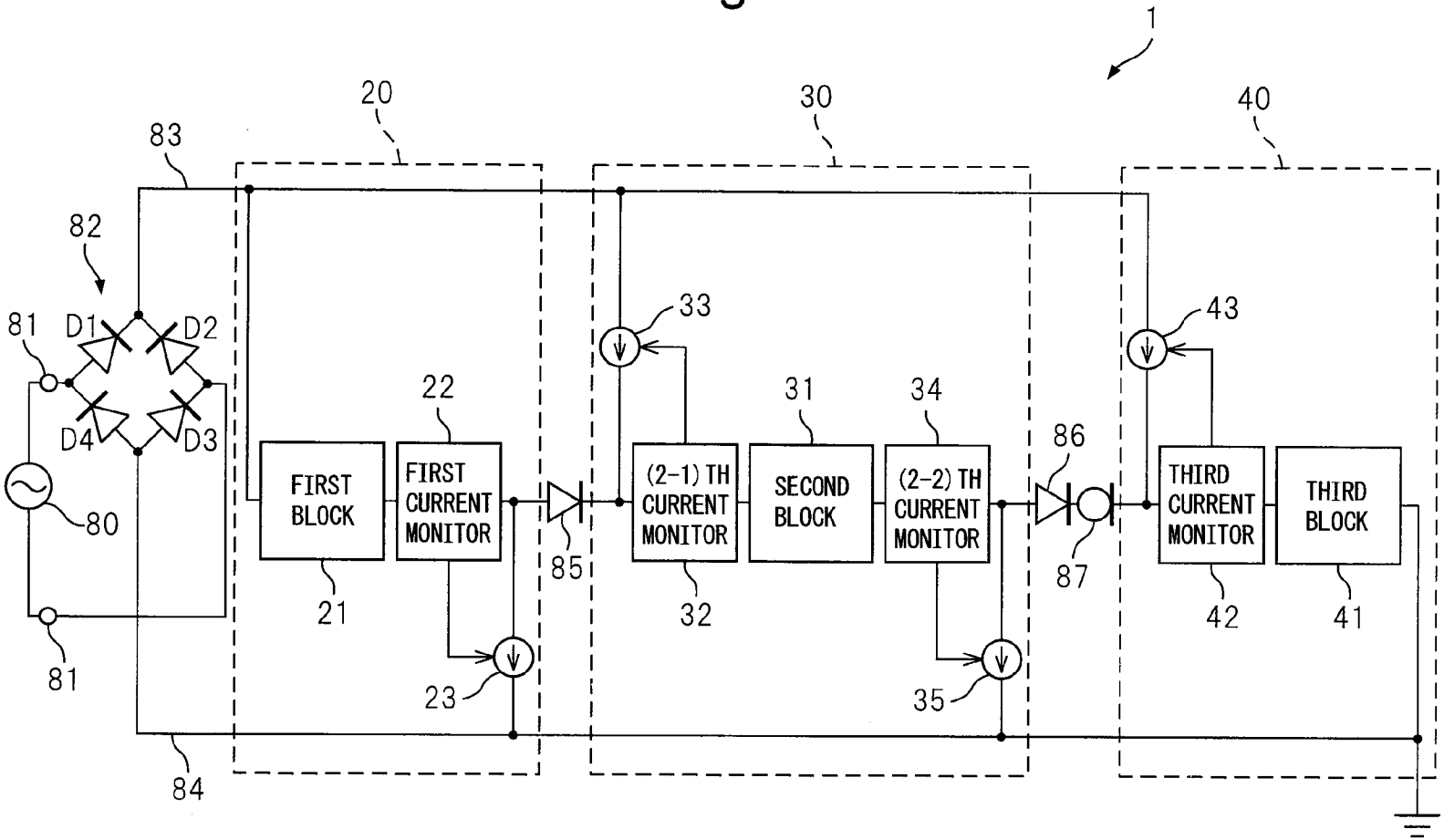
FIG. 1 is an LED driving circuit 1.

FIG. 1 is an explanatory schematic diagram of an LED driving circuit 1.

The LED driving circuit 1 comprises a pair of connecting terminals 81 for connection to an AC commercial power supply (100 VAC) 80, a full-wave rectification circuit 82, a start-point circuit 20, an intermediate circuit 30, an end-point circuit 40, reverse current preventing diodes 85 and 86, and a current regulative diode 87. The start-point circuit 20, the intermediate circuit 30, and the end-point circuit 40 are connected in parallel between a positive power supply output 83 and a negative power supply output 84. The start-point circuit 20 is connected to the intermediate circuit 30 via the diode 85, and the intermediate circuit 30 is connected to the end-point circuit 40 via the diode 86 and the current regulative diode 87.

The start-point circuit 20 includes a first LED block 21 containing a plurality of LEDs, a first current monitor 22 for detecting current flowing through the first LED block 21, and a first current control unit 23. The first current monitor 22 operates so as to limit the current flowing through the first current control unit 23 in accordance with the current flowing through the first LED block 21.

The intermediate circuit 30 includes a second LED block 31 containing a plurality of LEDs, a (2-1)th current monitor 32 and a (2-2)th current monitor 34 for detecting current flowing through the second LED block 31, a (2-1)th current control unit 33, and a (2-2)th current control unit 35. The (2-1)th current monitor 32 performs control so as to limit the current flowing through the (2-1)th current control unit 33 in accordance with the current flowing through the second LED block 31, while the (2-2)th current monitor 34 operates so as to limit the current flowing through the (2-2)th current control unit 35 in accordance with the current flowing through the second LED block 31.

The end-point circuit 40 includes a third LED block 41 containing a plurality of LEDs, a third current monitor 42 for detecting current flowing through the third LED block 41, and a third current control unit 43. The third current monitor 42 operates so as to limit the current flowing through the third current control unit 43 in accordance with the current flowing through the third LED block 41.

Figure 2:
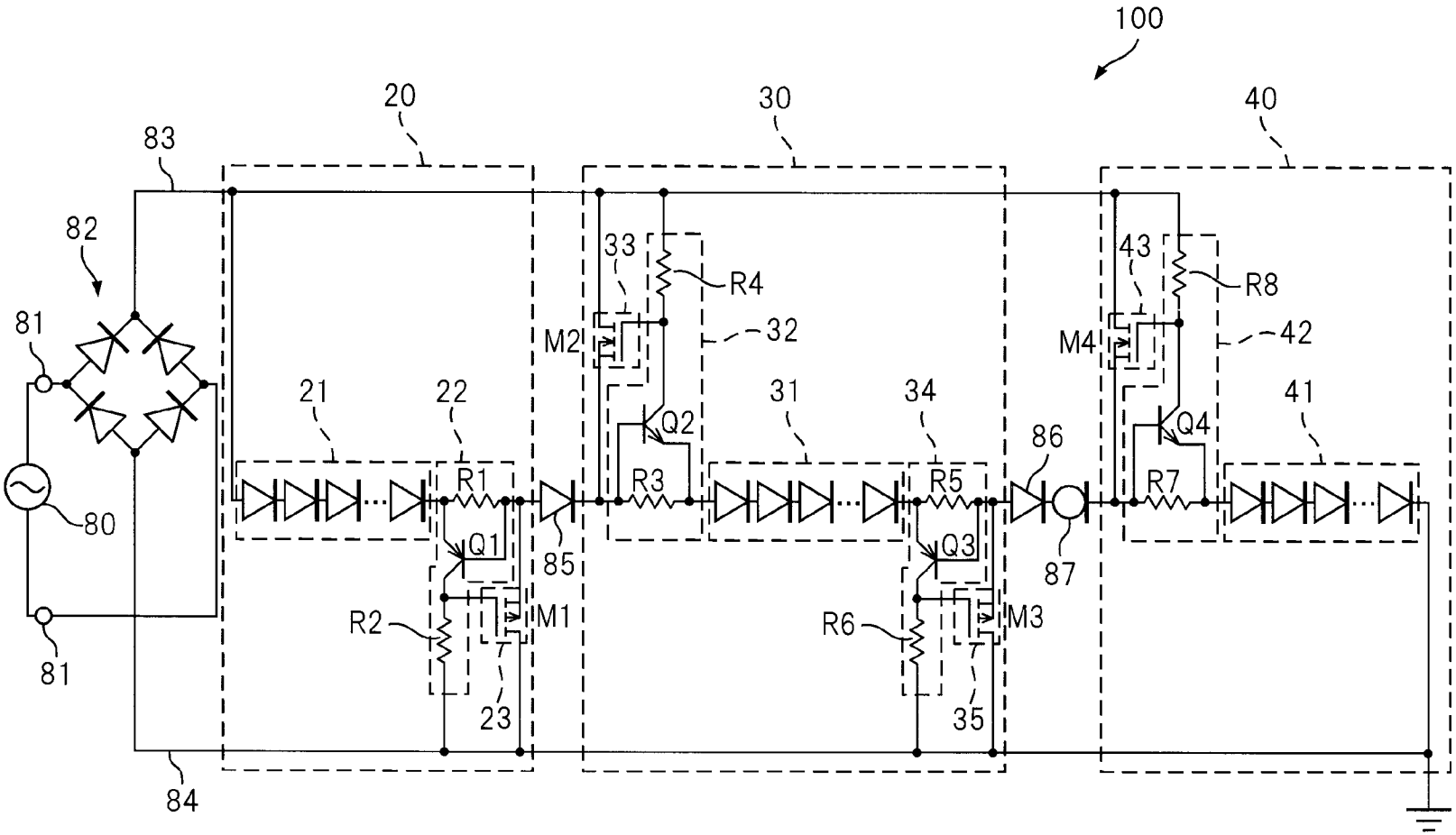
FIG. 2 is a diagram showing a circuit example 100 implementing the LED driving circuit 1 of FIG. 1.

FIG. 2 is a diagram showing a specific circuit example 100 implementing the LED driving circuit 1 of FIG. 1. In the circuit example 100, the same component elements as those in FIG. 1 are designated by the same reference numerals, and the portions corresponding to the respective component elements in FIG. 1 are enclosed by dashed lines.

In the circuit example 100, the pair of connecting terminals 81 is for connection to the AC commercial power supply 80, and is formed as a bayonet base when the LED driving circuit 1 is used for an LED lamp.

The full-wave rectification circuit 82 is a diode bridge circuit constructed from four rectifying elements D1 to D4, and includes the positive power supply output 83 and the negative power supply output 84. The full-wave rectification circuit 82 may be a full-wave rectification circuit that contains a voltage transformer circuit, or a two-phase full-wave rectification circuit that uses a transformer with a center tap.

In the start-point circuit 20, the first LED block 21 contains 10 LEDs connected in series. The first current monitor 22 comprises two resistors R1 and R2 and a transistor Q1, and the first current control unit 23 comprises a P-type MOSFET M1. The voltage drop that occurs across the resistor R1 due to the current flowing through the first LED block 21 causes the base voltage of the transistor Q1 to change. This change in the base voltage of the transistor Q1 causes a change in the emitter-collector current of the transistor Q1 flowing through the resistor R2, in accordance with which the gate voltage of the MOSFET M1 is adjusted to limit the source-drain current of the MOSFET M1.

In the intermediate circuit 30, the second LED block 31 contains 12 LEDs connected in series. The (2-1)th current monitor 32 comprises two resistors R3 and R4 and a transistor Q2, and the (2-1)th current control unit 33 comprises an N-type MOSFET M2. The voltage drop that occurs across the resistor R3 due to the current flowing through the second LED block 31 causes the base voltage of the transistor Q2 to change. This change in the base voltage of the transistor Q2 causes a change in the collector-emitter current of the transistor Q2 flowing through the resistor R4, in accordance with which the gate voltage of the MOSFET M2 is adjusted to limit the source-drain current of the MOSFET M2. The (2-2)th current monitor 34 comprises two resistors R5 and R6 and a transistor Q3, and the (2-2)th current control unit 35 comprises a P-type MOSFET M3. The (2-2)th current monitor 34 and the (2-2)th current control unit 35 operate in the same manner as the first current monitor 22 and the first current control unit 23.

In the end-point circuit 40, the third LED block 41 contains 14 LEDs connected in series. The third current monitor 42 comprises two resistors R7 and R8 and a transistor Q4, and the third current control unit 43 comprises an N-type MOSFET M4. The third current monitor 42 and the third current control unit 43 operate in the same manner as the (2-1)th current monitor 32 and the (2-1)th current control unit 33.

In the circuit example 100, the 10 series-connected LEDs contained in the first LED block 21 emit light when a voltage approximately equal to a first forward voltage V1 ($10\times Vf=10\times3.2=32.0$ (v)) is applied across the first LED block 21. On the other hand, the 12 series-connected LEDs contained in the second LED block 31 emit light when a voltage approximately equal to a second forward voltage V2 ($12\times Vf=12\times3.2=38.4$ (v)) is applied across the second LED block 31. Likewise, the 14 series-connected LEDs contained in the third LED block 41 emit light when a voltage approximately equal to a third forward voltage V3 ($14\times Vf=14\times3.2=44.8$ (v)) is applied across the third LED block 41.

When a voltage approximately equal to a fourth forward voltage V4 ($(10+12)\times3.2=70.4$ (v)) is applied across a series connection of the first LED block 21 and the second LED block 31, the LEDs contained in the first and second LED blocks 21 and 31 emit light. Likewise, when a voltage approximately equal to a fifth forward voltage V5 ($(10+12+14)\times3.2=115.2$ (v)) is applied across a series connection of the first LED block 21, the second LED block 31, and the third LED block 41, the LEDs contained in the first, second, and third LED blocks 21, 31, and 41 emit light.

In the case of the commercial power supply voltage of 100 (V), the maximum voltage is about 141 (V). The voltage stability should take into account a variation of about ±10%. The forward voltage of each of the rectifying elements D1 to D4 of the full-wave rectification circuit 82 is 1.0 (V); therefore, in the circuit example 100, when the commercial power supply voltage is 100 (V), the maximum output voltage of the full-wave rectifier circuit 82 is about 139 (V). The total number of LEDs in the first, second, and third LED blocks 21, 31, and 41 has been chosen to be 36 so that the voltage given as the total number $(n)\times Vf$ ($36\times3.2=115.2$), when all the LEDs are connected in series, does not exceed the maximum output voltage of the full-wave rectification circuit 82. As earlier noted, the forward voltage Vf of each LED is 3.2 (v), but the actual value varies somewhat among the individual LEDs.

It should be noted that the circuit configuration shown in the circuit example 100 of FIG. 2 is only illustrative and not restrictive, and that various changes and modifications can be made to the configuration including the number of LEDs contained in each of the first, second, and third LED blocks 21, 31, and 41.

Figure 3:
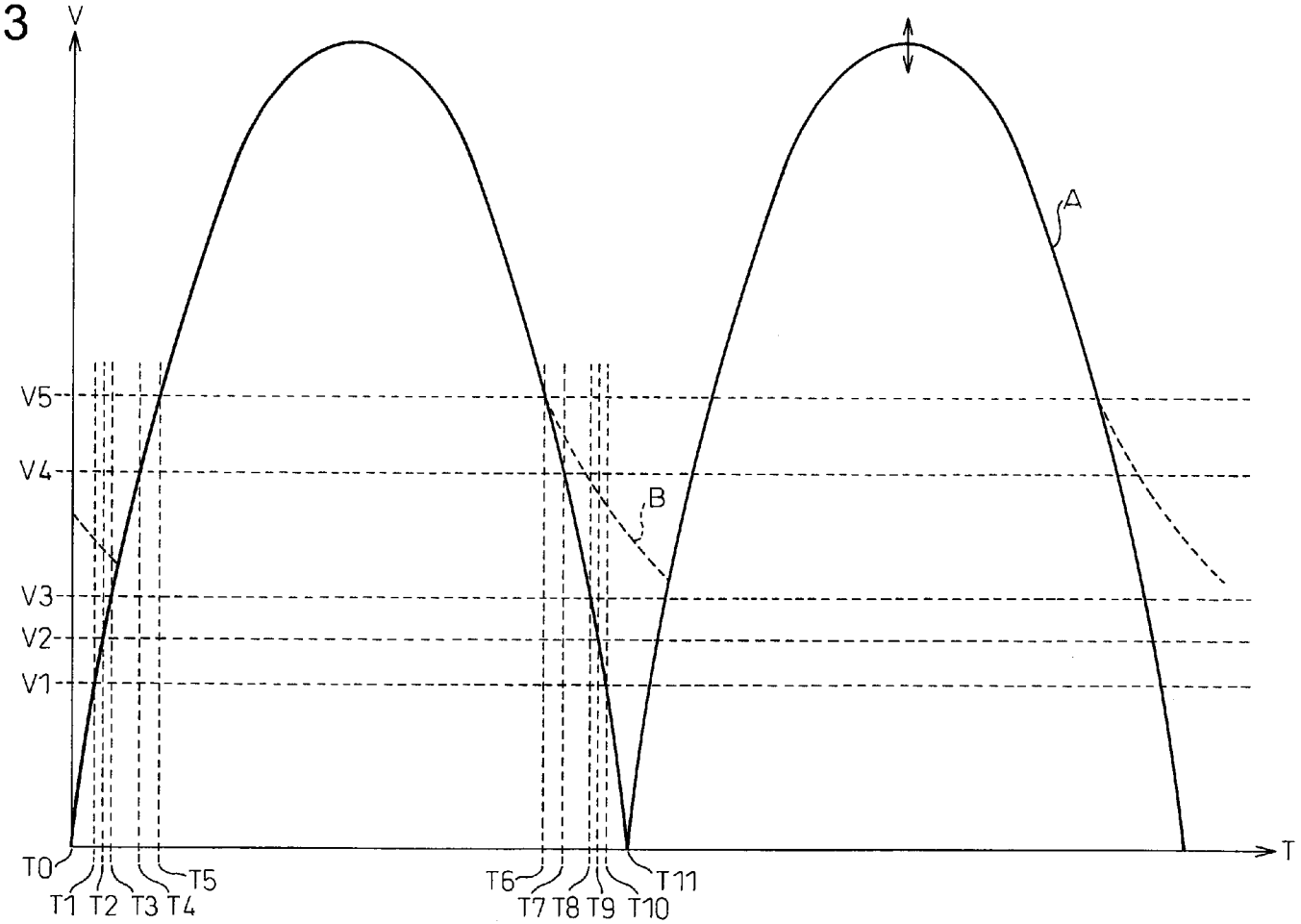
FIG. 3 is a diagram showing an output voltage waveform example of a full-wave rectification circuit 82.

The operation of the circuit example 100 will be described below with reference to FIGS. 3 to 5. FIG. 3 is a diagram showing an output voltage waveform example A of the full-wave rectification circuit 82, FIG. 4 is a diagram showing an example of the LED block switching sequence in the circuit example 100, and FIG. 5 is an excerpt from FIG. 1 and shows current flows.

At time T0 (see FIG. 3) when the output voltage of the full-wave rectification circuit 82 is 0 (v), since the voltage for causing any one of the first, second, and third LED blocks 21, 31, and 41 to emit light is not reached yet, the LEDs contained in any of the LED blocks remain OFF.

Figure 4:
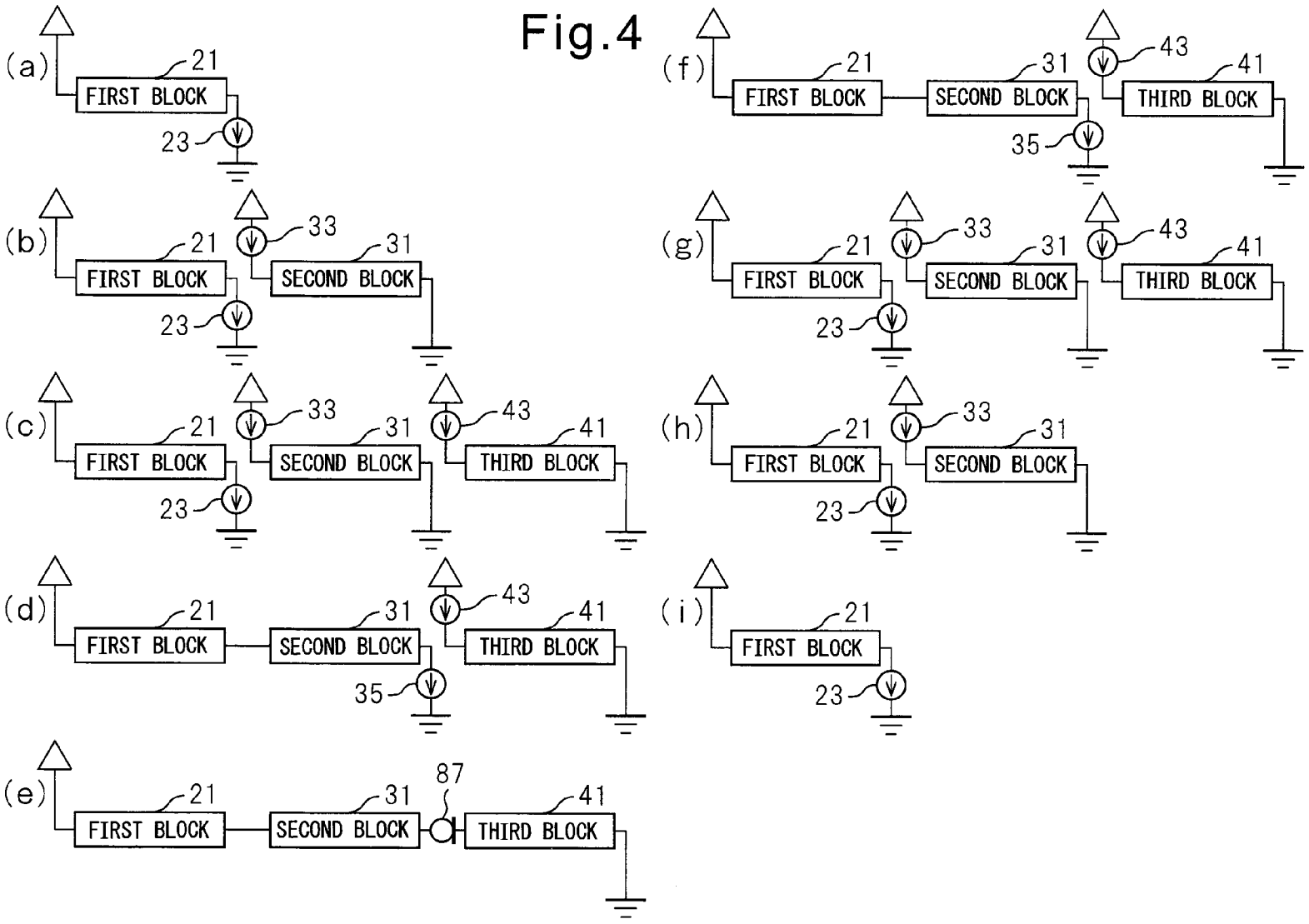
FIG. 4 is a diagram showing an example of an LED block switching sequence in the circuit example 100.
Figure 5:
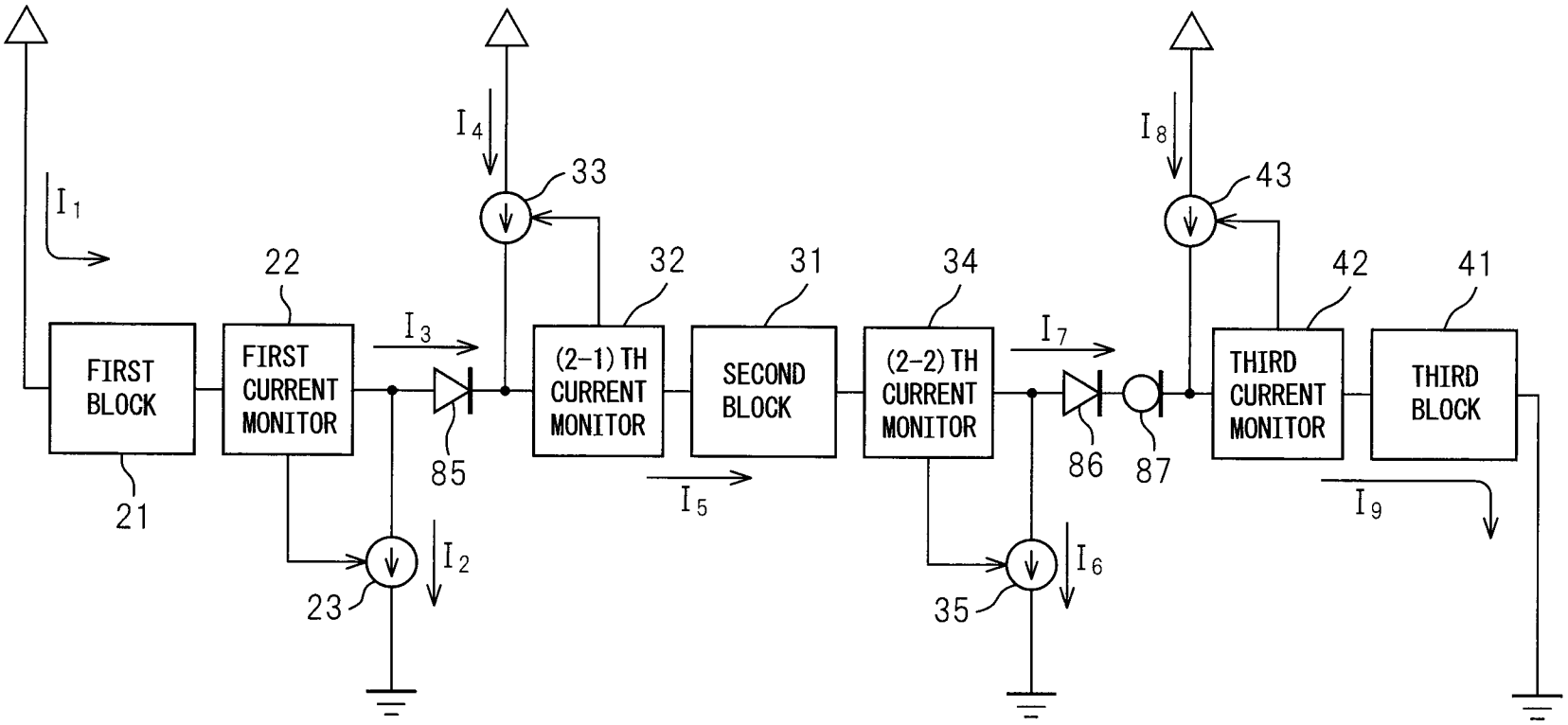
FIG. 5 is a diagram for explaining the operation of FIG. 4.

At time T1 (see FIG. 3) when the output voltage of the full-wave rectification circuit 82 reaches the first forward voltage V1 sufficient to cause the first LED block 21 to emit light, a current path passing through the first LED block 21 is formed, and the LEDs contained in the first LED block 21 emit light (see FIG. 4(*a*)). Here, since Vf varies among the individual LEDs in the first LED block 21, as earlier described, whether the LEDs actually begin to emit light at the first forward voltage V1 (32.0 (v)) depends on the actual circuit. Anyway, when the voltage equal to the sum of the Vf's of the 10 LEDs contained in the first LED block 21 is applied, the 10 LEDs contained in the first LED block begin to emit light. When the output voltage of the full-wave rectification circuit 82 further rises, the forward voltage of the first LED block 21 remains the same at V1 (the sum of the Vf's of the LEDs), because the first LED block 21 is driven at constant current. The same applies for the second to fifth forward voltages V2 to V5.

At time T2 (see FIG. 3) when the output voltage of the full-wave rectification circuit 82 reaches the second forward voltage V2 sufficient to cause the second LED block 31 to emit light, current paths are formed that connect the first LED block 21 and the second LED block 31 in parallel relative to the output of the full-wave rectification circuit 82, and the LEDs contained in the first and second LED blocks 21 and 31 emit light (see FIG. 4(*b*)).

Next, the transition from FIG. 4(*a*) to FIG. 4(*b*) will be described.

The first LED block 21, the second LED block 31, and the third LED block 41 are respectively connected in parallel relative to the full-wave rectification circuit 82, and the first LED block 21, the second LED block 31, and the third LED block 41 are connected to each other by interposing the reverse current preventing diodes 85 and 86, respectively.

At time T1 (see FIG. 3), the output voltage of the full-wave rectification circuit 82 is equal to the first forward voltage V1, which means that the voltage for causing the LEDs contained in the first LED block 21 to emit light is applied, but the forward voltages V2 and V3 for causing the second LED block 31 and the third LED block respectively to emit light are not applied. Accordingly, current $I_1$ flows as current $I_2$ from the positive power supply output of the full-wave rectification circuit 82 to the first LED block 21, and further flows as current $I_2$ into the negative power supply output of the full-wave rectification circuit 82. However, neither current $I_4$ nor current $I_8$ flows. Further, in this case, since the diode 85 is reverse biased, current $I_3$ does not flow.

The first current monitor 22 detects the current flowing through the first LED block 21 and controls the first current control unit 23 so that $I_2$ is held at a predefined value. Assume here that the set value of the current $I_2$ set in the first current monitor 22 is denoted by S2. When the supply current flows, voltage is applied to the gate of the MOSFET M1 through the biasing resistor R2 in the first current monitor 22, causing the MOSFET M1 to turn on. The same current $I_1$ also flows through the monitor resistor R1 in the first current monitor 22.

At this time, if the current $I_1$ flowing through the monitor resistor R1 increases above the predefined current value, the base voltage of the transistor Q1 exceeds a threshold voltage, thus causing the transistor Q1 to turn on. Thereupon, the gate voltage of the MOSFET M1 in the first current control unit 23 is pulled to a high potential level, and the impedance of the MOSFET M1 increases, thus operating to reduce the current flowing through the first LED block 21.

Conversely, if the current $I_1$ flowing through the first LED block 21 decreases, the impedance of the MOSFET M1 becomes lower, thus operating to increase the current $I_1$ flowing through the first LED block 21. By repeating this process, the current $I_1$ flowing through the first LED block 21 is controlled to a constant value. That is, by adjusting the impedance of the first current control unit 23, the first current monitor 22 adjusts the current so that the current flowing through the first LED block 21 does not increase above the predefined value. In this state, $I_1=I_2$.

When the time elapses from T1 to T2 (see FIG. 3), the output voltage of the full-wave rectifier circuit 82 reaches the second forward voltage V2, and the voltage for causing the LEDs contained in the first and second LED blocks 21 and 31 to emit light is applied, but the voltage falls short of the voltage for causing the third LED block 41 to emit light. Accordingly, current $I_1$ flows into the first LED block 21, and current $I_4$ flows into the second LED block 31, but current $I_8$ does not flow. Further, in this case, since the diodes 85 and 86 are both reverse biased, neither current $I_3$ nor current $I_7$ flows.

The (2-1)th current monitor 32 detects the current flowing through the second LED block 31 and controls the (2-1)th current control unit 33 so that current $I_4$ is held at a predefined value. The circuit configuration is such that the (2-2)th current monitor 34 can detect the current flowing through the second LED block 31 and control the (2-2)th current control unit 35 so that current $I_6$ is held at the predefined value. In this state, $I_4=I_5=I_6$.

In this way, the transition is made from the state of FIG. 4(*a*) to the state of FIG. 4(*b*). When the output voltage of the full-wave rectifier circuit 82 reaches the third forward voltage V3 at time T3 (see FIG. 3), the transition is made from the state of FIG. 4(*b*) to the state of FIG. 4(*c*) in much the same way as described above.

Next, the transition from FIG. 4(*c*) to FIG. 4(*d*) will be described.

At time T4 (see FIG. 3) when the output voltage of the full-wave rectifier circuit 82 reaches the fourth forward voltage V4 sufficient to cause all the LEDs contained in the first and second LED blocks 21 and 31 to emit light even if the first and second LED blocks 21 and 31 are connected in series, the current path is switched so that the first and second LED blocks 21 and 31 are connected in series relative to the full-wave rectifier circuit 82 (see FIG. 4(*d*)).

In the state of FIG. 4(*c*), $I_1=I_2$, $I_4=I_5=_6$, and $I_8=I_9$, and since the diodes 85 and 86 are both reverse biased, neither current $I_3$ nor current $I_7$ flows. Here, the set value S4 of the current $I_4$ set in the (2-1)th current monitor 32 is lower than the set value S6 of the current $I_6$ set in the (2-2)th current monitor 34. Therefore, it is the (2-1)th current control unit 33 that controls the flowing current, and the impedance of the (2-2)th current control unit 35 is held extremely low.

When the output voltage of the full-wave rectifier circuit 82 rises from the third forward voltage V3 to the fourth forward voltage V4, the first current monitor 22 controls the first current control unit 23 so as to limit the current $I_3$. At this time, when the output voltage of the full-wave rectifier circuit 82 rises, since the forward voltage of the first LED block 21 remains constant at V1, control is performed so that the voltage drop at the first current control unit 23 increases, that is, the impedance of the first current control unit 23 increases.

In this way, during the transition from FIG. 4(*c*) to FIG. 4(*d*), the voltage drop at the first current control unit 23 and the voltage drop at the (2-1)th current control unit 33 both increase. The diode 85 which has so far been reverse biased begins to be forward biased, and the current $I_3$ begins to flow. Then, the first current monitor 22 operates so as to increase the impedance of the first current control unit 23 and thus reduce the current $I_2$.

Further, since the current $I_3$ is added to the current $I_4$ currently being monitored, the (2-1)th current monitor 32 performs control to reduce the current $I_4$ in the (2-1)th current control unit 33, i.e., to increase the impedance of the (2-1)th current control unit 33. As a result, the currents $I_2$ and $I_4$ gradually decrease and finally drop to almost zero, achieving the state $I_1=I_3=I_5=I_6$ (the state of FIG. 4(*d*)). At this time, the first current control unit 23 and the (2-1)th current control unit 33 are both in a high impedance state. Then, the (2-2) current monitor 34 controls the impedance of the (2-2)th current control unit 35 so that the current defined by the set value S6 of the current $I_6$ flows.

Next, the transition from FIG. 4(*d*) to FIG. 4(*e*) will be described.

At time T5 (see FIG. 3) when the output voltage of the full-wave rectifier circuit 82 reaches the fifth forward voltage V5 sufficient to cause all the LEDs contained in the first, second, and third LED blocks 21, 31, and 41 to emit light even if the first, second, and third LED blocks 21, 31, and 41 are connected in series, the current path is switched so that the first, second, and third LED blocks 21, 31, and 41 are connected in series relative to the full-wave rectifier circuit 82 (see FIG. 4(*e*)).

The third current monitor 42 is controlling the impedance of the third current control unit 43. The voltage drop at the third current control unit 43 is gradually increasing. In this situation, the diode 86 which has so far been reverse biased begins to be forward biased, and the current $I_7$ begins to flow into the end-point circuit 40.

When the output voltage of the full-wave rectifier circuit 82 rises from the fourth forward voltage V4 to the fifth forward voltage V5, the (2-2)th current monitor 34 controls the impedance of the (2-2)th current control unit 35 so as to limit the current $I_6$. In the meantime, the voltage drop at the (2-2)th current control unit 35 is gradually increasing. Since the current $I_7$ is added to the current $I_8$ currently being monitored, the third current monitor 42 performs control to increase the impedance of the third current control unit 43 and thus reduce the current $I_8$. Likewise, the (2-2)th current monitor 34 performs control to increase the impedance of the (2-2)th current control unit 35 and thus reduce the current $I_6$. As a result, the currents $I_6$ and $I_8$ gradually decrease and finally drop to almost zero, achieving the state $I_1=I_3=I_5=I_7=I_9$ (the state of FIG. 4(*e*)).

In the state of FIG. 4(*e*), since $I_1=I_3=I_5=I_7=I_9$, the current flowing in this state is the set current S7 of the current regulative diode 87. Further, in this state, hardly any of the other currents $I_2$, $I_4$, $I_6$, and $I_8$ flows. In order to allow very little of the other currents to flow, the set current S7 of the current regulative diode 87 is chosen in advance to be higher than any of the other set currents S2, S4, S6, and S8.

Next, the transition from FIG. 4(*e*) to FIG. 4(*f*) will be described.

At time T6 (see FIG. 3) when the output voltage of the full-wave rectifier circuit 82 drops below the fifth forward voltage V5, the (2-2)th current monitor 34 controls the (2-2)th current control unit 35 so as to relax the limit on the current $I_6$. Then, the current $I_6$ gradually begins to flow, and the current $I_7$ drops. When the current $I_7$ drops, the current $I_g$ drops; as a result, the third current monitor 42 controls the third current control unit 43 so as to relax the limit on the current $I_8$. Then, the current $I_8$ gradually begins to flow, and thus the transition is made from the state of FIG. 4(*e*) to the state of FIG. 4(*f*). Since S6<S2, as earlier described, the series connection between the second and third LED blocks 31 and 41 is cut off earlier than the series connection between the first and second LED blocks 21 and 31.

Next, the transition from FIG. 4(*f*) to FIG. 4(*g*) will be described.

At time T7 (see FIG. 3), the output voltage of the full-wave rectifier circuit 82 drops below the fourth forward voltage V4, which means that the output voltage drops below the voltage sufficient to drive all the LEDs contained in the first and second LED blocks 21 and 31 connected in series; as a result, the currents $I_2$ and $I_4$ begin to flow, and thus the transition is made to the state in FIG. 4(*g*).

Next, the transition from FIG. 4(*g*) to FIG. 4(*h*) will be described.

At time T8 (see FIG. 3), the output voltage of the full-wave rectifier circuit 82 drops below the third forward voltage V3, which means that the output voltage drops below the voltage sufficient to drive all the LEDs contained in the third LED block 41; as a result, the current $I_7$, $I_8$, and $I_9$ cease to flow, and thus the transition is made to the state of FIG. 4(*h*).

Next, the transition from FIG. 4(*h*) to FIG. 4(*i*) will be described.

At time T9 (see FIG. 3), the output voltage of the full-wave rectifier circuit 82 drops below the second forward voltage V2, which means that the output voltage drops below the voltage sufficient to drive all the LEDs contained in the second LED block 31; as a result, the current $I_3$ to $I_9$ cease to flow, and thus the transition is made to the state in FIG. 4(*i*).

At time T10 (see FIG. 3), the output voltage of the full-wave rectifier circuit 82 drops below the first forward voltage V1, which means that the output voltage drops below the voltage sufficient to drive all the LEDs contained in the first LED block 21; as a result, all of the current $I_1$ to $I_9$ cease to flow. By repeating the process from time T0 to time T11 (time T11 corresponds to time T0 in the next cycle), the LEDs contained in the first, second, and third LED blocks 21, 31, and 41, respectively, are caused to emit light as described above.

The reverse current preventing diode 85 prevents the current from accidentally flowing from the intermediate circuit 30 back to the start-point circuit 20 and thereby damaging the LEDs contained in the first LED block 21. Likewise, the reverse current preventing diode 86 prevents the current from accidentally flowing from the end-point circuit 40 back to the intermediate circuit 30 and thereby damaging the LEDs contained in the second LED block 31. Each of the current control units contained in the start-point circuit 20, the intermediate circuit 30, and the end-point circuit 40, respectively, controls the current by adjusting its impedance. At this time, the voltage drop at the current control unit also changes. Then, when the reverse current preventing diode 85 or 86, respectively, is forward biased, the current so far blocked gradually begins to flow, and the current path is switched as described above.

The current regulative diode 87 prevents overcurrent from flowing through the first, second, and third LED blocks 21, 31, and 41, in particular, in the situation of FIG. 4(*e*). As can be seen from FIGS. 4(*a*) to 4(*i*), in any other state than the state of FIG. 4(*e*), at least one of the current control units is connected in the current path, so that overcurrent can be prevented from flowing through the respective LED blocks. However, in the state of FIG. 4(*e*), since no current control units are connected in the current path, the current regulative diode 87 is inserted as illustrated. While the current regulative diode 87 is shown as being inserted between the end-point circuit 40 and the intermediate circuit 30, it may be inserted at some other suitable point as long as it is located in the current path formed in the state in FIG. 4(*e*). Further, a plurality of current regulative diodes may be inserted at various points along the current path formed in the state of FIG. 4(*e*). Furthermore, the current regulative diode 87 may be replaced by a current regulating circuit or device, such as a constant current circuit or a high power resistor, that can prevent overcurrent from flowing through the first, second, and third LED blocks 21, 31, and 41 in the situation in FIG. 4(*e*).

As described above, in the circuit example 100, since provisions are made to switch the current path in accordance with the output voltage of the full-wave rectification circuit 82, there is no need to provide a large number of switch circuits. Furthermore, since the switching of the current path is automatically determined in accordance with the output voltage of the full-wave rectification circuit 82 and the sum of the actual Vf's of the individual LEDs contained in each LED block, there is no need to perform control by predicting the switching timing of each LED block from the number of LEDs contained in the LED block, and it is thus possible to switch the connection of the respective LED blocks between a series connection and a parallel connection with the most efficient timing.

Figure 6:
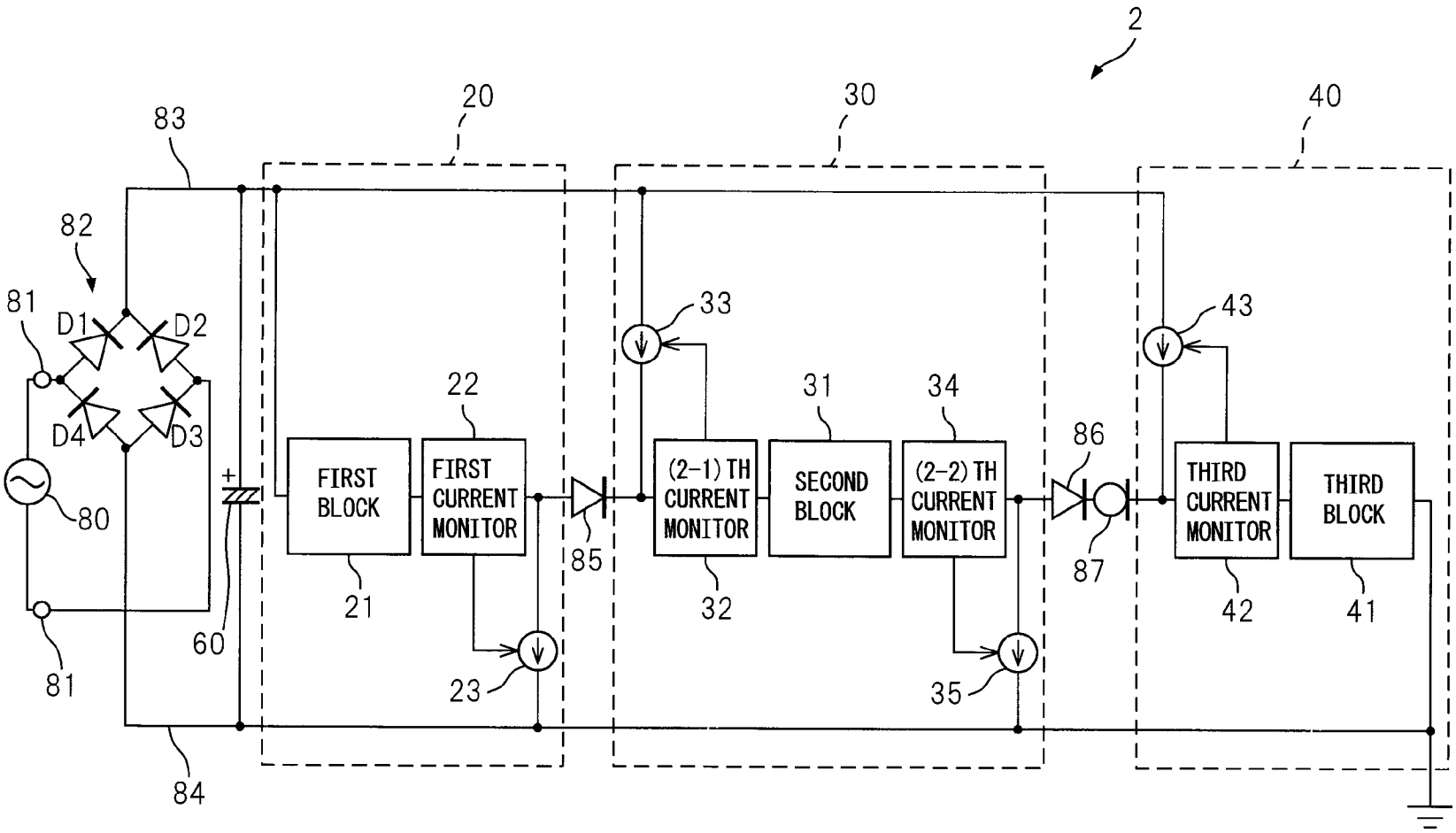
FIG. 6 is a diagram schematically illustrating the configuration of an alternative LED driving circuit 2.

FIG. 6 is an explanatory schematic diagram of an alternative LED driving circuit 2.

The LED driving circuit 2 shown in FIG. 6 differs from the LED driving circuit 1 shown in FIG. 1 only in that the LED driving circuit 2 includes an electrolytic capacitor 60 which is inserted between the output terminals of the full-wave rectification circuit 82.

The output voltage waveform of the full-wave rectification circuit 82 is smoothed by the electrolytic capacitor 60 (see the voltage waveform B in FIG. 3). In the case of the output voltage waveform A of the LED driving circuit 1 shown in FIG. 1, all the LEDs are OFF during the period from time T0 to time T1 and the period from time T10 to time T11, because the output voltage is lower than the first forward voltage V1. Accordingly, in the LED driving circuit 1 shown in FIG. 1, the LED-off period alternates with the LED-on period, which means that the LEDs are switched on and off at 100 Hz when the commercial power supply frequency is 50 Hz and at 120 Hz when the commercial power supply frequency is 60 Hz.

By contrast, in the LED driving circuit 2 shown in FIG. 6, since the output voltage waveform of the full-wave rectification circuit 82 is smoothed, the output voltage of the full-wave rectification circuit 82 is always higher than the third forward voltage V3, and all the LED blocks are ON (see dashed line B in FIG. 3). Alternatively, provisions may be made so that the output voltage of the full-wave rectification circuit 82 is always higher than the first forward voltage V1. The LED driving circuit 2 shown in FIG. 6 can thus prevent the LEDs from switching on and off.

In the example of FIG. 6, the electrolytic capacitor 60 has been added, but instead of the electrolytic capacitor 60, use may be made of a ceramic capacitor or some other device or circuit for smoothing the output voltage waveform of the full-wave rectification circuit 82. Further, in order to improve power factor by suppressing harmonic currents, a coil may be inserted on the AC input side before the diode bridge of the full-wave rectification circuit 82 or at the rectifier output side after the diode bridge.

Figure 7:
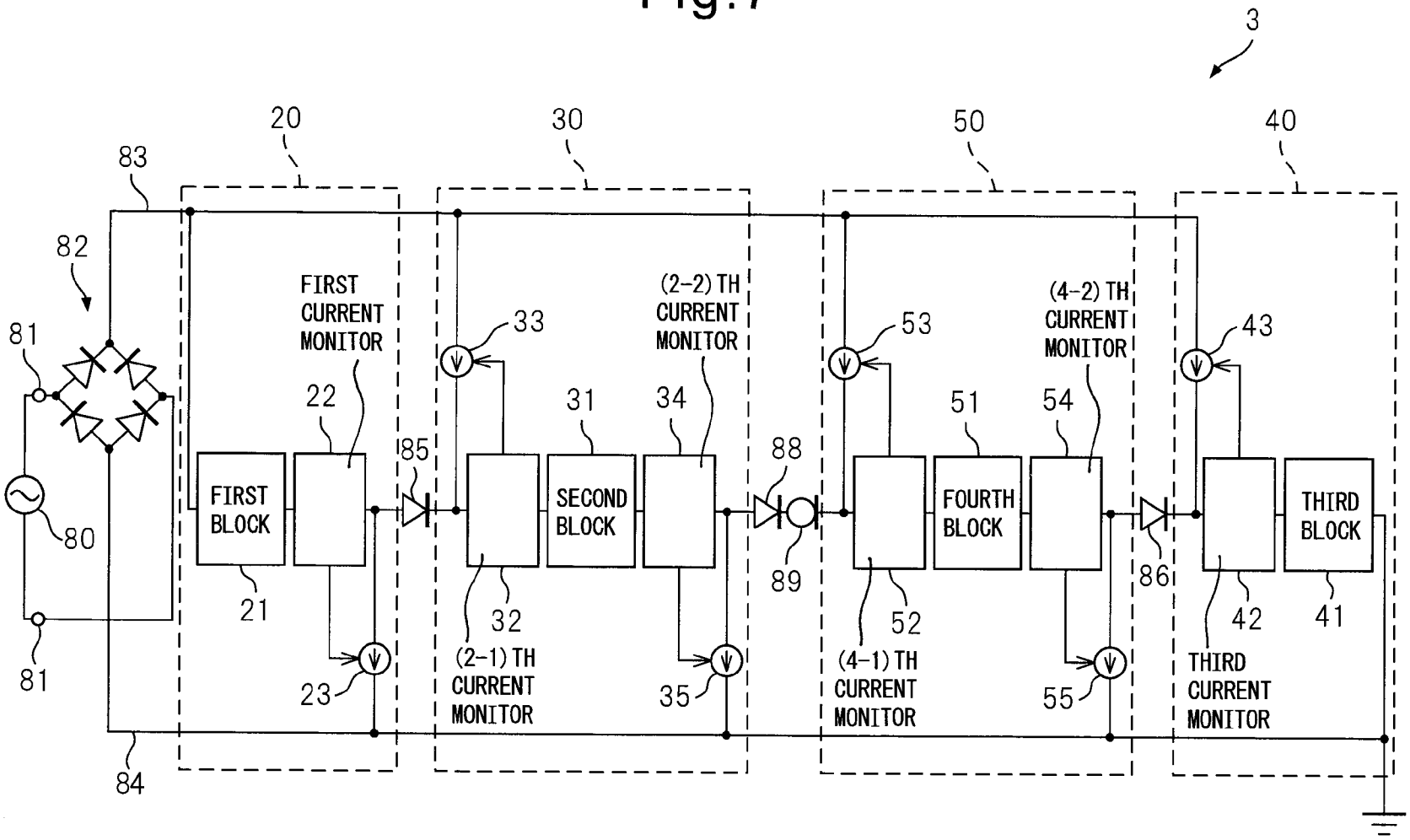
FIG. 7 is a diagram schematically illustrating the configuration of another alternative LED driving circuit 3.

FIG. 7 is a diagram schematically illustrating the configuration of another alternative LED driving circuit 3.

In the LED driving circuit 3 shown in FIG. 7, the same components as those in the LED driving circuit 1 shown in FIG. 1 are designated by the same reference numerals, and will not be further described herein. The LED driving circuit 3 shown in FIG. 7 differs from the LED driving circuit 1 shown in FIG. 1 by the inclusion of a second intermediate circuit 50 between the intermediate circuit 30 (hereinafter referred to as "first intermediate circuit 30") and the end-point circuit 40 and the inclusion of a reverse current preventing diode 88 and a current regulative diode 89 between the first intermediate circuit 30 and the second intermediate circuit 50.

The second intermediate circuit 50 includes a fourth LED block 51 containing a plurality of LEDs, a (4-1)th current monitor 52 and a (4-2)th current monitor 54 for detecting current flowing through the fourth LED block 51, a (4-1)th current control unit 53, and a (4-2)th current control unit 55. The (4-1)th current monitor 52 operates so as to limit the current flowing through the (4-1)th current control unit 53 in accordance with the current flowing through the fourth LED block 51, while the (4-2)th current monitor 54 operates so as to limit the current flowing through the (4-2)th current control unit 55 in accordance with the current flowing through the fourth LED block 51. The specific circuit configuration of the second intermediate circuit 50 may be the same as that employed for the first intermediate circuit 30 shown in FIG. 2.

In the LED driving circuit 3 also, the total number of LEDs in the first to fourth LED blocks 21 to 51 has been chosen to be 39 so that the voltage given as the total number (n)×Vf (39×3.2=124.8), when all the LEDs are connected in series, exceeds 80% of the instantaneous maximum voltage value. The operation of the LED driving circuit 3 will be described below by dealing with the circuit example in which the first LED block 21 contains 8 LEDs, the second LED block 31 contains 9 LEDs, the third LED block 41 contains 12 LEDs, and the fourth LED block 51 contains 10 LEDs.

In this case, the 8 series-connected LEDs contained in the first LED block 21 emit light when a voltage approximately equal to a first forward voltage V1 (8×3.2=25.6 (v)) is applied across the first LED block 21. On the other hand, the 9 series-connected LEDs contained in the second LED block 31 emit light when a voltage approximately equal to a second forward voltage V2 (9×3.2=28.8 (v)) is applied across the second LED block 31. Likewise, the 10 series-connected LEDs contained in the fourth LED block 51 emit light when a voltage approximately equal to a third forward voltage V3 (10×3.2=32.0 (v)) is applied across the fourth LED block 51. In the third LED block 41, the 12 LEDs connected in series emit light when a voltage approximately equal to a fourth forward voltage V4 (12×3.2=38.4 (v)) is applied across the third LED block 41.

When a voltage approximately equal to a fifth forward voltage V5 ((8+9)×3.2=54.4 (v)) is applied across a series connection of the first LED block 21 and the second LED block 31, the LEDs contained in the first and second LED blocks 21 and 31 emit light. Likewise, when a voltage approximately equal to a sixth forward voltage V6 ((10+12)×3.2=70.4 (v)) is applied across a series connection of the third LED block 41 and the fourth LED block 51, the LEDs contained in the third and fourth LED blocks 41 and 51 emit light. Further, when a voltage approximately equal to a seventh forward voltage V7 ((8+9+10+12)×3.2=124.8 (v)) is applied across a series connection of the first to fourth LED blocks 21 to 51, the LEDs contained in the first to fourth LED blocks 21 to 51 emit light.

Figure 8:
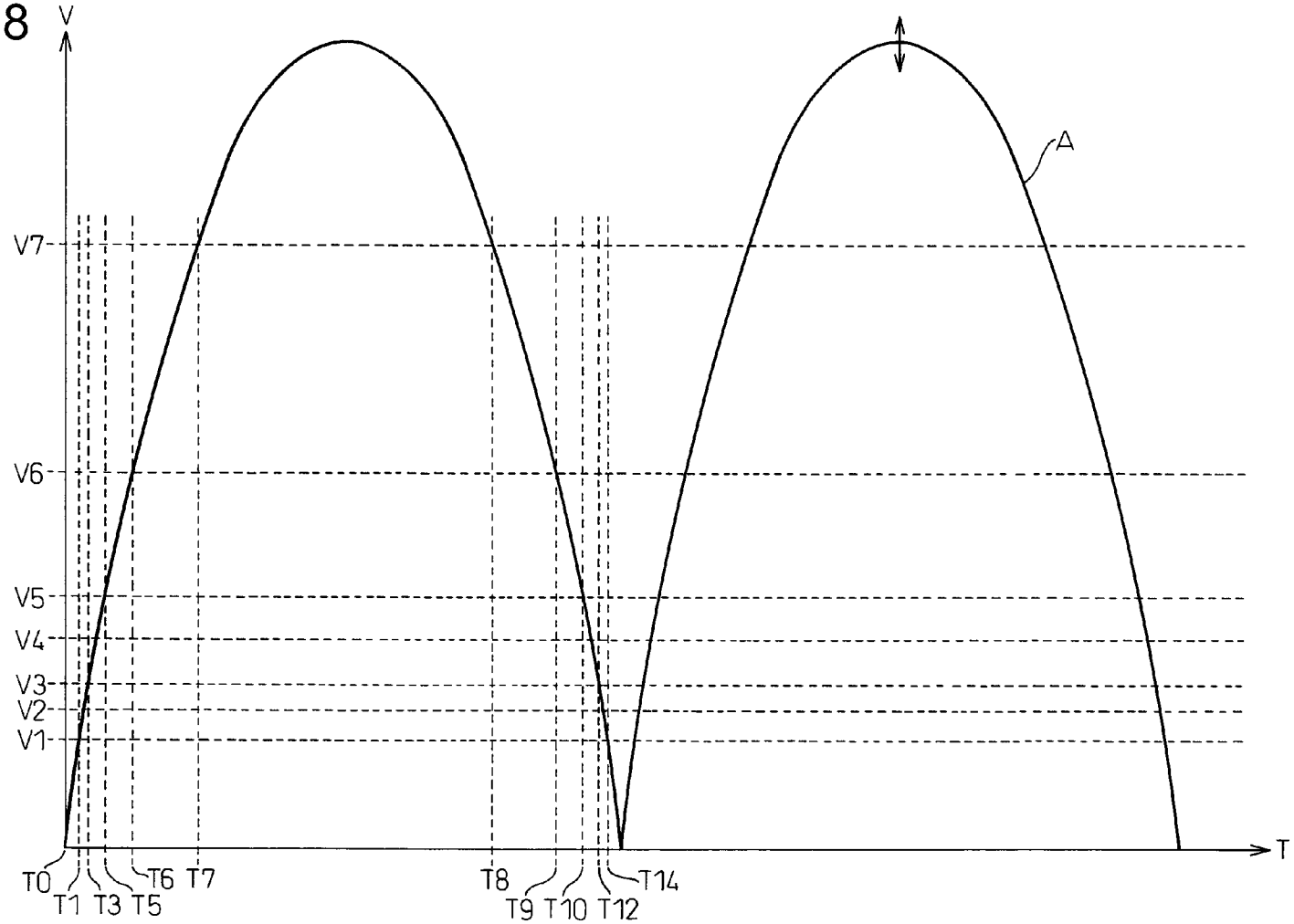
FIG. 8 is a diagram showing an output voltage waveform example of the full-wave rectification circuit 82.

The operation of the LED driving circuit 3 will be described below with reference to FIGS. 8 to 10. FIG. 8 is a diagram showing an output voltage waveform example A of the full-wave rectification circuit 82, and FIGS. 9 and 10 are diagrams showing an example of the LED block switching sequence in the LED driving circuit 3.

At time T0 (see FIG. 8) when the output voltage of the full-wave rectification circuit 82 is 0 (v), since the voltage for causing any one of the first to fourth LED blocks 21 to 51 to emit light is not reached yet, the LEDs contained in any of the LED blocks remain OFF.

Figure 9:
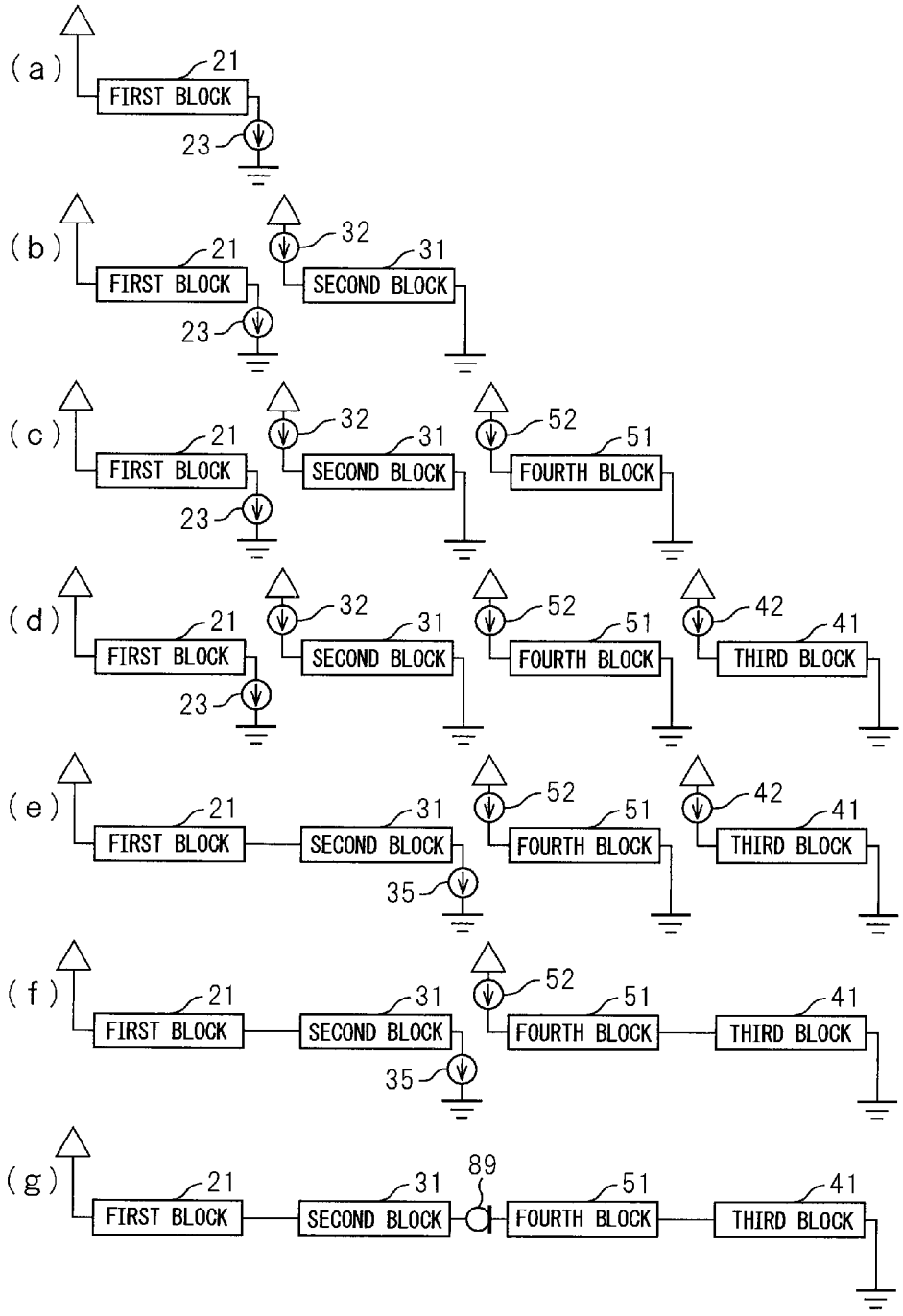
FIG. 9 is a diagram (part 1) showing an example of an LED block switching sequence in the LED driving circuit 3.
Figure 10:
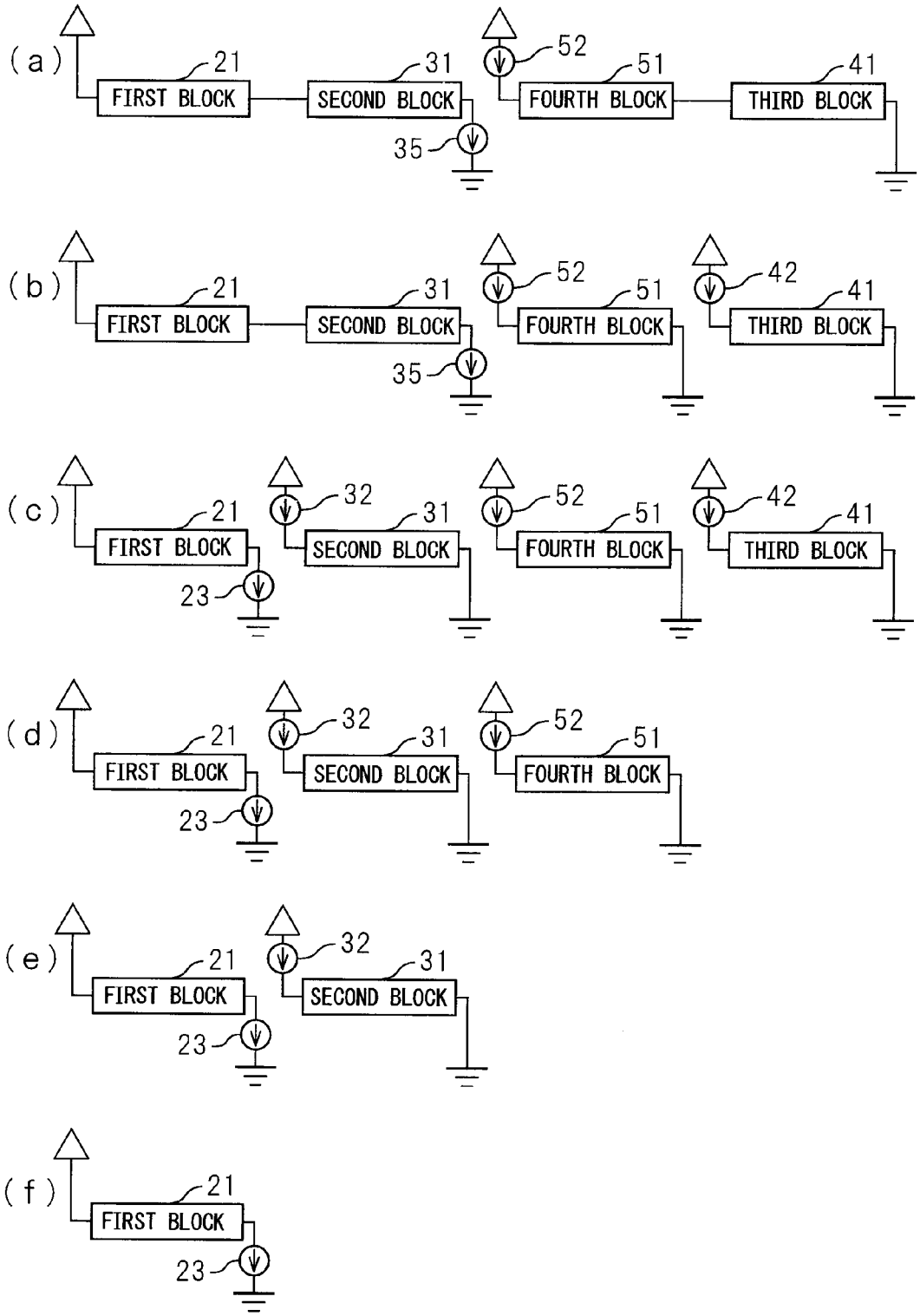
FIG. 10 is a diagram (part 2) showing an example of an LED block switching sequence in the LED driving circuit 3.

At time T1 (see FIG. 8) when the output voltage of the full-wave rectification circuit 82 reaches the first forward voltage V1 sufficient to cause the first LED block 21 to emit light, the LEDs contained in the first LED block 21 emit light (see FIG. 9(*a*)). Since Vf varies among the individual LEDs in the first LED block 21, as earlier described, whether the LEDs actually begin to emit light at the first forward voltage V1 (25.6 (v)) depends on the actual circuit. Incidentally, when the voltage equal to the sum of the Vf's of the 8 LEDs contained in the first LED block 21 is applied, the 8 LEDs contained in the first LED block begin to emit light. The same applies for the second to seventh forward voltages V2 to V7.

At time T2 (see FIG. 8) when the output voltage of the full-wave rectification circuit 82 reaches the second forward voltage V2 sufficient to cause the second LED block 31 to emit light, the LEDs contained in the first and second LED blocks 21 and 31 emit light (see FIG. 9(*b*)). At this time, current paths are formed that connect the first LED block 21 and the second LED block 31 in parallel relative to the full-wave rectification circuit 82.

At time T3 when the output voltage of the full-wave rectification circuit 82 reaches the third forward voltage V3 sufficient to cause the fourth LED block 51 to emit light, the LEDs contained in the first, second, and fourth LED blocks 21, 31, and 51 emit light (see FIG. 9(*c*)). At this time, current paths are formed that connect the first LED block 21, the second LED block 31, and the fourth LED block 51 in parallel relative to the full-wave rectification circuit 82.

At time T4 when the output voltage of the full-wave rectification circuit 82 reaches the fourth forward voltage V4 sufficient to cause the third LED block 41 to emit light, the LEDs contained in the first to fourth LED blocks 21 to 51 continue to emit light by switching the current path accordingly (see FIG. 9(*d*)). At this time, current paths are formed that connect the first to fourth LED blocks 21 to 51 respectively in parallel relative to the full-wave rectification circuit 82.

At time T5 when the output voltage of the full-wave rectification circuit 82 reaches the fifth forward voltage V5 sufficient to cause a series connection of the first LED block 21 and the second LED block 31 to emit light, the LEDs contained in the first to fourth LED blocks 21 to 51 continue to emit light by switching the current path accordingly (see FIG. 9(*e*)). At this time, a current path that connects the first and second LED blocks 21 and 31 in series relative to the full-wave rectification circuit 82 is formed, along with current paths that connect the fourth and third LED blocks 51 and 41 in parallel relative to the full-wave rectification circuit 82.

At time T6 when the output voltage of the full-wave rectification circuit 82 reaches the sixth forward voltage V6 sufficient to cause a series connection of the third LED block 41 and the fourth LED block 51 to emit light, the LEDs contained in the first to fourth LED blocks 21 to 51 continue to emit light by switching the current path accordingly (see FIG. 9(*f*)). At this time, a current path that connects the first and second LED blocks 21 and 31 in series relative to the full-wave rectification circuit 82 is formed, along with a current path that connects the third and fourth LED blocks 41 and 51 in series relative to the full-wave rectification circuit 82.

At time T7 when the output voltage of the full-wave rectification circuit 82 reaches the seventh forward voltage V7 sufficient to cause a series connection of the first to fourth LED blocks 21 to 51 to emit light, the LEDs contained in the first to fourth LED blocks 21 to 51 continue to emit light by switching the current path accordingly (see FIG. 9(*g*)). At this time, a current path is formed that connects the first to fourth LED blocks 21 to 51 in series relative to the full-wave rectification circuit 82.

At time T8 when the output voltage of the full-wave rectification circuit 82 drops below the seventh forward voltage V7, the LEDs contained in the first to fourth LED blocks 21 to 51 continue to emit light by switching the current path accordingly (see FIG. 10(*a*)). At this time, a current path that connects the first and second LED blocks 21 and 31 in series relative to the full-wave rectification circuit 82 is formed, along with a current path that connects the third and fourth LED blocks 41 and 51 in series relative to the full-wave rectification circuit 82.

At time T9 when the output voltage of the full-wave rectification circuit 82 drops below the sixth forward voltage V6, the LEDs contained in the first to fourth LED blocks 21 to 51 continue to emit light by switching the current path accordingly (see FIG. 10(*b*)). At this time, current paths are formed so as to connect the fourth LED block 51 and the third LED block 41 in parallel relative to the full-wave rectification circuit 82, along with the current path that connects the first and second LED blocks 21 and 31 in series.

At time T10 when the output voltage of the full-wave rectification circuit 82 drops below the fifth forward voltage V5, the LEDs contained in the first to fourth LED blocks 21 to 51 continue to emit light by switching the current path accordingly (see FIG. 10(*c*)). At this time, current paths are formed that connect the first to fourth LED blocks 21 to 51 respectively in parallel relative to the full-wave rectification circuit 82.

At time T11 when the output voltage of the full-wave rectification circuit 82 drops below the fourth forward voltage V4, the third LED block 41 turns off, and the first, second, and fourth LED blocks 21, 31, and 51 continue to emit light (see FIG. 10(*d*)). At this time, current paths are formed so as to connect the first LED block 21, the second LED block 31, and the fourth LED block 51 in parallel relative to the full-wave rectification circuit 82.

At time T12 (see FIG. 8) when the output voltage of the full-wave rectification circuit 82 drops below the third forward voltage V3, the fourth LED block 51 turns off, and the first and second LED blocks 21 and 31 continue to emit light (see FIG. 10(*e*)). At this time, current paths are formed that connects the first LED block 21 and the second LED block 31 in parallel relative to the full-wave rectification circuit 82.

At time T13 when the output voltage of the full-wave rectification circuit 82 drops below the second forward voltage V2, the second LED block 31 turns off, and the first LED block 21 continues to emit light (see FIG. 10(*f*)). At this time, a current path is formed so as to connect the first LED block 21 to the full-wave rectification circuit 82. At time T14, the output voltage of the full-wave rectification circuit 82 drops below the first forward voltage V1, and all of the LEDs are OFF.

The reverse current preventing diode 85 prevents the current from accidentally flowing from the first intermediate circuit 30 back to the start-point circuit 20 and thereby damaging the LEDs contained in the first LED block 21. Likewise, the reverse current preventing diode 88 prevents the current from accidentally flowing from the second intermediate circuit 50 back to the first intermediate circuit 30 and thereby damaging the LEDs contained in the second LED block 31. Further, the reverse current preventing diode 86 prevents the current from accidentally flowing from the end-point circuit 40 back to the second intermediate circuit 50 and thereby damaging the LEDs contained in the fourth LED block 51. Each of the current control units contained in the start-point circuit 20, the first intermediate circuit 30, the second intermediate circuit 50, and the end-point circuit 40, respectively, controls the current by adjusting its impedance. At this time, the voltage drop at the current control unit also changes. Then, when the reverse current preventing diode 85, 86, or 88, respectively, is forward biased, the current blocked so far gradually begins to flow, and the current path is switched as described above.

The current regulative diode 89 prevents overcurrent from flowing through the first to fourth LED blocks 21 to 51, in particular, in the situation of FIG. 9(*g*). As can be seen from FIGS. 9(*a*) to 9(*g*) and FIGS. 10(*a*) to 10(*f*), in any other state than the state of FIG. 9(*g*), at least one of the current control units is connected in the current path, so that overcurrent can be prevented from flowing through the respective LED blocks. However, in the state of FIG. 9(*g*), since no current control units are connected in the current path, the current regulative diode 89 is inserted as illustrated. While the current regulative diode 89 is shown as being inserted between the first intermediate circuit 20 and the second intermediate circuit 50, it may be inserted at some other suitable point as long as it is located in the current path formed in the state of FIG. 9(*g*). Further, a plurality of current regulative diodes may be inserted at various points along the current path formed in the state of FIG. 9(*g*). Furthermore, the current regulative diode 89 may be replaced by some other current regulating device, for example, a junction FET, that can prevent overcurrent from flowing through the first to fourth LED blocks 21 to 51 in the situation of FIG. 9(*g*). Alternatively, the current monitor constructed from the resistor and bipolar transistor and the current control circuit constructed from the MOSFET, which are provided in each of the start-point circuit 20, first intermediate circuit 30, second intermediate circuit 50, and end-point circuit 40, may together be used as a current regulating device.

As described above, in the LED driving circuit 3, since provisions are made to switch the current path in accordance with the output voltage of the full-wave rectification circuit 82, there is no need to provide a large number of switch circuits. Furthermore, since the switching of the current path is automatically determined in accordance with the output voltage of the full-wave rectification circuit 82 and the sum of the actual Vf's of the individual LEDs contained in each LED block, there is no need to perform control by predicting the switching timing of each LED block from the number of LEDs contained in the LED block, and it thus becomes possible to switch the connection of the respective LED blocks between a series connection and a parallel connection with the most efficient timing. Further, even if the commercial power supply voltage is different, all that is needed is to accordingly adjust the number of LEDs connected in series in each LED block, and there is no need to modify the circuit itself.

As in the case of FIG. 6, in the LED driving circuit 3 of FIG. 7 also, a device or circuit, such as the electrolytic capacitor 60, for smoothing the output waveform may be inserted between the output terminals of the full-wave rectification circuit 82. In the above example, each LED block has been shown as containing a different number of series-connected LEDs for convenience of explanation, but all the LED blocks or some of the LED blocks may contain the same number of series-connected LEDs. If the number of series-connected LEDs is made the same for all or some of the LED blocks, not only does it facilitate the fabrication, but it may lead to a reduction in cost. Further, in the above example, all of the LEDs have been connected in series in each LED block, but instead, a plurality of circuits, for example, two or three circuits, each comprising a plurality of series-connected LEDs, may be connected in parallel within the block.

Figure 11:
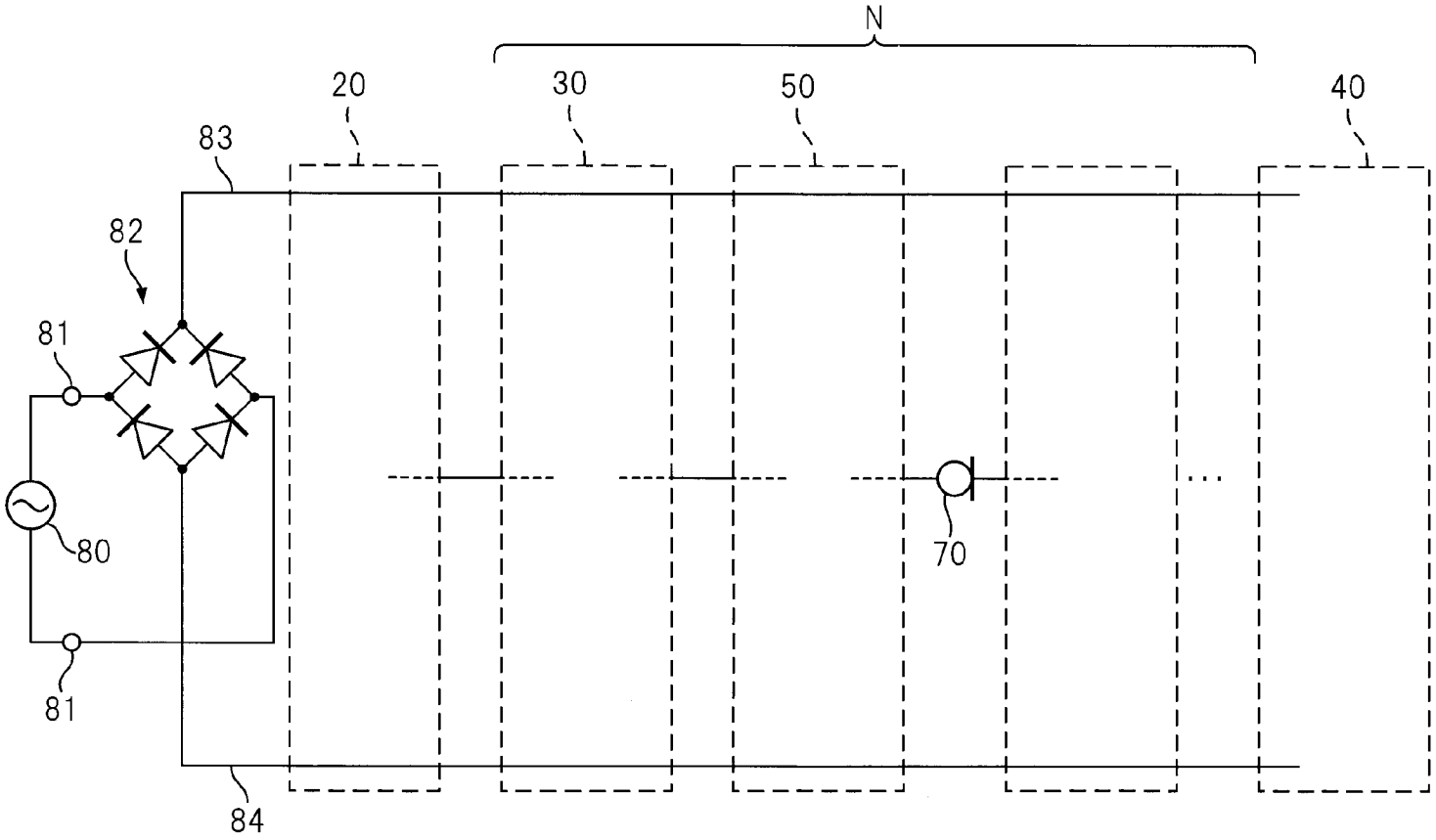
FIG. 11 is a diagram for explaining an expanded version of the LED driving circuit.

FIG. 11 is a diagram for explaining an expanded version of the LED driving circuit.

The above description has dealt with two different cases, i.e., the case where only one intermediate circuit is provided (the LED driving circuit 1 shown in FIG. 1) and the case where two intermediate circuits are provided (the LED driving circuit 3 shown in FIG. 7). However, the present invention is also applicable to the case when a number, N, of intermediate circuits are provided. That is, a suitable number of intermediate circuits can be provided between the start-point circuit 20 and the end-point circuit 40, as shown in FIG. 11. It should be noted that, in FIG. 11, the detailed circuit configuration is not shown.

In the example of FIG. 11, one current regulative diode 70 is provided on the end-point circuit 40 side of the second intermediate circuit 50. However, neither the location of the current regulative diode 70 nor the number thereof is not limited to the illustrated example, the only requirement being that when a current path is formed so that the LED blocks contained in the respective circuits are all connected in series relative to the full-wave rectification circuit (for example, see FIG. 9(*g*)), the current regulative diode 70 be inserted at one or a plurality of suitable locations in the current path so as to prevent overcurrent from flowing through the respective LED blocks.

As can be seen from a comparison between FIG. 3 and FIG. 8, if the number of LEDs contained in each LED block is reduced, the period from time T0 to time T1 (that is, the time taken for the LEDs to begin to emit light) can be reduced correspondingly. Accordingly, by increasing the number of intermediate circuits and thereby reducing the number of LEDs contained in each intermediate circuit, the LED driving efficiency can be further enhanced. In particular, in the LED driving circuit according to the present invention, since the switching of the current path is automatically determined in accordance with the output voltage of the full-wave rectification circuit 82 and the sum of the actual Vf's of the individual LEDs contained in each LED block, the advantage is that the switching between the respective LED blocks can be made efficiently, even if the number of intermediate circuits is increased. Furthermore, if the number of LED blocks is increased, and thus the LED forward voltage of each LED block is reduced, it is possible to reduce the power loss that occurs in the current control unit constructed from the MOSFET.

The LED driving efficiency refers to the percentage of the time during which all the LEDs are driven at rated current. In the case of the LED driving circuit 1 shown in FIG. 1, the LED driving efficiency (K(%)) can be expressed as shown below by referring to FIG. 3.

$$K=100\times\{V1\times(T10-T1)+V2\times(T9-T2)+V31\}/\{V1+V2+V3)\times(T11-T0)\}$$

For example, in the case of the LED driving circuit 1 of FIG. 1 which contains three LED blocks (the first LED block contains 10 LEDs, the second LED block contains 12 LEDs, and the third LED block contains 14 LEDs), the LED driving efficiency is 80.5%, while in the case of the LED driving circuit 3 of FIG. 7 which contains four LED blocks (the first LED block contains 8 LEDs, the second LED block contains 9 LEDs, the fourth LED block contains 10 LEDs, and the third LED block contains 12 LEDs), the LED driving efficiency is 83.9%. The driving efficiency can also be enhanced by adjusting the number of LEDs or the distribution of the LEDs among the respective blocks; for example, when the first LED block contains 9 LEDs, the second LED block contains 9 LEDs, the fourth LED block contains 9 LEDs, and the third LED block contains 9 LEDs, the LED driving efficiency is 86.0%.

Figure 12:
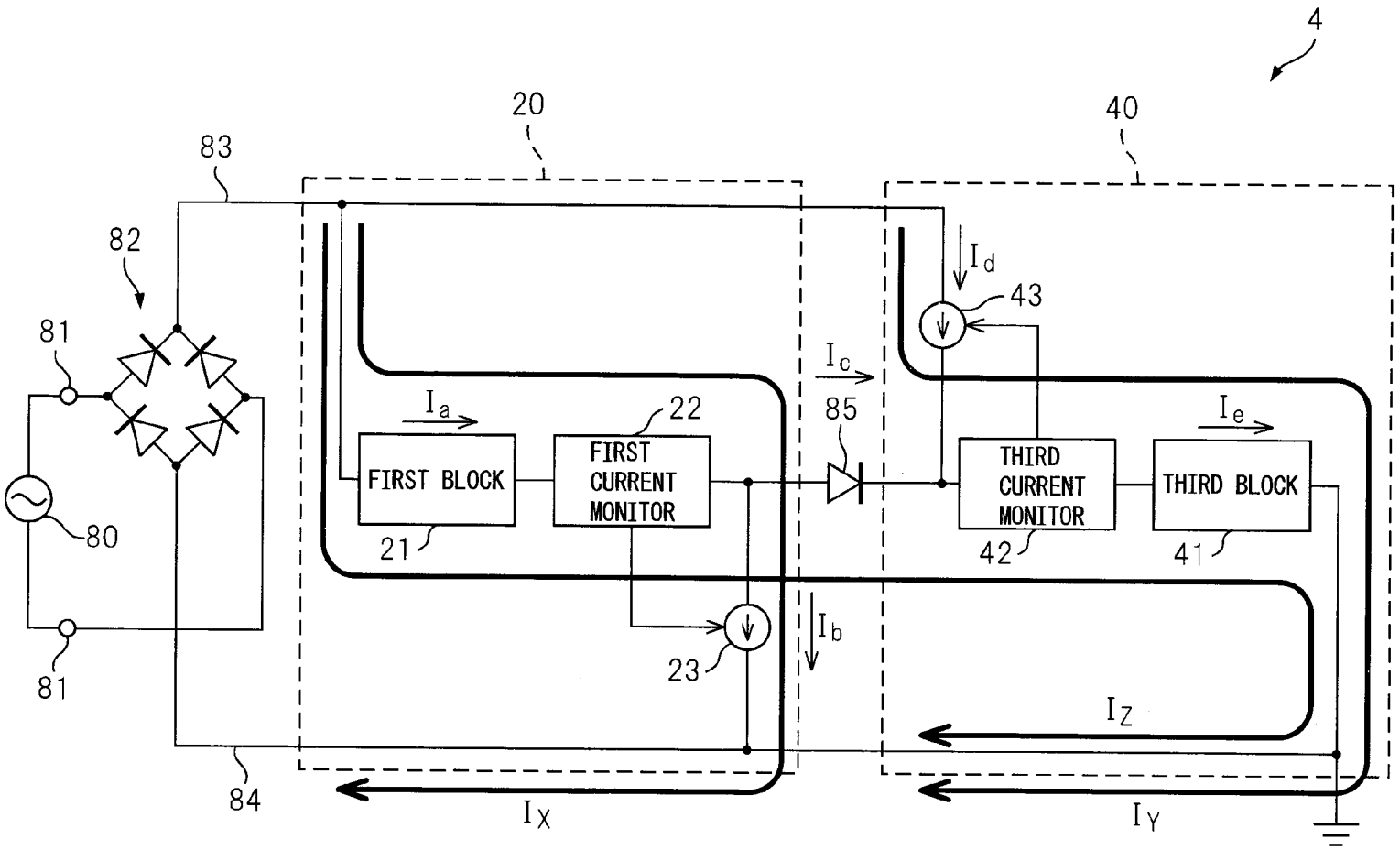
FIG. 12 is a diagram schematically illustrating the configuration of still another alternative LED driving circuit 4.

FIG. 12 is a diagram schematically illustrating the configuration of still another alternative LED driving circuit 4.

The LED driving circuit 4 shown in FIG. 12 includes only the minimum constituent elements of the LED driving circuit, i.e., the start-point circuit 20, the end-point circuit 40, and the reverse current preventing diode 85 connecting between the start-point circuit 20 and the end-point circuit 40. The LED driving circuit 4 is characterized in that the current paths (Ix and Iy) in which the first LED block 21 contained in the start-point circuit 20 and the third LED block 41 contained in the end-point circuit 40 are respectively connected in parallel relative to the full-wave rectification circuit 82 and the current path (Iz) in which the respective LED blocks are connected in series relative to the full-wave rectification circuit 82 are formed by automatically switching the connection in accordance with the output voltage of the full-wave rectification circuit 82.

The current path switching from the parallel to the series connection is accomplished in the following manner; i.e., as the output voltage of the full-wave rectification circuit 82 increases, the current Ia flowing through the first LED block 21 increases, and hence, control is performed to increase the impedance of the first current control unit 23 thereby limiting the current Ib, as a result of which the diode 85 which has so far been reverse biased begins to be forward biased, and the current Ic that has so far been held off begins to flow, whereupon the current Ie flowing through the third LED block 41 begins to increase, and control is performed to increase the impedance of the third current control unit 43 thereby limiting the current Id.

The above has described the current path switching from the parallel to the series connection for the case of the LED driving circuit 4 that contains the start-point circuit 20 and the end-point circuit 40 but, in the case of the LED driving circuit containing one or a plurality of intermediate circuits between the start-point circuit 20 and the end-point circuit 40, the current path switching between the circuits is performed based on essentially the same principle as that described above.

Figure 13:
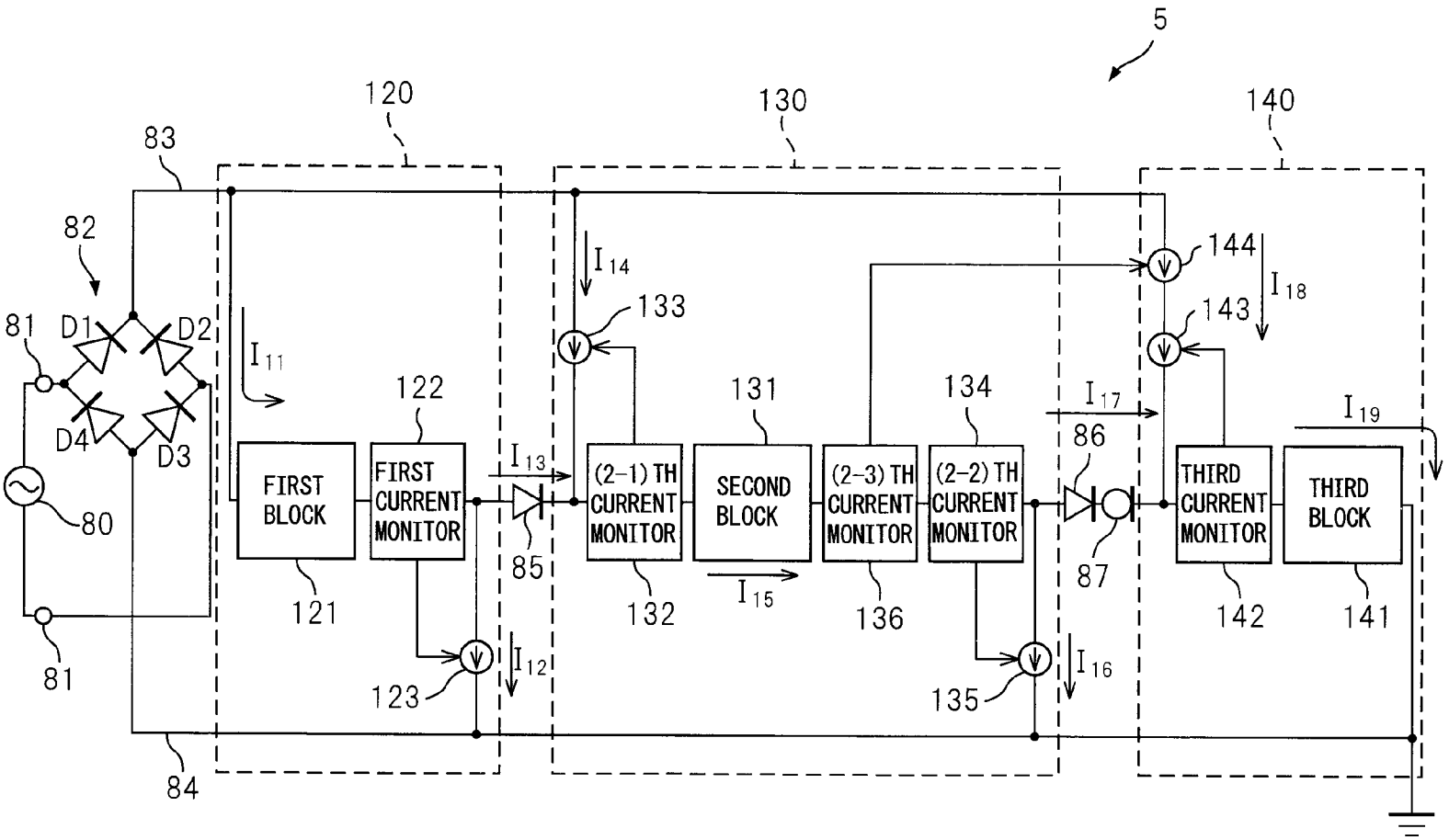
FIG. 13 is a diagram schematically illustrating the configuration of yet another alternative LED driving circuit 5.

FIG. 13 is a diagram schematically illustrating the configuration of yet another alternative LED driving circuit 5.

The LED driving circuit 5 comprises a pair of connecting terminals 81 for connection to an AC commercial power supply (100 VAC) 80, a full-wave rectification circuit 82, a start-point circuit 120, an intermediate circuit 130, an end-point circuit 140, reverse current preventing diodes 85 and 86, and a current regulative diode 87. The start-point circuit 120, the intermediate circuit 130, and the end-point circuit 140 are connected in parallel between a positive power supply output 83 and a negative power supply output 84. The start-point circuit 120 is connected to the intermediate circuit 130 via the diode 85, and the intermediate circuit 130 is connected to the end-point circuit 140 via the diode 86 and the current regulative diode 87.

The start-point circuit 120 includes a first LED block (LED array) 121 containing one or a plurality of LEDs, a first current monitor 122 for detecting current $I_{11}$ flowing through the first LED block 121, and a first current control unit 123. The first current monitor 122 operates so as to limit the current flowing through the first current control unit 123 in accordance with the current $I_{11}$ flowing through the first LED block 121.

The intermediate circuit 130 includes a second LED block (LED array) 131 containing one or a plurality of LEDs, a (2-1)th current monitor 132 and a (2-2)th current monitor 134 for detecting current flowing through the second LED block 131, a (2-1)th current control unit 133, a (2-2)th current control unit 135, and a (2-3)th current monitor 136. The (2-1)th current monitor 132 performs control so as to limit the current $I_{14}$ flowing through the (2-1)th current control unit 133 in accordance with the current $I_{15}$ flowing through the second LED block 131, while the (2-2)th current monitor 134 operates so as to limit the current $I_{16}$ flowing through the (2-2)th current control unit 135 in accordance with the current $I_{15}$ flowing through the second LED block 131. On the other hand, the (2-3)th current monitor 136 operates so as to limit the current $I_{18}$ flowing through a (3-2)th current control unit 144, described below, in accordance with the current $I_{15}$ flowing through the first and second LED blocks 121 and 131 when the two LED blocks are connected in series.

The end-point circuit 140 includes a third LED block (LED array) 141 containing one or a plurality of LEDs, a third current monitor 142 for detecting current $I_{19}$ flowing through the third LED block 141, a (3-1)th current control unit 143, and the (3-2)th current control unit 144. The third current monitor 142 operates so as to limit the current $I_{18}$ flowing through the (3-1)th current control unit 143 in accordance with the current $I_{19}$ flowing through the third LED block 141. On the other hand, the (3-2)th current control unit 144 operates so as to limit the current $I_{18}$ flowing through the (3-2)th current control unit 144, described later, in accordance with the current $I_{15}$ flowing through the second LED block 131.

Figure 14:
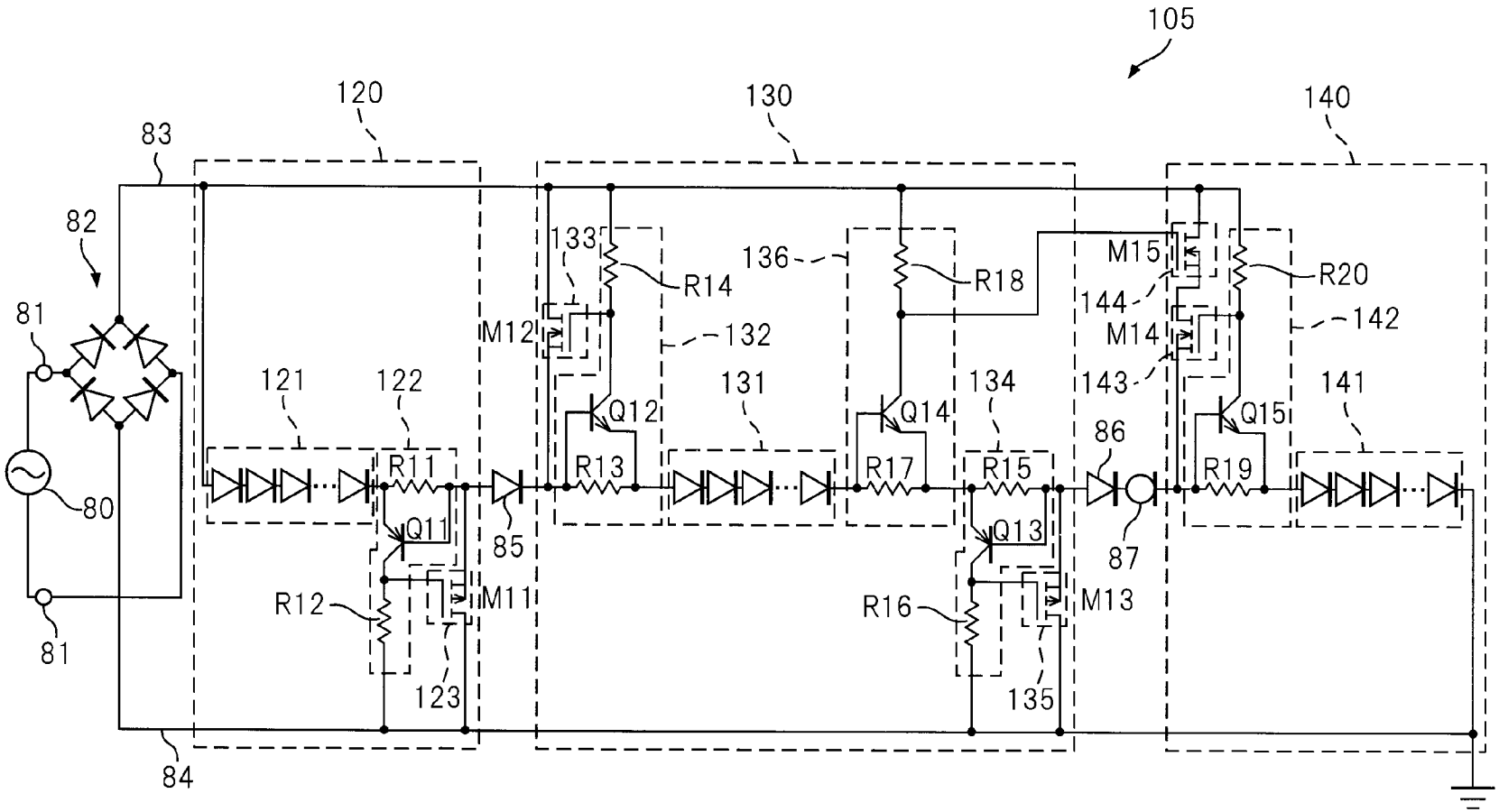
FIG. 14 is a diagram showing a circuit example 105 implementing the LED driving circuit 5 of FIG. 13.

FIG. 14 is a diagram showing a specific circuit example 105 implementing the LED driving circuit 5 of FIG. 13. In the circuit example 105, the same component elements as those in FIG. 13 are designated by the same reference numerals, and the portions corresponding to the respective component elements in FIG. 13 are enclosed by dashed lines.

In the circuit example 105, the pair of connecting terminals 81 is for connection to the AC commercial power supply 80, and is formed as a bayonet base when the LED driving circuit 5 is used for an LED lamp.

The full-wave rectification circuit 82 is a diode bridge circuit constructed from four rectifying elements D1 to D4, and includes the positive power supply output 83 and the negative power supply output 84. The full-wave rectification circuit 82 may be a full-wave rectification circuit that contains a voltage transformer circuit, or a two-phase full-wave rectification circuit that uses a transformer with a center tap.

In the start-point circuit 120, the first LED block 121 contains 12 LEDs connected in series. The first current monitor 122 comprises two resistors R11 and R12 and a transistor Q11, and the first current control unit 123 comprises a P-type MOSFET M11. The voltage drop that occurs across the resistor R11 due to the current flowing through the first LED block 121 causes the base voltage of the transistor Q11 to change. This change in the base voltage of the transistor Q11 causes a change in the emitter-collector current of the transistor Q11 flowing through the resistor R12, in accordance with which the gate voltage of the MOSFET M11 is adjusted to limit the source-drain current of the MOSFET M11.

In the intermediate circuit 130, the second LED block 131 contains 12 LEDs connected in series. The (2-1)th current monitor 132 comprises two resistors R13 and R14 and a transistor Q12, and the (2-1)th current control unit 133 comprises an N-type MOSFET M12. The voltage drop that occurs across the resistor R13 due to the current flowing through the second LED block 131 causes the base voltage of the transistor Q12 to change. This change in the base voltage of the transistor Q12 causes a change in the collector-emitter current of the transistor Q12 flowing through the resistor R14, in accordance with which the gate voltage of the MOSFET M12 is adjusted to limit the source-drain current of the MOSFET M12.

The (2-2)th current monitor 134 comprises two resistors R15 and R16 and a transistor Q13, and the (2-2)th current control unit 135 comprises a P-type MOSFET M13. The (2-2)th current monitor 134 and the (2-2)th current control unit 135 operate in the same manner as the first current monitor 122 and the first current control unit 123. The (2-3)th current monitor 136 comprises two resistors R17 and R18 and a transistor Q14.

In the end-point circuit 140, the third LED block 141 contains 12 LEDs connected in series. The third current monitor 142 comprises two resistors R19 and R20 and a transistor Q15, and the (3-1)th current control unit 143 comprises an N-type MOSFET M14. The third current monitor 142 and the (3-1)th current control unit 143 operate in the same manner as the (2-1)th current monitor 132 and the (2-1)th current control unit 133.

The (3-2)th current control unit 144 comprises an N-type MOSFET M15. The voltage drop that occurs across the resistor R17 in the (2-3)th current monitor 136 due to the current $I_{15}$ causes the base voltage of the transistor Q14 to change. This change in the base voltage of the transistor Q14 causes a change in the collector-emitter current of the transistor Q14 flowing through the resistor R18, in accordance with which the gate voltage of the MOSFET M15 is adjusted to limit the source-drain current of the MOSFET M15.

In the circuit example 105, since 12 LEDs are connected in series in each of the first, second, and third LED blocks 121, 131, and 141, when a voltage approximately equal to a first forward voltage V1 (12×Vf=12×3.2=38.4 (v)) is applied to each of the first, second, and third LED blocks 121, 131, and 141, the LEDs contained in each of the first, second, and third LED blocks 121, 131, and 141 emit light.

When a voltage approximately equal to a second forward voltage V2 ((12+12)×3.2=76.8 (v)) is applied across a series connection of the first LED block 121 and the second LED block 131, the LEDs contained in the first and second LED blocks 121 and 131 emit light. On the other hand, when a voltage approximately equal to a third forward voltage V3 ((12+12+12)×3.2=115.2 (v)) is applied across a series connection of the first LED block 121, the second LED block 131, and the third LED block 141, the LEDs contained in the first, second, and third LED blocks 121, 131, and 141 emit light.

In the case of the commercial power supply voltage of 100 (V), the maximum voltage is about 141 (V). The voltage stability should take into account a variation of about ±10%. The forward voltage of each of the rectifying elements D1 to D4 of the full-wave rectification circuit 82 is 1.0 (V); in the circuit example 105, when the commercial power supply voltage is 100 (V), the maximum output voltage of the full-wave rectifier circuit 82 is about 139 (V). The total number of LEDs in the first, second, and third LED blocks 121, 131, and 141 has been chosen to be 36 so that the voltage given as the total number (n)×Vf (36×3.2=115.2), when all the LEDs are connected in series, does not exceed the maximum output voltage of the full-wave rectification circuit 82. As earlier noted, the forward voltage Vf of each LED is 3.2 (v), but the actual value somewhat varies among the individual LEDs.

It should be noted that the circuit configuration shown in the circuit example 105 of FIG. 14 is only illustrative and not restrictive, and that various changes and modifications can be made to the configuration including the number of LEDs contained in each of the first, second, and third LED blocks 121, 131, and 141.

Figure 15:
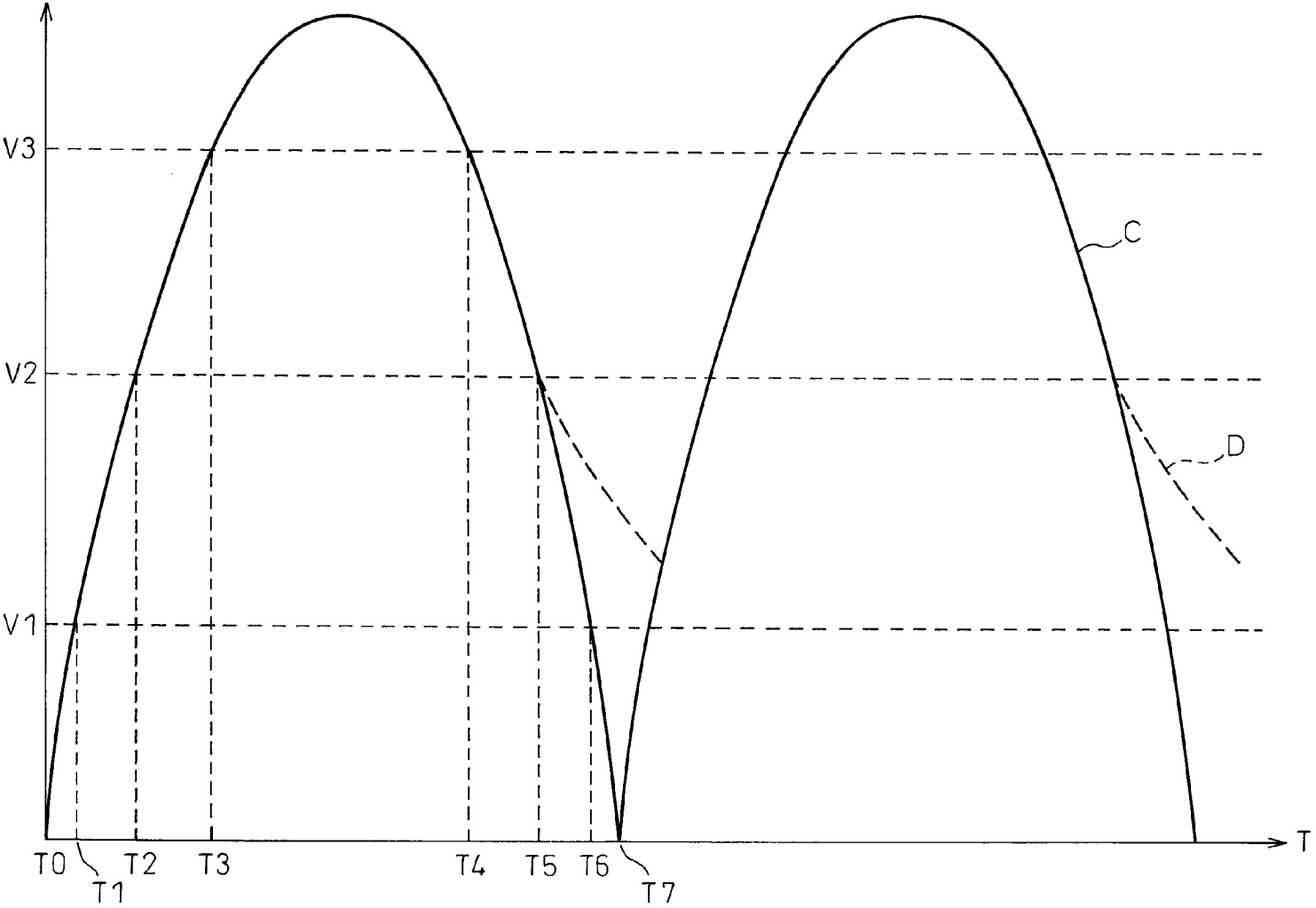
FIG. 15 is a diagram showing an output voltage waveform example of the full-wave rectification circuit 82.
Figure 16:
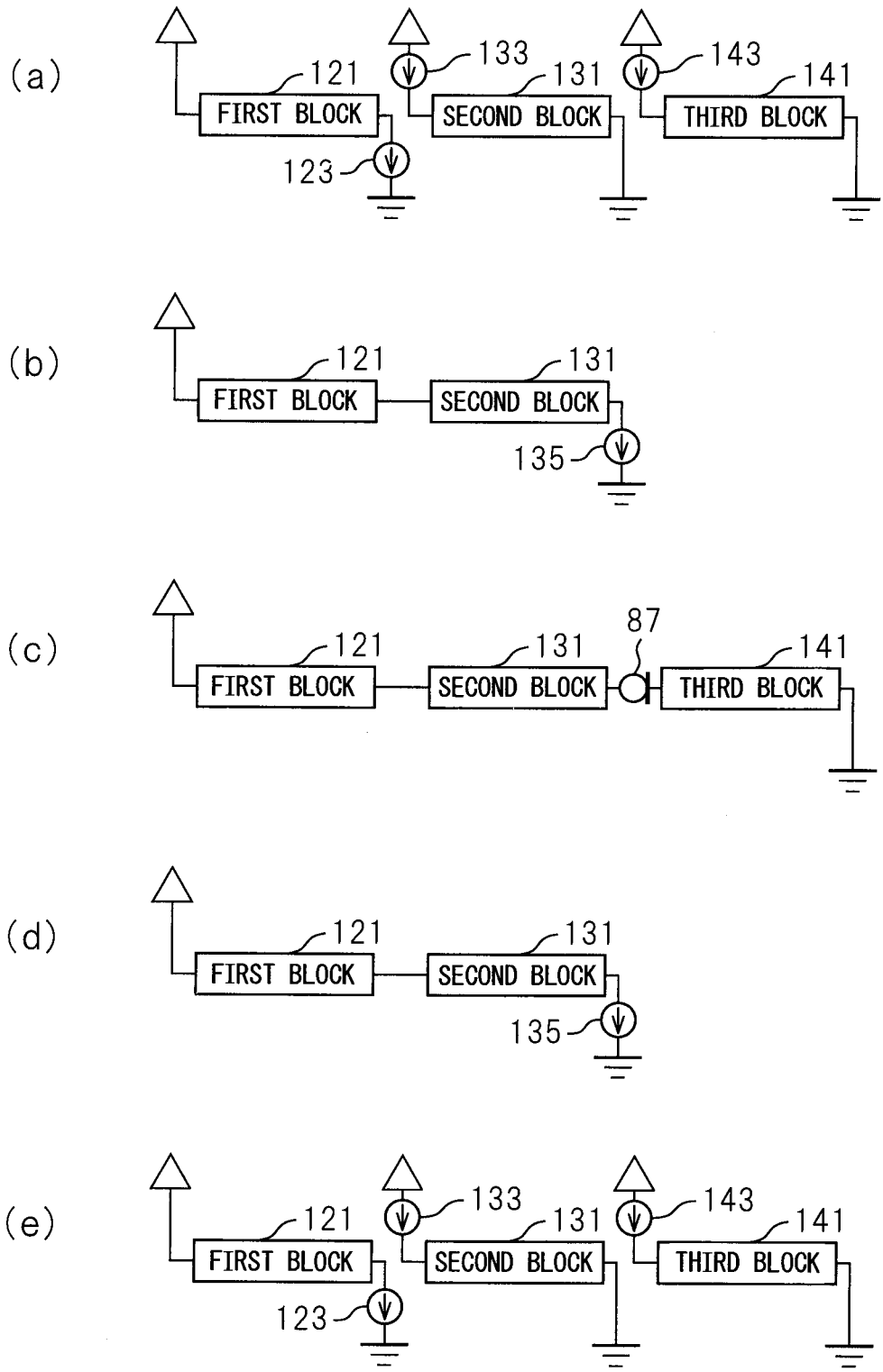
FIG. 16 is a diagram showing an example of an LED block switching sequence in the LED driving circuit 5 of FIG. 13.
Figure 17:
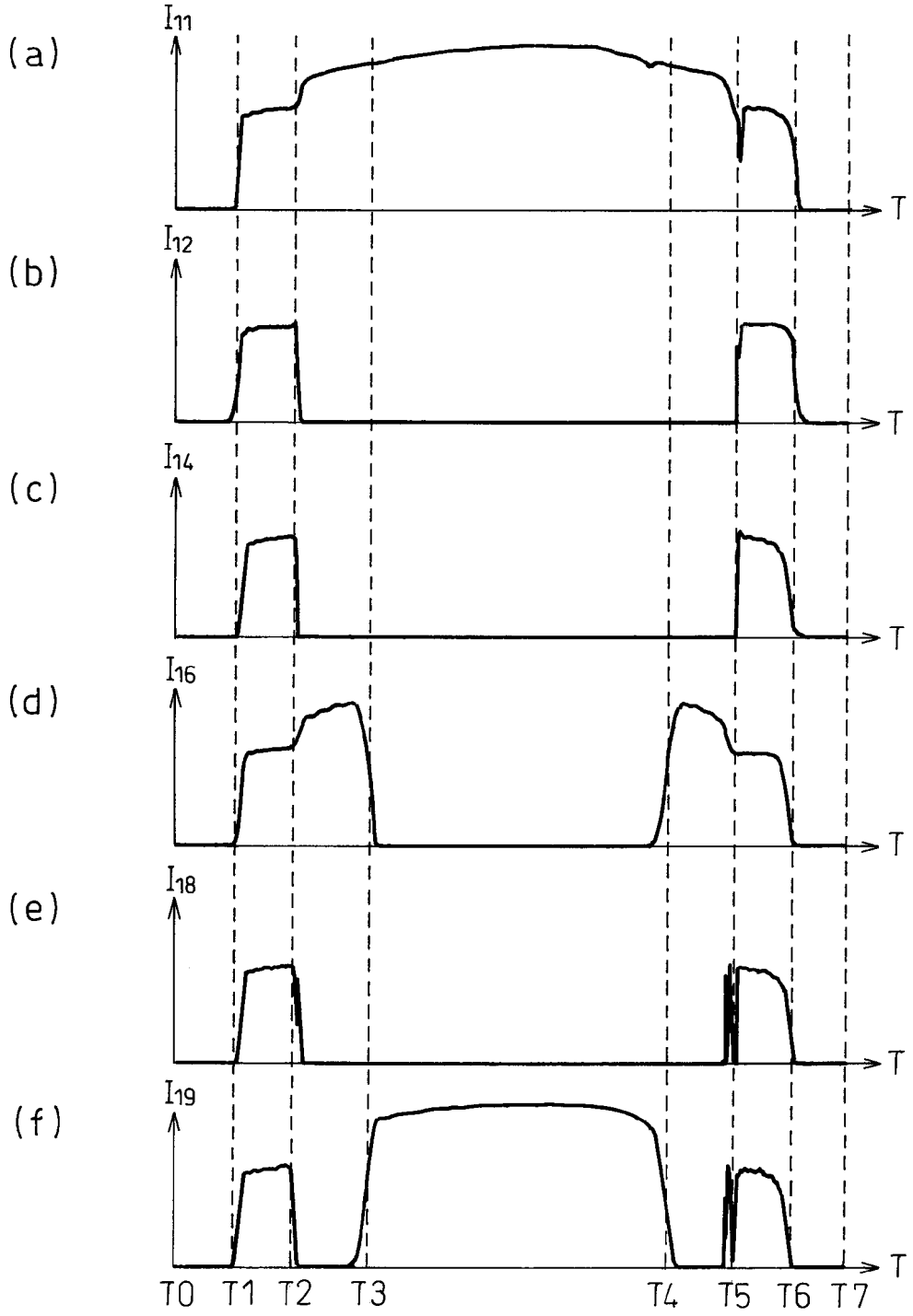
FIG. 17 is a diagram showing examples of currents flowing through particular portions during the period from time T0 to time T7 in FIG. 15.

The operation of the circuit example 105 will be described below with reference to FIGS. 15 to 17. FIG. 15 is a diagram showing an output voltage waveform example C of the full-wave rectification circuit 82, FIG. 16 is a diagram showing an example of the LED block switching sequence in the circuit example 105, and FIG. 17 is a diagram showing examples of the currents flowing through the particular portions during the period from time T0 to time T7. FIG. 17(*a*) shows the current $I_{11}$, FIG. 17(*b*) shows the current $I_{12}$, FIG. 17(*c*) shows the current $I_{14}$, FIG. 17(*d*) shows the current $I_{16}$, FIG. 17(*e*) shows the current $I_{18}$, and FIG. 17(*f*) shows the current $I_{19}$.

Further, the set value of the current $I_{12}$ set in the first current monitor 122 is denoted by S2, the set value of the current $I_{14}$ set in the (2-1)th current monitor 132 is denoted by S4, the set value of the current $I_{16}$ set in the (2-2)th current monitor 134 is denoted by S6, the set value of the current $I_{18}$ set in the third current monitor 142 is denoted by S8, the set value of the current $I_{18}$ set in the (2-3)th current monitor 136 is denoted by S10, and the set value of the current $I_{17}$ set in the current regulative diode 87 is denoted by S7. In the LED driving circuit 105 shown in FIG. 14, the relations between the respective set values are, for example, defined by: S2=S4=S8<S10<S6<S7. However, the relations between the respective set values need not necessarily be limited to the above example, but may be defined in other ways.

At time T0 (see FIG. 15) when the output voltage of the full-wave rectification circuit 82 is 0 (v), since the voltage for causing any one of the first, second, and third LED blocks 121, 131, and 141 to emit light is not reached yet, the LEDs contained in any of the LED blocks remain OFF.

At time T1 (see FIG. 15) when the output voltage of the full-wave rectification circuit 82 reaches the first forward voltage V1 sufficient to cause each of the first, second, and third LED blocks 121, 131, and 141 to emit light, a current path passing through each of the first, second, and third LED blocks 121, 131, and 141 is formed, and the LEDs contained in each of the first, second, and third LED blocks 121, 131, and 141 emit light (see FIG. 16(*a*)). Since Vf varies among the individual LEDs in each LED block, as earlier described, whether the LEDs actually begin to emit light at the first forward voltage V1 (38.4 (v)) depends on the actual circuit. Incidentally, when the voltage equal to the sum of the Vf's of the 12 LEDs contained in each of the first, second, and third LED blocks 121, 131, and 141 is applied, the 12 LEDs contained in each of the first, second, and third LED blocks 121, 131, and 141 begin to emit light.

In the state of FIG. 16(*a*), $I_{11}=I_{12}$, $I_{14}=I_{15}$, and $I_{18}=I_{11}$, and since the diodes 85 and 86 are both reverse biased, neither current $I_{13}$ nor current $I_{17}$ flows. Here, the first current control unit 123, the (2-1)th current control unit 133, and the (3-1)th current control unit 143 control the currents in the first to third LED blocks 121 to 141, respectively. In this state, from the above-defined relations between the respective set current values, the (2-2)th current control unit 135 and the (3-2)th current control unit 144 are each held in an extremely low impedance state, that is, in the ON state.

Since the first, second, and third LED blocks 121, 131, and 141 are each driven at constant current, the currents $I_{11}$, $I_{12}$, $I_{14}$, $I_{15}$, $I_{18}$, and $I_{11}$ are substantially maintained constant during the period from time T1 to time T2 (see FIGS. 17(*a*) to 17(*f*)).

Next, at time T2 (see FIG. 15) when the output voltage of the full-wave rectifier circuit 82 reaches the second forward voltage V2 sufficient to cause all the LEDs contained in the first and second LED blocks 121 and 131 to emit light even if the first and second LED blocks 121 and 131 are connected in series, the current path is switched so that the first and second LED blocks 121 and 131 are connected in series relative to the full-wave rectifier circuit 82 (see FIG. 16(*b*)).

The transition from FIG. 16(*a*) to FIG. 16(*b*) will be described below.

When the output voltage of the full-wave rectifier circuit 82 rises from the first forward voltage V1 to the second forward voltage V2, the first current monitor 122 controls the first current control unit 123 so as to limit the current $I_{13}$. As described above, in the state of FIG. 16(*a*), the first current control unit 123, the (2-1)th current control unit 133, and the (3-1)th current control unit 143 control the currents in the first to third LED blocks 121 to 141, respectively. However, when the output voltage of the full-wave rectifier circuit 82 rises, since the forward voltage of the first LED block 121 remains constant at V1, control is performed so that the voltage drop at the first current control unit 123 increases, i.e., the impedance of the first current control unit 123 increases.

In this way, during the transition from FIG. 16(*a*) to FIG. 16(*b*), the voltage drop at the first current control unit 123 and the voltage drop at the (2-1)th current control unit 133 both increase. The diode 85 which has so far been reverse biased begins to be forward biased, and the current $I_{13}$ begins to flow. Then, the first current monitor 122 operates so as to increase the impedance of the first current control unit 123 and thus reduce the current $I_{12}$.

Further, since the current $I_{13}$ is added to the current $I_{14}$ currently being monitored, the (2-1)th current monitor 132 performs control to reduce the current $I_{14}$ in the (2-1)th current control unit 133, i.e., to increase the impedance of the (2-1)th current control unit 133. As a result, the currents $I_{12}$ and $I_{14}$ gradually decrease and finally drop to almost zero, achieving the state $I_{11}=I_{13}=I_{15}=I_{16}$ (the state of FIG. 16(*b*)) (see FIGS. 17(*b*) and 17(*c*)). At this time, the first current control unit 123 and the (2-1)th current control unit 133 are both in a high impedance state, that is, in the OFF state. Then, the (2-2)th current monitor 134 controls the impedance of the (2-2)th current control unit 135 so that the current defined by the set value S6 of the current $I_{16}$ flows.

With the (2-2)th current monitor 134 thus controlling the impedance of the (2-2)th current control unit 135, the drive currents $I_{11}$, $I_{13}$, $I_{15}$, and $I_{16}$ are maintained constant during the period from time T2 to time T3 at a higher value than during the period from time T1 to time T2 (see FIGS. 17(*a*) and 17(*d*)). At this time, the (2-3)th current monitor 136 detects the increase in the current $I_{15}$ flowing through the first and second LED blocks 121 and 131 when the two LED blocks are connected in series, and controls the (3-2)th current control unit 144 to block the current $I_{18}$, thus performing control to hold the third LED block 141 in the OFF state (see FIGS. 17(*e*) and 17(*f*)). As a result, only the current path shown in FIG. 16(*b*) is formed. The reason for performing control to hold the third LED block 141 in the OFF state in FIG. 16(*b*) will be described later.

Since the set current values are defined by the relation S2=S4=S8<S10<S6, as earlier described, in the state of FIG. 16(*b*) the first current limiting unit 123 and the (2-1)th current limiting unit 133 are both in a high impedance state, that is, in the OFF state. Further, since S10<S6, the (3-2)th current limiting unit 144 is held in a high impedance state, i.e., in the OFF state, by the (2-3)th current monitor 136, and thus the current $I_{18}$ is blocked. Accordingly, in the state of FIG. 16(*b*), the (2-2)th current control unit 135 controls the current flowing through the first and second LED blocks 121 and 131. When the output voltage of the full-wave rectification circuit 82 is equal to or higher than the second forward voltage V2, the (2-3)th current monitor 136 continues to control the (3-2)th current limiting unit 144 so as to limit the current, and therefore, the current $I_{18}$ is always blocked here.

Next, at time T3 (see FIG. 15) when the output voltage of the full-wave rectifier circuit 82 reaches the third forward voltage V3 sufficient to cause all the LEDs contained in the first, second, and third LED blocks 121, 131, and 141 to emit light even if the first, second, and third LED blocks 121, 131, and 141 are connected in series, the current path is switched so that the first, second, and third LED blocks 121, 131, and 141 are connected in series relative to the full-wave rectifier circuit 82 (see FIG. 16(*c*)).

The transition from FIG. 16(*b*) to FIG. 16(*c*) will be described below.

As the output voltage of the full-wave rectifier circuit 82 nears the third forward voltage V3, the diode 86 which has so far been reverse biased begins to be forward biased, and the current $I_{17}$ begins to flow into the end-point circuit 140.

When the output voltage of the full-wave rectifier circuit 82 rises from the second forward voltage V2 to the third forward voltage V3, the (2-2)th current monitor 134 controls the impedance of the (2-2)th current control unit 135 so as to limit the current $I_{16}$. In the meantime, the voltage drop at the (2-2)th current control unit 135 is gradually increasing. Since the current set value S10 of the (2-3)th current monitor 136 is set lower than the current set value S6 of the (2-2)th current monitor 134, when the output voltage of the full-wave rectification circuit 82 is equal to or higher than the second forward voltage V2, the impedance of the (3-2)th current limiting unit 144 is high, and the current $I_{18}$ does not flow. On the other hand, the (2-2)th current monitor 134 performs control to increase the impedance of the (2-2)th current control unit 135 and thus reduce the current $I_{16}$. As a result, the current $I_{16}$ gradually decreases and finally drops to almost zero, achieving the state $I_{11}=I_{13}=I_{15}=I_{17}=I_{19}$ (the state of FIG. 6(*c*)).

In the state of FIG. 16(*c*), since $I_{11}=I_{13}=I_{15}=I_{17}=I_{19}$, the current flowing in this state is the set current S7 of the current regulative diode 87 (see FIGS. 17(*a*) and 17(*f*)). Further, in this state, hardly any of the other currents $I_{12}$, $I_{14}$, $I_{16}$, and $I_{18}$ flows (see FIGS. 17(*b*) to 17(*e*)). Since S2=S4=S8<S10<S6<S7, as earlier described, in the state of FIG. 16(*c*) the current regulative diode 87 controls the current flowing through the first to third LED blocks 120 to 140.

Next, at time T4 (see FIG. 15) when the output voltage of the full-wave rectifier circuit 82 drops below the third forward voltage V3, the (2-2)th current monitor 134 controls the (2-2)th current control unit 135 so as to relax the limit on the current $I_{16}$. Then, the current $I_{16}$ gradually begins to flow, and the current $I_{17}$ drops. Since the current set value S10 of the (2-3)th current monitor 136 is set lower than the current set value S6 of the (2-2)th current monitor 134, when the supply voltage is equal to or higher than V2, the impedance of the (3-2)th current limiting unit 144 is high, and the current $I_{18}$ does not flow. When the supply voltage drops below V3, the third LED block 141 turns off, and the transition is made from the state of FIG. 16(*c*) to the state of FIG. 16(*d*). In this state, $I_{11}=I_{13}=I_{15}=I_{16}$ (see FIGS. 17(*a*) and 17(*d*)).

Since the current set value S2 of the first current monitor 122 is set lower than the current set value S6 of the (2-2)th current monitor 134, as earlier described, the series connection between the second and third LED blocks 131 and 141 is cut off earlier than the series connection between the first and second LED blocks 121 and 131.

Next, at time T5 (see FIG. 15), the output voltage of the full-wave rectifier circuit 82 drops below the second forward voltage V2, which means that the output voltage drops below the voltage sufficient to drive all the LEDs contained in the first and second LED blocks 121 and 131 connected in series; as a result, current paths passing through the first LED block 121, the second LED block 131, and the third LED block 141, respectively, are formed, and the LEDs contained in the first, second, and third LED blocks 121, 131, and 141, respectively, emit light (see FIG. 16(*e*)). When the output voltage of the full-wave rectifier circuit 82 drops below the second forward voltage V2, the (2-3)th current monitor 136 switches the (3-2)th current control unit 144 to the ON state and thus allows the current $I_{18}$ to flow. As a result, $I_{11}=I_{12}$, $I_{14}=I_{15}=I_{16}$, and $I_{18}=I_{19}$, and since the diodes 85 and 86 are both reverse biased, neither the current $I_{13}$ nor the current $I_{17}$ flows (see FIGS. 17(*a*) to 17(*f*)).

Next, at time T6 (see FIG. 15), the output voltage of the full-wave rectifier circuit 82 drops below the first forward voltage V1, which means that the output voltage drops below the voltage sufficient to drive any of the LEDs contained in the first, second, and third LED blocks 121, 131, and 141; as a result, none of the current $I_{11}$ to $I_{19}$ flow (see FIGS. 17(*a*) to 17(*f*)). By repeating the process from time T0 to time T7 (time T7 corresponds to time T0 in the next cycle), the LEDs contained in the first, second, and third LED blocks 121, 131, and 141, respectively, are caused to emit light as described above.

The reverse current preventing diode 85 prevents the current from accidentally flowing from the intermediate circuit 130 back to the start-point circuit 120 and thereby damaging the LEDs contained in the first LED block 121. Likewise, the reverse current preventing diode 86 prevents the current from accidentally flowing from the end-point circuit 140 back to the intermediate circuit 130 and thereby damaging the LEDs contained in the second LED block 131. Each of the current control units contained in the start-point circuit 120, the intermediate circuit 130, and the end-point circuit 140, respectively, controls the current by adjusting its impedance. At this time, the voltage drop at the current control unit also changes. Then, when the reverse current preventing diode 85 or 86, respectively, is forward biased, the current so far blocked gradually begins to flow, and the current path is switched as described above.

The current regulative diode 87 prevents overcurrent from flowing through the first, second, and third LED blocks 121, 131, and 141, in particular, in the situation in FIG. 16(*c*). As can be seen from FIGS. 16(*a*) to 16(*e*), in any other state than the state in FIG. 16(*c*), at least one of the current control units is connected in the current path, so that overcurrent can be prevented from flowing through the respective LED blocks. However, in the state in FIG. 16(*c*), since no current control units are connected in the current path, the current regulative diode 87 is inserted as illustrated. While the current regulative diode 87 is shown as being inserted between the intermediate circuit 130 and the end-point circuit 140, it may be inserted at some other suitable point as long as it is located in the current path formed in the state in FIG. 16(*c*).

Further, a plurality of current regulative diodes may be inserted at various points along the current path formed in the state of FIG. 16(*c*). Furthermore, the current regulative diode 87 may be replaced with a current regulating circuit or device, such as a constant current circuit or a high power resistor, that can prevent overcurrent from flowing through the first, second, and third LED blocks 121, 131, and 141 in the situation in FIG. 16(*c*).

As described above, in the circuit example 105, since provisions are made to switch the current path in accordance with the output voltage of the full-wave rectification circuit 82, there is no need to provide a large number of switch circuits. Furthermore, since the switching of the current path is automatically determined in accordance with the output voltage of the full-wave rectification circuit 82 and the sum of the actual Vf's of the individual LEDs contained in each LED block, there is no need to perform control by predicting the switching timing of each LED block from the number of LEDs contained in the LED block, and it is thus possible to switch the connection of the respective LED blocks between a series connection and a parallel connection with the most efficient timing.

The functions of the (2-3)th current monitor 136 and (3-2)th current control unit 144 included in the LED driving circuit 5 will be further described below with reference to FIGS. 33 and 34.

Figure 33:
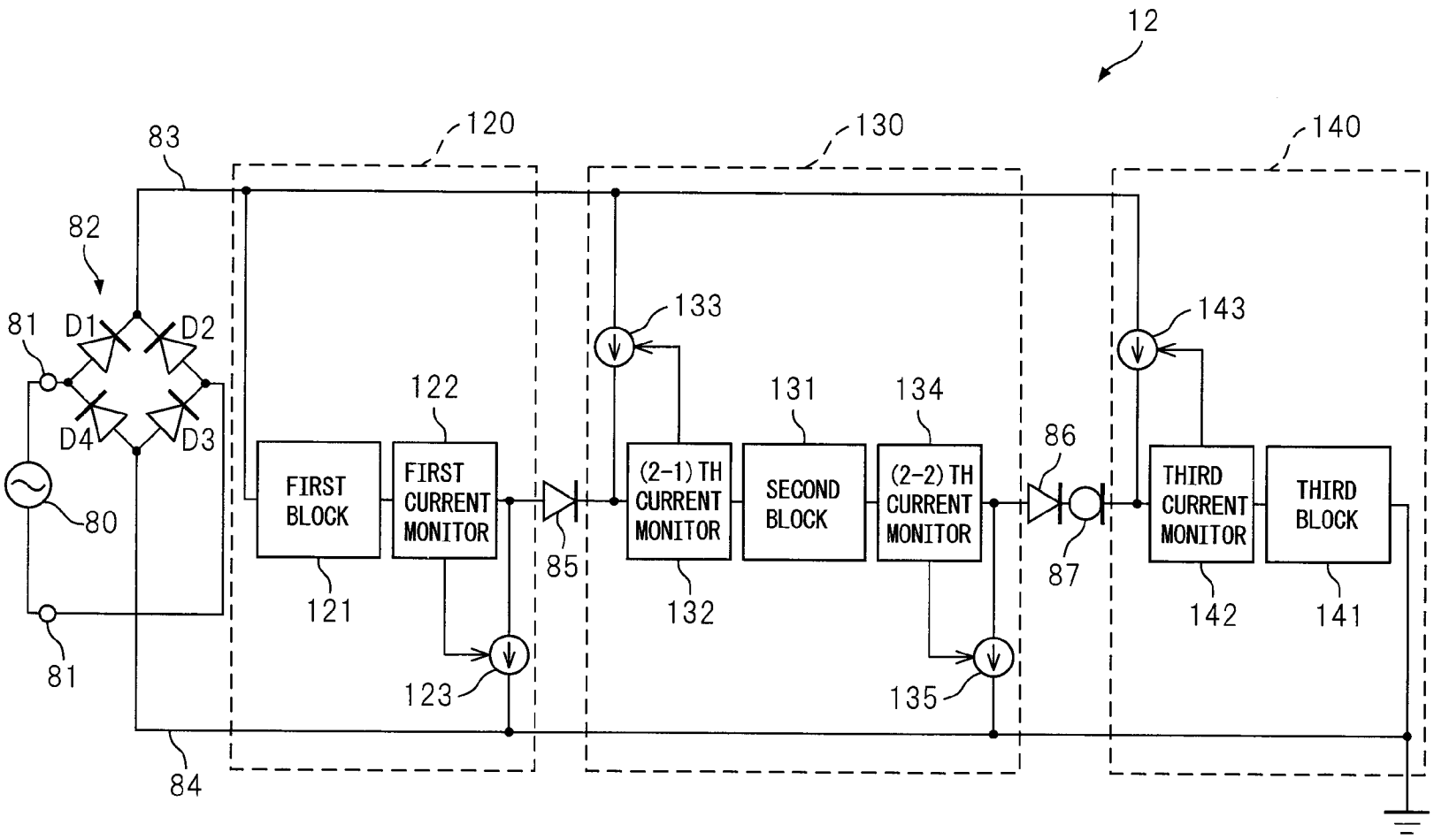
FIG. 33 is a diagram schematically illustrating the configuration of the LED driving circuit 12.

FIG. 33 shows an LED driving circuit 12 which is identical to the LED driving circuit 5 of FIG. 13 except that the (2-3)th current monitor 136 and (3-2)th current control unit 144 are omitted. FIG. 34 is a diagram showing an example of the LED block switching sequence in the LED driving circuit 12 of FIG. 33 when the output voltage of the full-wave rectification circuit 82 varies as shown in the waveform example C in FIG. 15.

Figure 34:
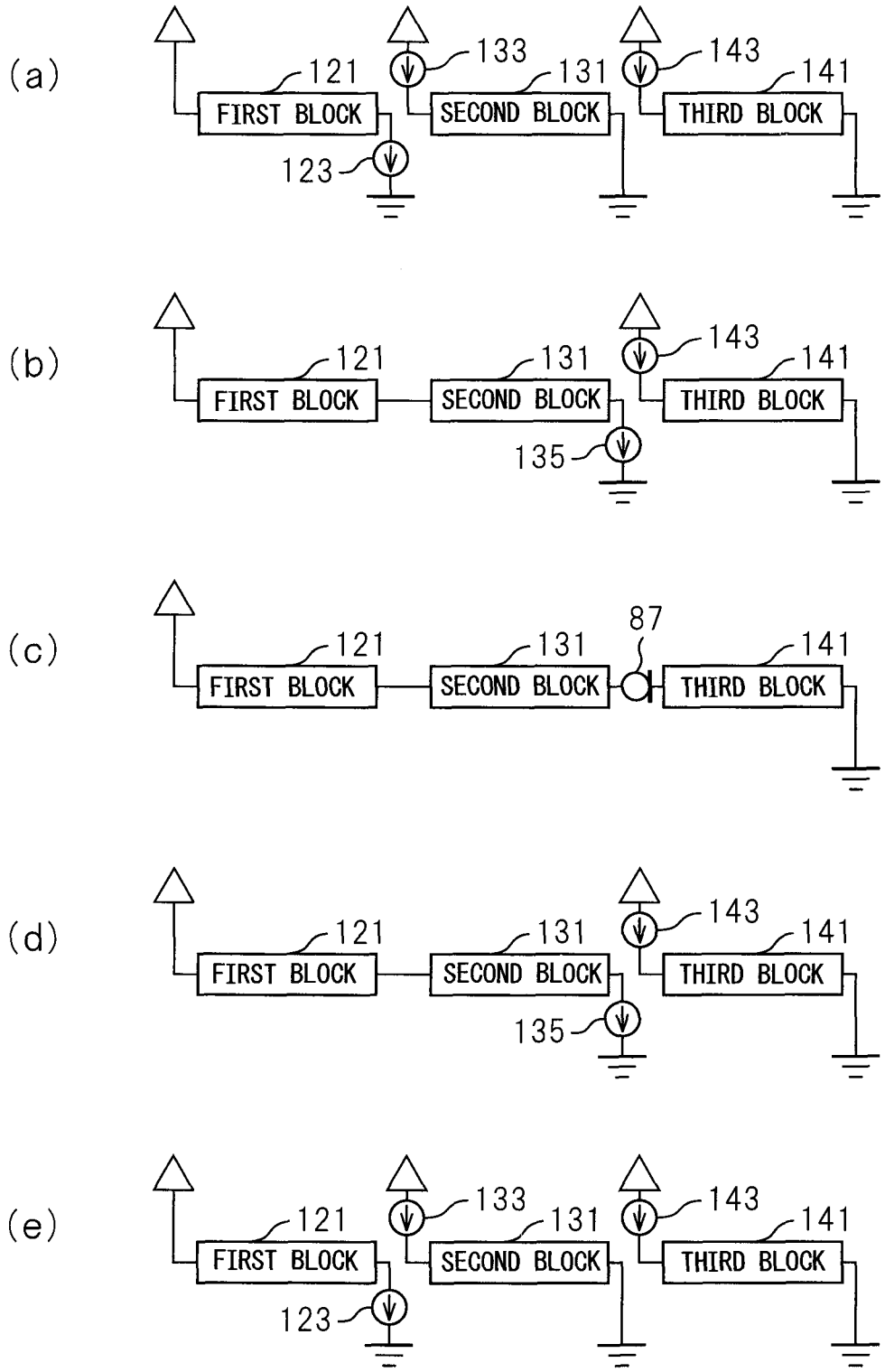
FIG. 34 is a diagram showing an example of an LED block switching sequence in the LED driving circuit 12 of FIG. 33.

In the LED driving circuit 12 of FIG. 33 which includes neither the (2-3)th current monitor 136 nor the (3-2)th current control unit 144, when the output voltage of the full-wave rectification circuit 82 rises from the first voltage V1 to the second voltage V2, a transition is made from the state shown in FIG. 34(*a*) to the state shown in FIG. 34(*b*).

In the state of FIG. 34(*b*), the first and second LED blocks 121 and 131 are connected in series and, in this condition, a voltage sufficient to cause the LEDs contained in the two LED blocks to emit light is applied to the third LED block 141 alone. Since the impedance of the third LED block 141 is about one half of the combined impedance of the first and second LED blocks 121 and 131, normally a correspondingly larger amount of current would flow. However, the third LED block 141 is driven at constant current under the control of the third current control unit 143. This means that a loss equivalent to the amount of current limited by the third current control unit 143 occurs in the circuit of FIG. 33. Such power loss also occurs when a transition is made from the state of FIG. 34(*c*) to the state of FIG. 34(*d*).

As can be seen from the above, the (2-3)th current monitor 136 and the (3-2)th current control unit 144 work cooperatively to prevent LED blocks of different impedances, such as two LED blocks connected in series and one LED block, from being connected in parallel relative to the full-wave rectification circuit 82 as shown in FIG. 34(*b*) or 34(*d*). That is, control is performed to hold the third LED block 141 in the OFF state, as shown in FIG. 16(*b*) or 16(*d*), in order to prevent the occurrence of an unbalanced state and thereby prevent power loss.

Figure 18:
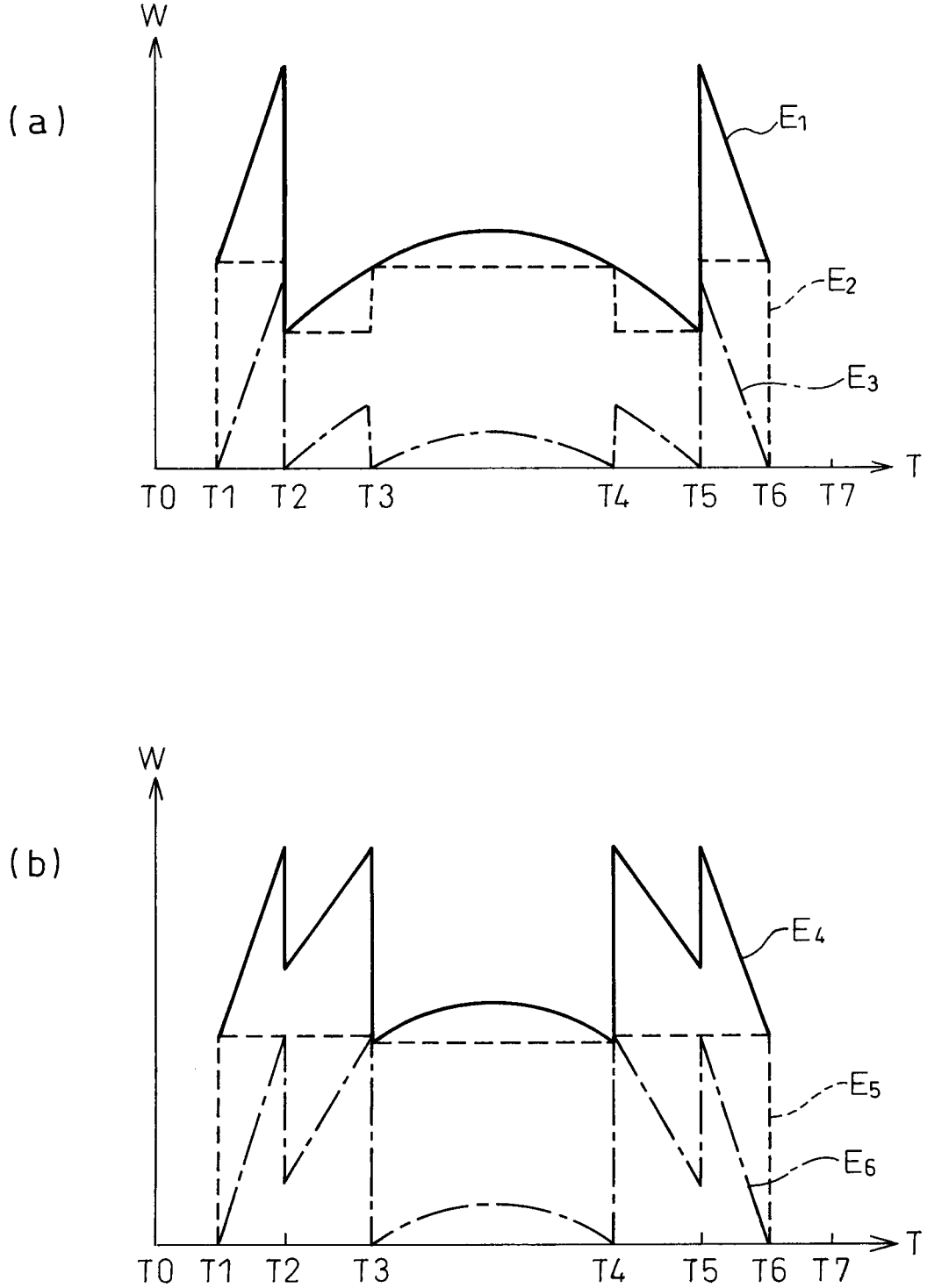
FIG. 18 is a diagram showing the input power, power consumption, and power loss of the LED driving circuit 5 in comparison with an LED driving circuit 12.

FIG. 18(*a*) is a diagram showing the input power, power consumption, and power loss of the LED driving circuit 5, and FIG. 18(*b*) is a diagram showing the input power, power consumption, and power loss of the LED driving circuit 12.

In FIG. 18(*a*), solid line $E_1$ indicates the input power to the LED driving circuit 5, dashed line $E_2$ indicates the power consumption of the LED driving circuit 5, and semi-dashed line $E_3$ indicates the power loss occurring in the LED driving circuit 5. Similarly, in FIG. 18(*b*), solid line $E_4$ indicates the input power to the LED driving circuit 12, dashed line $E_5$ indicates the power consumption of the LED driving circuit 12, and semi-dashed line $E_6$ indicates the power loss occurring in the LED driving circuit 12.

When the conversion efficiency (%) is defined as (power consumption/input power)×100, it is seen from FIGS. 18(*a*)

and 18(*b*) that the conversion efficiency of the LED driving circuit 5 of FIG. 13 is 80.3(%), while the conversion efficiency of the LED driving circuit 12 of FIG. 33 is as low as 72.9(%). This is believed to be because of the unbalanced impedance condition that occurs, for example, when two LED blocks containing the same number of LEDs and one LED block are connected in parallel relative to the full-wave rectification circuit 82, as previously shown in FIG. 34(*b*) or 34(*d*). By contrast, in the case of the LED driving circuit 5, since the (2-3)th current monitor 136 and the (3-2)th current control unit 144 cooperatively perform control to turn off the third LED block 141 with proper timing, it is possible to reduce the power loss and enhance the conversion efficiency of the LED driving circuit.

Figure 19:
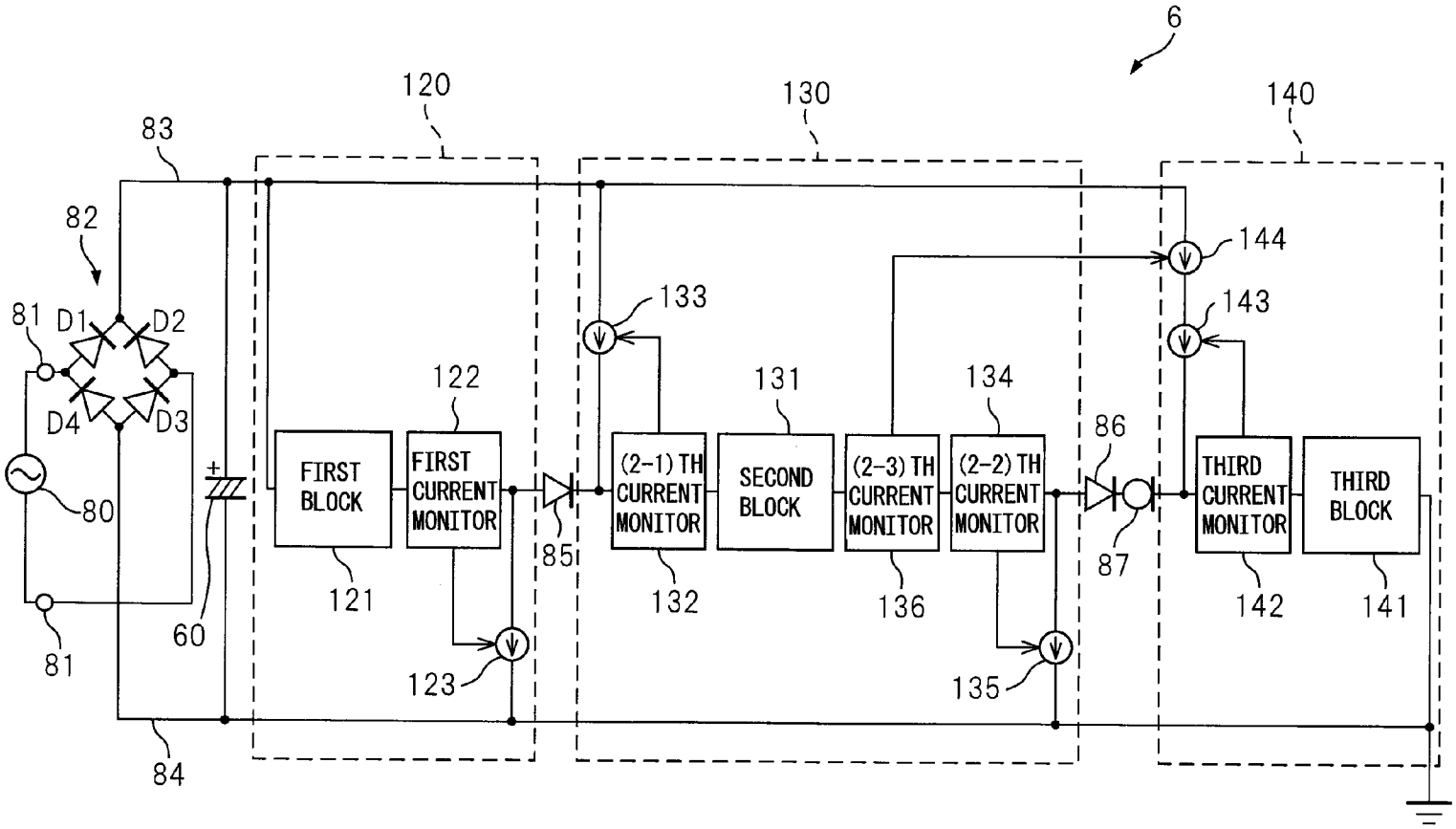
FIG. 19 is a diagram schematically illustrating the configuration of a further alternative LED driving circuit 6.

FIG. 19 is an explanatory schematic diagram of a further alternative LED driving circuit 6.

The LED driving circuit 6 shown in FIG. 19 differs from the LED driving circuit 5 shown in FIG. 13 only in that the LED driving circuit 6 includes an electrolytic capacitor 60 which is inserted between the output terminals of the full-wave rectification circuit 82.

The output voltage waveform of the full-wave rectification circuit 82 is smoothed by the electrolytic capacitor 60 (see the voltage waveform D in FIG. 15). In the case of the output voltage waveform C of the LED driving circuit 5 shown in FIG. 13, all the LEDs are OFF during the period from time T0 to time T1 and the period from time T6 to time T7, because the output voltage is lower than the first forward voltage V1. Accordingly, in the LED driving circuit 5 shown in FIG. 13, the LED-off period alternates with the LED-on period, which means that the LEDs are switched on and off at 100 Hz when the commercial power supply frequency is 50 Hz and at 120 Hz when the commercial power supply frequency is 60 Hz.

By contrast, in the LED driving circuit 6 shown in FIG. 19, since the output voltage waveform of the full-wave rectification circuit 82 is smoothed, the output voltage of the full-wave rectification circuit 82 is always higher than the first forward voltage V1, and all the LED blocks are ON (see dashed line D in FIG. 15). Alternatively, provisions may be made so that the output voltage of the full-wave rectification circuit 82 is always higher than the second forward voltage V2. The LED driving circuit 6 shown in FIG. 19 can thus prevent the LEDs from switching on and off.

In the example of FIG. 19, the electrolytic capacitor 60 has been added, but instead of the electrolytic capacitor 60, use may be made of a ceramic capacitor or some other device or circuit for smoothing the output voltage waveform of the full-wave rectification circuit 82. Further, in order to improve power factor by suppressing harmonic currents, a coil may be inserted on the AC input side before the diode bridge of the full-wave rectification circuit 82 or at the rectifier output side after the diode bridge.

Figure 20:
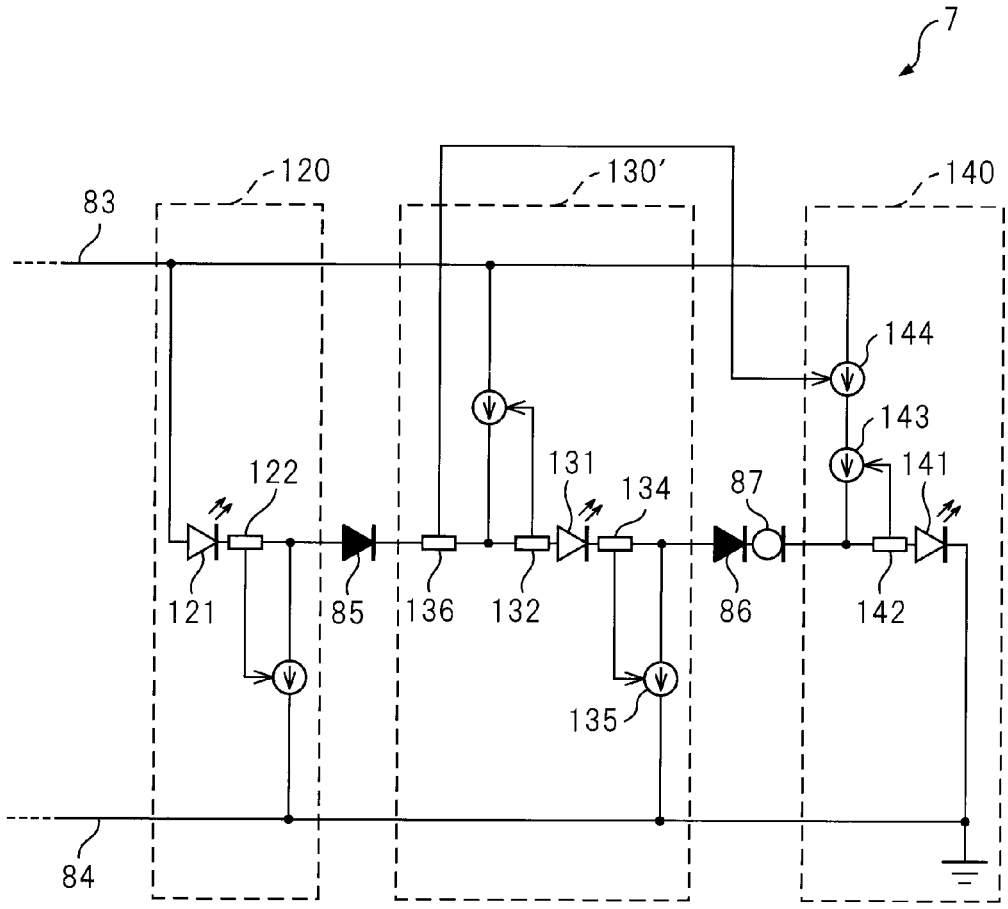
FIG. 20 is a diagram schematically illustrating the configuration of a still further alternative LED driving circuit 7.

FIG. 20 is a diagram schematically illustrating the configuration of a still further alternative LED driving circuit 7.

In the LED driving circuit 7 shown in FIG. 20, the AC commercial power supply (100 VAC) 80, the pair of connecting terminals 81 for connection to the AC commercial power supply 80, and the full-wave rectification circuit 82 shown in FIG. 13 are omitted for simplicity, but it is to be understood that the positive power supply output 83 and the negative power supply output 84 are connected to the full-wave rectification circuit 82 not shown. The LED driving circuit 7 shown in FIG. 20 differs from the LED driving circuit 5 shown in FIG. 13 only in that the (2-3)th current monitor 136 in the LED driving circuit 7 is inserted, not between the second LED block 131 and the (2-2)th current monitor 134, but between the reverse current preventing diode 85 and the (2-1)th current monitor 132. The current path switching sequence in the LED driving circuit 7 is the same as that of the LED driving circuit 5 shown in FIG. 16.

In the LED driving circuit 5 in FIG. 13, the current set value S10 of the (2-3)th current monitor 136 needs to be set higher than the current set value S4 of the (2-1)th current monitor 132 but lower than the current set value S6 of the (2-2)th current monitor 134, as earlier described. The reason is that, in the state in FIG. 16(*a*), the (3-2)th current limiting unit 144 has to be set ON and, in the state of FIG. 16(*b*), the (3-2)th current limiting unit 144 has to be set OFF.

By contrast, in the LED driving circuit 7 of FIG. 20, the current set value S10 of the (2-3)th current monitor 136 need only be set lower than the current set value S6 of the (2-2)th current monitor 134, which offers the advantage of providing greater freedom in setting the current. There is also offered the advantage that the larger the difference between the current set value S10 of the (2-3)th current monitor 136 and the current set value S6 of the (2-2)th current monitor 134, the more stable is the operation of the (3-2)th current limiting unit 144 in the state of FIG. 16(*b*).

Figure 21:
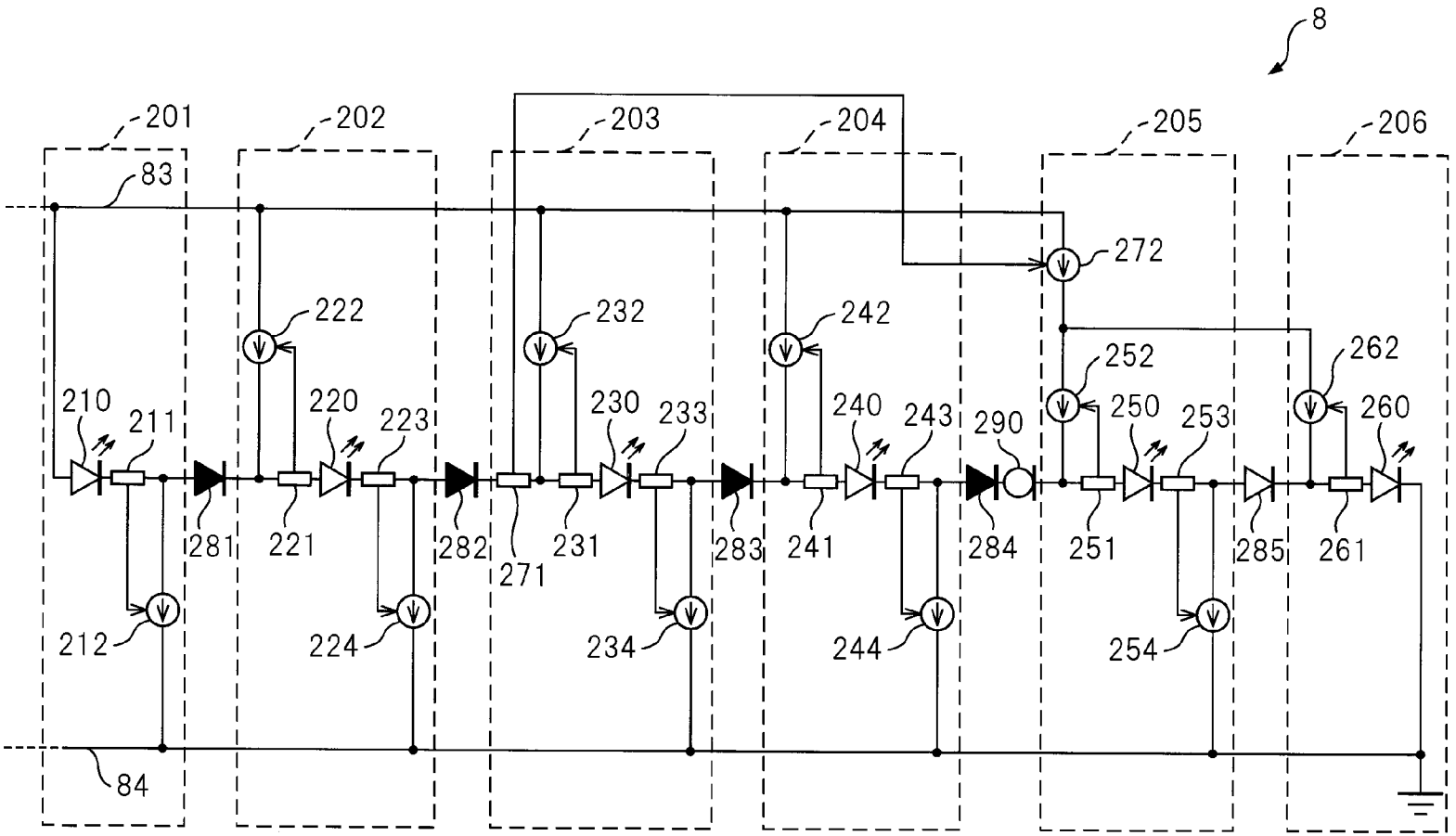
FIG. 21 is a diagram schematically illustrating the configuration of a yet further alternative LED driving circuit 8.

FIG. 21 is a diagram schematically illustrating the configuration of a yet further alternative LED driving circuit 8.

In the LED driving circuit 8 shown in FIG. 21, the AC commercial power supply (100 VAC) 80, the pair of connecting terminals 81 for connection to the AC commercial power supply 80, and the full-wave rectification circuit 82 shown in FIG. 13 are omitted for simplicity, but it is to be understood that the positive power supply output 83 and the negative power supply output 84 are connected to the full-wave rectification circuit 82 not shown. The LED driving circuit 8 includes a start-point circuit 201, four intermediate circuits 202 to 205, and an end-point circuit 206, and further includes reverse current preventing diodes 281 to 285 and a current regulative diode 290 which are inserted between the respective circuits.

The start-point circuit 201, similarly to the start-point circuit 120 shown in FIG. 13, includes a first LED block 210 containing a plurality of LEDs, a first current monitor 211 for detecting current flowing through the first LED block 210, and a first current control unit 212. The first current monitor 211 operates so as to limit the current flowing through the first current control unit 212 in accordance with the current flowing through the first LED block 210.

The end-point circuit 206, similarly to the end-point circuit 140 shown in FIG. 13, includes a sixth LED block 260 containing a plurality of LEDs, a sixth current monitor 261 for detecting current flowing through the sixth LED block 260, and a sixth current control unit 262. The sixth current monitor 261 operates so as to limit the current flowing through the sixth current control unit 262 in accordance with the current flowing through the sixth LED block 260.

The intermediate circuit 202, similarly to the intermediate circuit 130 shown in FIG. 13, includes a second LED block 220 containing a plurality of LEDs, a (2-1)th current monitor 221 and a (2-2)th current monitor 223 for detecting current flowing through the second LED block 220, a (2-1)th current control unit 222, and a (2-2)th current control unit 224. The (2-1)th current monitor 221 performs control so as to limit the current flowing through the (2-1)th current control unit 222 in accordance with the current flowing through the second LED block 220, while the (2-2)th current monitor 223 operates so as to limit the current flowing through the (2-2)th current control unit 224 in accordance with the current flowing through the second LED block 220. Each of the other intermediate circuits 203 to 205 is identical in configuration to the intermediate circuit 202, and includes an LED block containing a plurality of LEDs, two current monitors for detecting current flowing through the LED block, and two current control units whose currents are limited by the respective current monitors.

The LED driving circuit 8 further includes a current monitor 271 and a current control unit 272 in which the flowing current (the current flowing through the third LED block 230 and the fourth LED block 240 when the two LED blocks are connected in series) is limited by the current monitor; the current monitor 271 and the current control unit 272 are similar in function to the (2-3)th current monitor 136 and the (3-2)th current control unit 144 provided in the LED driving circuit 5 shown in FIG. 13, and are provided in order to prevent the occurrence of power loss due to an unbalanced condition that may occur when the connection of the LED blocks is switched to series and/or parallel.

Figure 22:
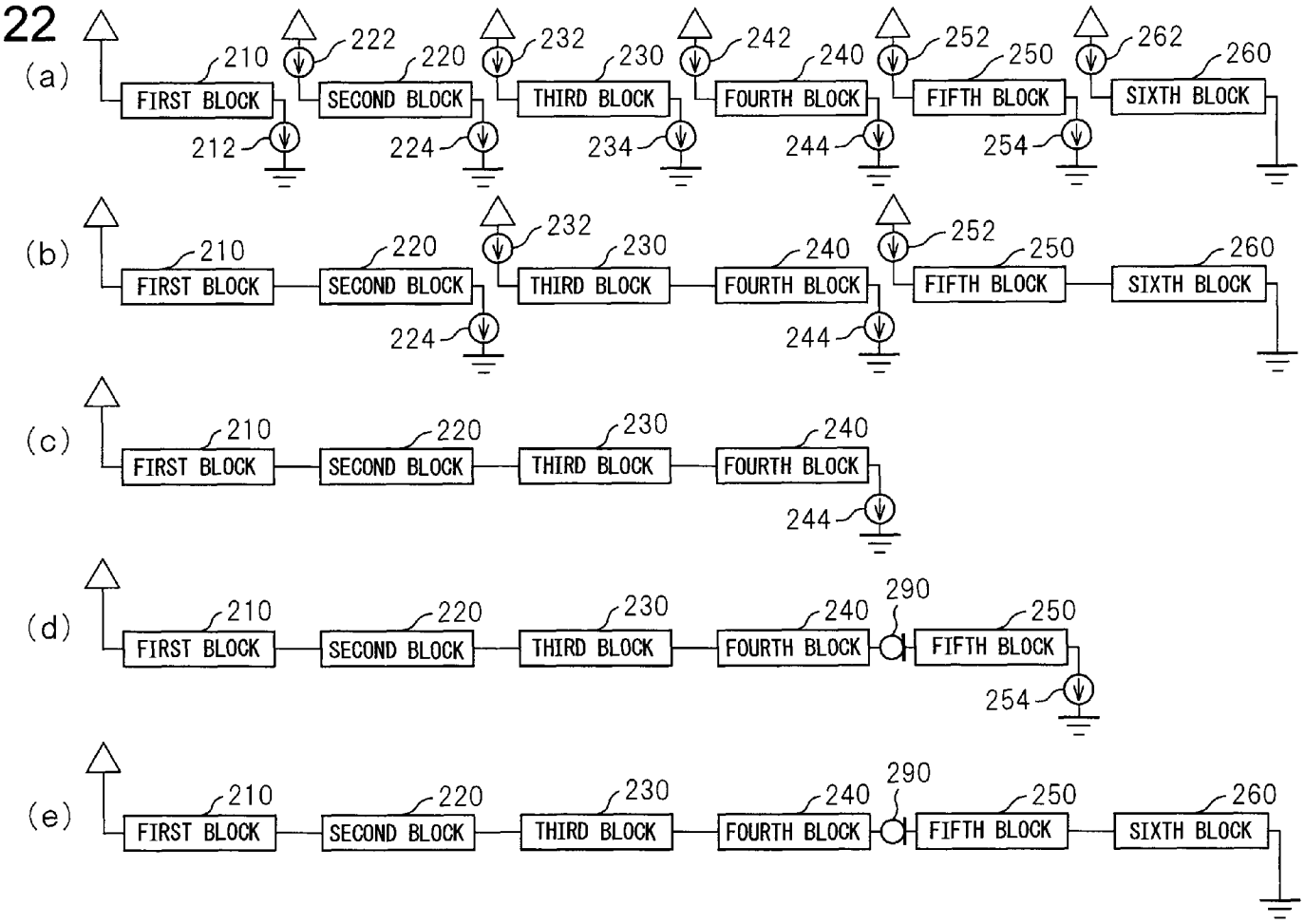
FIG. 22 is a diagram showing an example of an LED block switching sequence in the LED driving circuit 8 of FIG. 21.

FIG. 22 is a diagram showing an example of the LED block switching sequence in the LED driving circuit 8 of FIG. 21.

In FIG. 21, the method for switching the connection of the respective LED blocks in the start-point circuit 201, end-point circuit 206, and intermediate circuits 202 to 205 from parallel to series and/or vice versa in accordance with the output voltage of the full-wave rectification circuit 82 is essentially the same as that described in connection with the LED driving circuit 1, and the sequence for switching the respective LED blocks in accordance with the output voltage of the full-wave rectification circuit 82 will be described here with reference to FIG. 22. In the illustrated example, each of the LED blocks provided in the start-point circuit 201, end-point circuit 206, and intermediate circuits 202 and 205, respectively, contains six LEDs connected in series, and the total number of LEDs contained in the LED driving circuit 8 is 36.

For example, at time T0 when the output voltage of the full-wave rectification circuit 82 is 0 (v), the LEDs contained in any of the first to sixth LED blocks 210 to 260 remain OFF.

The first to sixth LED blocks 210 to 260 each contain six LEDs connected in series; therefore, at time T1, for example, when a voltage approximately equal to a first forward voltage V1 (6×Vf=6×3.2=19.2 (v)) is applied from the full-wave rectification circuit 82 to each of the first to sixth LED blocks 210 to 260, the LEDs contained in each of the first to sixth LED blocks 210 to 260 emit light (see FIG. 22(*a*)). At this time, the current control unit 272 is ON, and the current flowing through the fifth LED block 250 is controlled by the (5-2)th current control unit 254, while the current flowing through the sixth LED block 260 is controlled by the sixth current control unit 262.

Next, at time T2, for example, when a voltage approximately equal to a second forward voltage V2 ((6+6)×3.2=38.4 (v)) is applied from the full-wave rectification circuit 82 to a series connection of the first LED block 210 and the second LED block 220, a series connection of the third LED block 230 and the fourth LED block 240, and a series connection of the fifth LED block 250 and the sixth LED block 260, respectively, the LEDs contained in the respective LED blocks emit light (see FIG. 22(*b*)). At this time, the current control unit 272 is ON, and the current flowing through the fifth and sixth LED blocks 250 and 260 is controlled by the (5-1)th current control unit 252.

Next, at time T3, for example, when a voltage approximately equal to a third forward voltage V3 ((6+6+6+6)×3.2=76.8 (v)) is applied from the full-wave rectification circuit 82 to a series connection of the first LED block 210, the second LED block 220, the third LED block 230, and the fourth LED block 240, the LEDs contained in the respective LED blocks emit light (see FIG. 22(*c*)). If the third forward voltage V3 were also applied from the full-wave rectification circuit 82 to the series connection of the fifth LED block 250 and the sixth LED block 260, the LEDs contained in these LED blocks could be made to emit light. However, if the LEDs contained in the fifth and sixth LED blocks 250 and 260 were made to emit light with the third forward voltage V3, power loss would occur at the (5-1)th current limiting unit 252, as previously explained with reference to FIGS. 16(*b*) and 16(*d*). In view of this, in the LED driving circuit 8, the current monitor 271 performs control to put the current control unit 272 in the OFF state so that the current will not flow into the fifth and sixth LED blocks 250 and 260. When the output voltage is equal to or higher than the third forward voltage V3, the current monitor 271 holds the current control unit 272 in the OFF state to block the current passing through the current control unit 272.

Next, at time T4, for example, when a voltage approximately equal to a fourth forward voltage V4 ((6+6+6+6+6)×3.2=96.0 (v)) is applied from the full-wave rectification circuit 82 to a series connection of the first LED block 210, the second LED block 220, the third LED block 230, the fourth LED block 240, and the fifth LED block 250, the LEDs contained in the respective LED blocks emit light (see FIG. 22(*d*)). As the output voltage nears the fourth forward voltage V4, the diode 284 which has so far been reverse biased begins to be forward biased, and the current begins to flow into the fifth LED block 250. However, since the output voltage of the full-wave rectification circuit 82 is not sufficiently high, the current does not flow into the sixth LED block 260. At this time, the current control unit 272 is held in the OFF state under the control of the current monitor 271.

If the fourth forward voltage V4 were applied from the full-wave rectification circuit 82 to the sixth LED block 260, the LEDs contained therein could be made to emit light. However, if the LEDs contained in the sixth LED block 260 were made to emit light with the fourth forward voltage V4, power loss would occur at the sixth current limiting unit 262, as previously explained with reference to FIGS. 16(*b*) and 16(*d*). In view of this, in the LED driving circuit 8, the current monitor 271 operates in conjunction with the current control unit 272, as earlier described, and performs control so that the current will not flow into the sixth LED block 260.

Next, at time T5, for example, when a voltage approximately equal to a fifth forward voltage V5 ((6+6+6+6+6+6)×3.2=115.2 (v)) is applied from the full-wave rectification circuit 82 to a series connection of the first to sixth LED blocks 210 to 260, the LEDs contained in the respective LED blocks emit light (see FIG. 22(*e*)). As the output voltage nears the fifth forward voltage V5, the diode 285 which has so far been reverse biased begins to be forward biased, and the current begins to flow into the sixth LED block 260. At this time, the current control unit 272 is held in the OFF state under the control of the current monitor 271.

In the LED driving circuit 8 shown in FIG. 21, the respective LED blocks are caused to emit light by repeatedly cycling through the states shown in FIGS. 22(*a*) to 22(*e*) in accordance with the output voltage of the full-wave rectification circuit 82. As described earlier, the current monitor 271 and the current control unit 272 work cooperatively to prevent the occurrence of an unbalanced condition and thus prevent the occurrence of power loss.

Figure 23:
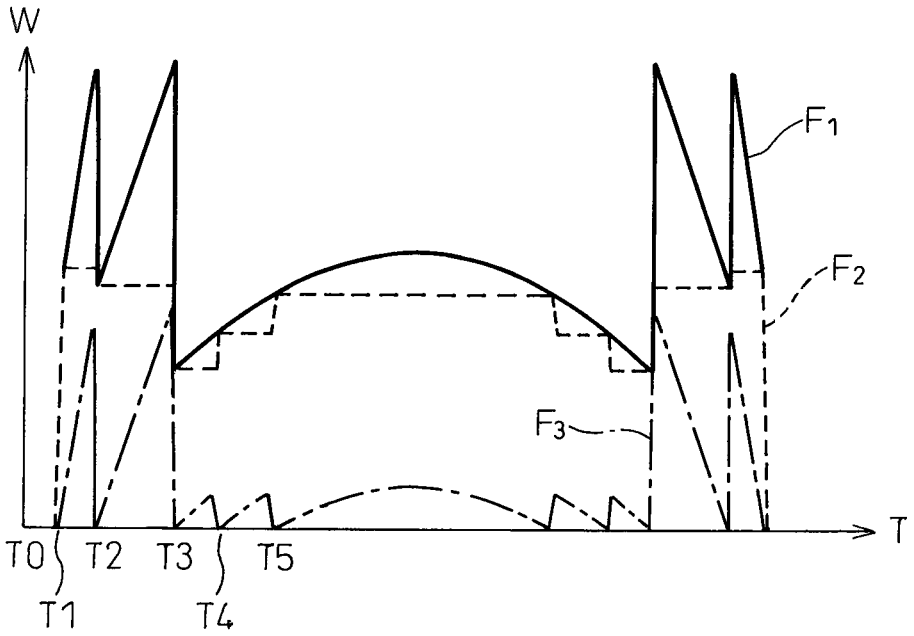
FIG. 23 is a diagram showing the input power, power consumption, and power loss of the LED driving circuit 8.

FIG. 23 is a diagram showing the input power, power consumption, and power loss of the LED driving circuit 8.

In FIG. 23, solid line $F_1$ indicates the input power to the LED driving circuit 8, dashed line $F_2$ indicates the power consumption of the LED driving circuit 8, and semi-dashed line $F_3$ indicates the power loss occurring in the LED driving circuit 8. From FIG. 23, the conversion efficiency of the LED driving circuit 8 of FIG. 21 is 81.5(%). In this way, with the LED driving circuit 8, since the current monitor 271 and the current control unit 144 cooperatively perform control to turn off the fifth LED block 250 and/or the sixth LED block 260 with proper timing, it becomes possible to reduce the power loss and enhance the conversion efficiency of the LED driving circuit.

Figure 24:
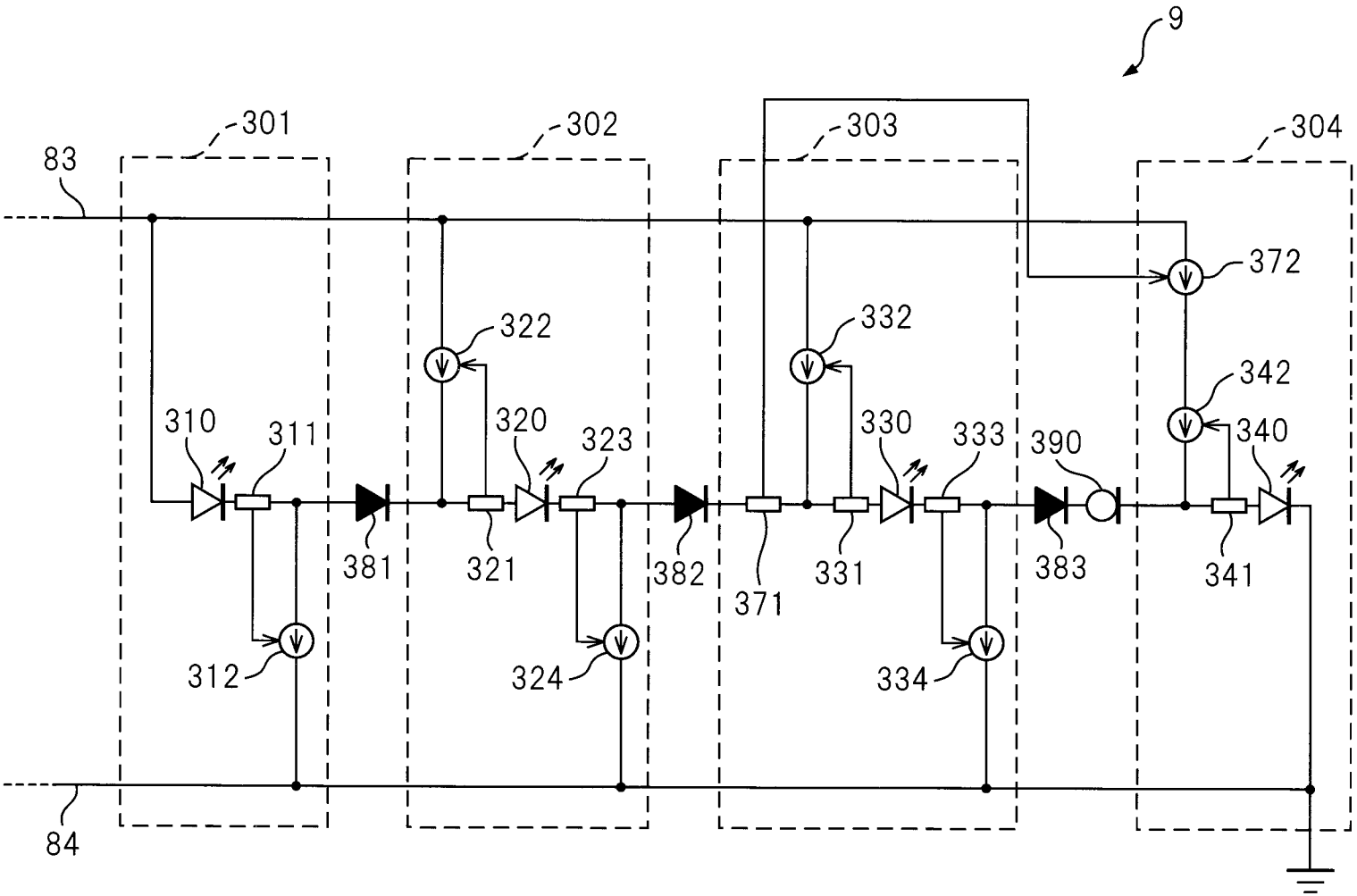
FIG. 24 is a diagram schematically illustrating the configuration of another alternative LED driving circuit 9.

FIG. 24 is a diagram schematically illustrating the configuration of another alternative LED driving circuit 9.

In the LED driving circuit 9 shown in FIG. 24, the AC commercial power supply (100 VAC) 80, the pair of connecting terminals 81 for connection to the AC commercial power supply 80, and the full-wave rectification circuit 82 shown in FIG. 1 are omitted for simplicity, but it is to be understood that the positive power supply output 83 and the negative power supply output 84 are connected to the full-wave rectification circuit 82 not shown. The LED driving circuit 9 includes a start-point circuit 301, two intermediate circuits 302 and 303, and an end-point circuit 304, and further includes reverse current preventing diodes 381 to 383 and a current regulative diode 390 which are inserted between the respective circuits.

The start-point circuit 301, similarly to the start-point circuit 120 shown in FIG. 13, includes a first LED block 310 containing a plurality of LEDs, a first current monitor 311 for detecting current flowing through the first LED block 310, and a first current control unit 312. The first current monitor 311 operates so as to limit the current flowing through the first current control unit 312 in accordance with the current flowing through the first LED block 310.

The end-point circuit 304, similarly to the end-point circuit 140 shown in FIG. 13, includes a fourth LED block 340 containing a plurality of LEDs, a fourth current monitor 341 for detecting current flowing through the fourth LED block 340, and a fourth current control unit 342. The fourth current monitor 341 operates so as to limit the current flowing through the fourth current control unit 342 in accordance with the current flowing through the fourth LED block 340.

The intermediate circuit 302, similarly to the intermediate circuit 130 shown in FIG. 13, includes a second LED block 320 containing a plurality of LEDs, a (2-1)th current monitor 321 and a (2-2)th current monitor 323 for detecting current flowing through the second LED block 320, a (2-1)th current control unit 322, and a (2-2)th current control unit 324. The (2-1)th current monitor 321 performs control so as to limit the current flowing through the (2-1)th current control unit 322 in accordance with the current flowing through the second LED block 320, while the (2-2)th current monitor 323 operates so as to limit the current flowing through the (2-2)th current control unit 324 in accordance with the current flowing through the second LED block 320. The intermediate circuit 303 is identical in configuration to the intermediate circuit 302, and includes an LED block containing a plurality of LEDs, two current monitors for detecting current flowing through the LED block, and two current control units whose currents are limited by the respective current monitors.

The LED driving circuit 9 further includes a current monitor 371 and a current control unit 372 in which the flowing current (the current flowing through the first LED block 310 and the second LED block 320 when the two LED blocks are connected in series) is limited by the current monitor 371; the current monitor 371 and the current control unit 372 are similar in function to the (2-3)th current monitor 136 and the (3-2)th current control unit 144 provided in the LED driving circuit 5 shown in FIG. 13, and are provided in order to prevent the occurrence of power loss due to an unbalanced condition that may occur when the connection of the LED blocks is switched to series and/or parallel.

Figure 25:
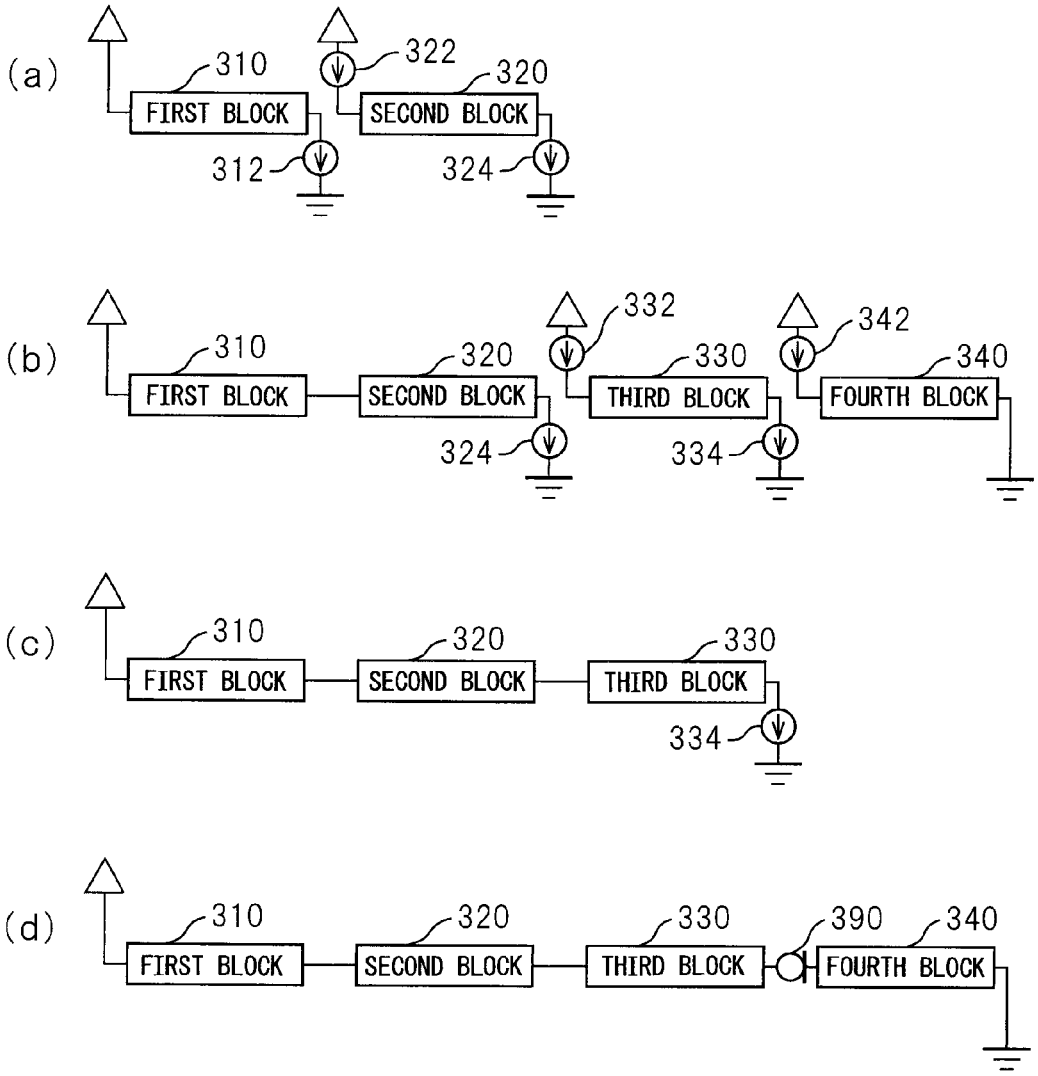
FIG. 25 is a diagram showing an example of an LED block switching sequence in the LED driving circuit 9 of FIG. 24.

FIG. 25 is a diagram showing an example of the LED block switching sequence in the LED driving circuit 9 of FIG. 24.

In FIG. 24, the method for switching the connection of the respective LED blocks in the start-point circuit 301, end-point circuit 304, and intermediate circuits 302 and 303 from parallel to series and/or vice versa in accordance with the output voltage of the full-wave rectification circuit 82 is essentially the same as that described in connection with the LED driving circuit 5, and the sequence for switching the respective LED blocks in accordance with the output voltage of the full-wave rectification circuit 82 will be described here with reference to FIG. 25. In the illustrated example, the first LED block 310 in the start-point circuit 301 contains six LEDs connected in series, the second LED block 320 in the intermediate circuit 302 contains six LEDs connected in series, the third LED block in the intermediate circuit 303 contains 12 LEDs connected in series, and the fourth LED block 340 in the end-point circuit 304 contains 12 LEDs connected in series; i.e., a total of 36 LEDs are contained in the LED driving circuit 9.

For example, at time T0 when the output voltage of the full-wave rectification circuit 82 is 0 (v), the LEDs contained in any of the first to fourth LED blocks 310 to 340 remain OFF.

The first and second LED blocks 310 and 320 each contain six LEDs connected in series; therefore, at time T1, for example, when a voltage approximately equal to a first forward voltage V1 ($6\times Vf=6\times 3.2=19.2$ (v)) is applied from the full-wave rectification circuit 82 to each of the first and second LED blocks 310 and 320, the LEDs contained in the first and second LED blocks 310 and 320 emit light (see FIG. 25(*a*)).

Next, at time T2, for example, when a voltage approximately equal to a second forward voltage V2 ($(6+6)\times 3.2=38.4$ (v)) is applied from the full-wave rectification circuit 82 to a series connection of the first LED block 310 and the second LED block 320 and to each of the third and fourth LED blocks 330 and 340, the LEDs contained in the respective LED blocks emit light (see FIG. 25(*b*)).

Next, at time T3, for example, when a voltage approximately equal to a third forward voltage V3 ($(6+6+12)\times 3.2=76.8$ (v)) is applied from the full-wave rectification circuit 82 to a series connection of the first LED block 310, the second LED block 320, and the third LED block 330, the LEDs contained in the respective LED blocks emit light (see FIG. 25(*c*)). If the third forward voltage V3 were also applied from the full-wave rectification circuit 82 to the fourth LED block 340, the LEDs contained therein could be made to emit light. However, if the LEDs contained in the fourth LED block 240 were made to emit light with the third forward voltage V3, power loss would occur at the fourth current limiting unit 342, as previously explained with reference to FIGS. 16(*b*) and 16(*d*). In view of this, in the LED driving circuit 9, the current monitor 371 operates in conjunction with the current control unit 372 and performs control so that the current will not flow into the fourth LED block 340.

Next, at time T4, for example, when a voltage approximately equal to a fourth forward voltage V4 ($(6+6+12+12)\times 3.2=115.2$ (v)) is applied from the full-wave rectification circuit 82 to a series connection of the first LED block 310, the second LED block 320, the third LED block 330, and the fourth LED block 340, the LEDs contained in the respective LED blocks emit light (see FIG. 25(*d*)).

In the LED driving circuit 9 shown in FIG. 24, the respective LED blocks are caused to emit light by repeatedly cycling through the states shown in FIGS. 25(*a*) to 25(*d*) in accordance with the output voltage of the full-wave rectification circuit 82. As earlier described, the current monitor 371 and the current control unit 372 work cooperatively to prevent the occurrence of an unbalanced condition and thus prevent the occurrence of power loss.

Figure 26:
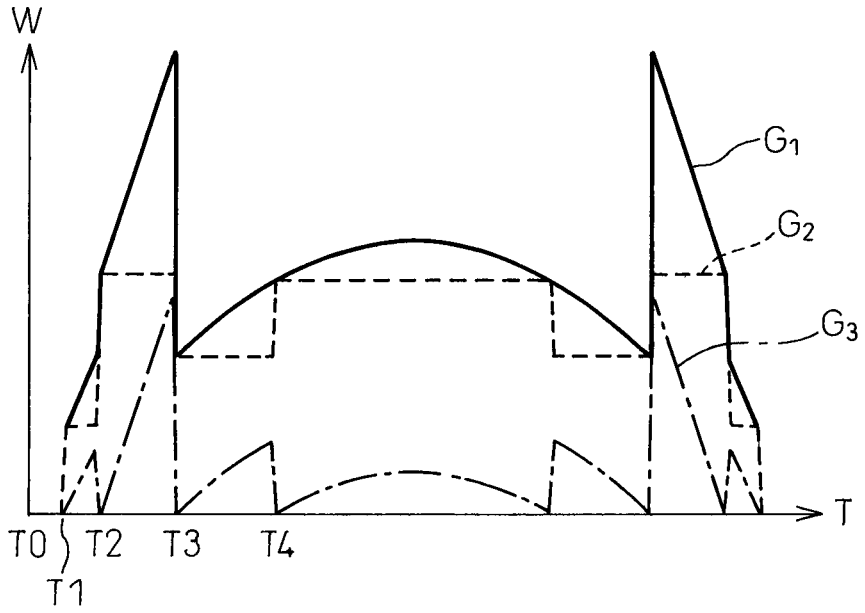
FIG. 26 is a diagram showing the input power, power consumption, and power loss of the LED driving circuit 9.

FIG. 26 is a diagram showing the input power, power consumption, and power loss of the LED driving circuit 9.

In FIG. 26, solid line $G_1$ indicates the input power to the LED driving circuit 9, dashed line $G_2$ indicates the power consumption of the LED driving circuit 9, and semi-dashed line $G_3$ indicates the power loss occurring in the LED driving circuit 9. From FIG. 26, the conversion efficiency of the LED driving circuit 9 of FIG. 24 is 80.0(%). In this way, with the LED driving circuit 9, since the current monitor 371 and the current control unit 372 cooperatively perform control to turn off the fourth LED block 340 with proper timing, it is possible to reduce the power loss and enhance the conversion efficiency of the LED driving circuit.

Figure 27:
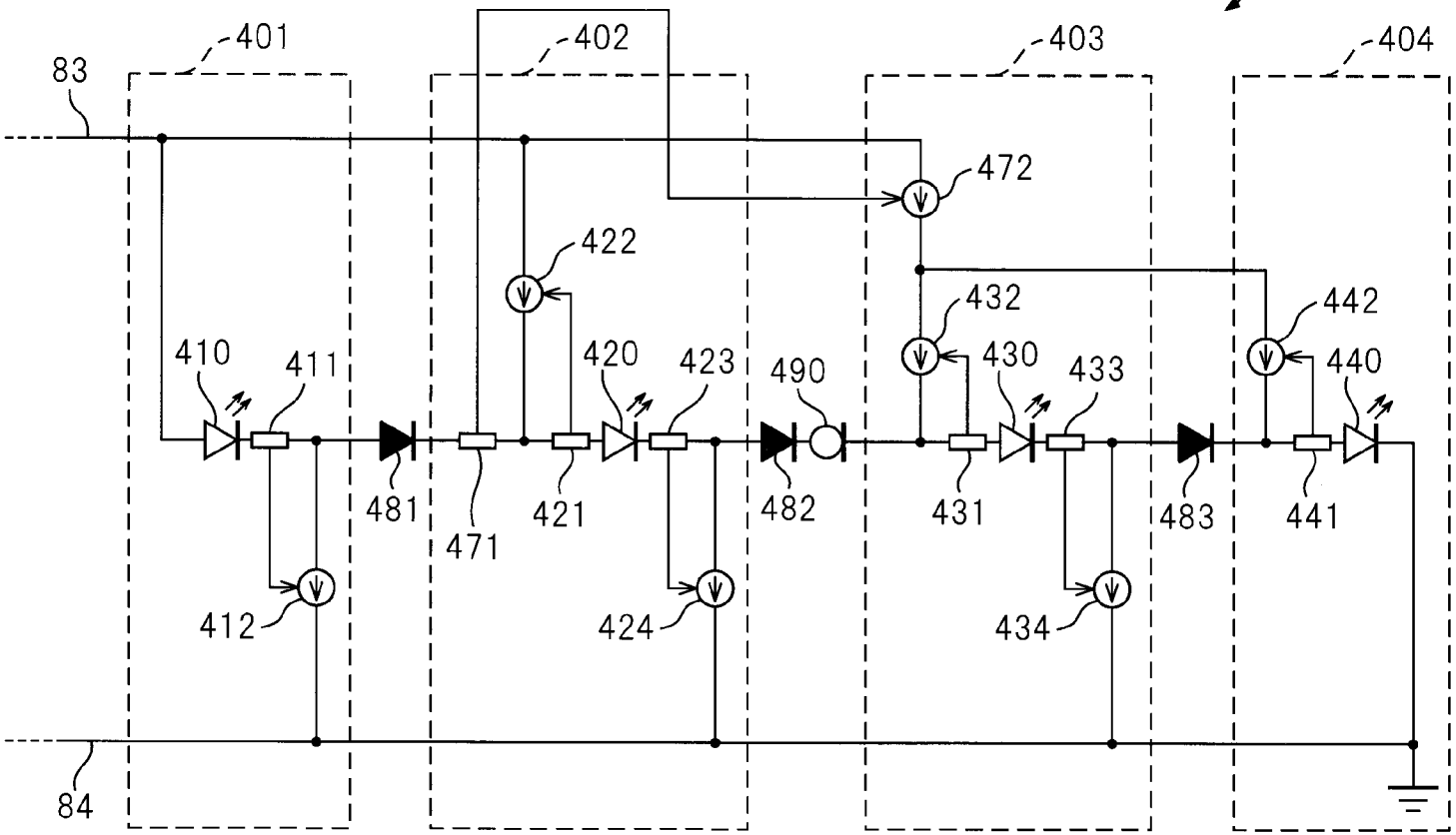
FIG. 27 is a diagram schematically illustrating the configuration of still another alternative LED driving circuit 10.

FIG. 27 is a diagram schematically illustrating the configuration of still another alternative LED driving circuit 10.

In the LED driving circuit 10 shown in FIG. 27, the AC commercial power supply (100 VAC) 80, the pair of connecting terminals 81 for connection to the AC commercial power supply 80, and the full-wave rectification circuit 82 shown in FIG. 13 are omitted for simplicity, but it is to be understood that the positive power supply output 83 and the negative power supply output 84 are connected to the full-wave rectification circuit 82 not shown. The LED driving circuit 10 includes a start-point circuit 401, two intermediate circuits 402 and 403, and an end-point circuit 404, and further includes reverse current preventing diodes 481 to 483 and a current regulative diode 490 which are inserted between the respective circuits.

The start-point circuit 401, similarly to the start-point circuit 120 shown in FIG. 13, includes a first LED block 410 containing a plurality of LEDs, a first current monitor 411 for detecting current flowing through the first LED block 410, and a first current control unit 412. The first current monitor 411 operates so as to limit the current flowing through the first current control unit 412 in accordance with the current flowing through the first LED block 410.

The end-point circuit 404, similarly to the end-point circuit 140 shown in FIG. 13, includes a fourth LED block 440 containing a plurality of LEDs, a fourth current monitor 441 for detecting current flowing through the fourth LED block 440, and a fourth current control unit 442. The fourth current monitor 441 operates so as to limit the current flowing through the fourth current control unit 442 in accordance with the current flowing through the fourth LED block 440.

The intermediate circuit 402, similarly to the intermediate circuit 130 shown in FIG. 13, includes a second LED block 420 containing a plurality of LEDs, a (2-1)th current monitor 421 and a (2-2)th current monitor 423 for detecting current flowing through the second LED block 420, a (2-1)th current control unit 422, and a (2-2)th current control unit 424. The (2-1)th current monitor 421 performs control so as to limit the current flowing through the (2-1)th current control unit 422 in accordance with the current flowing through the second LED block 420, while the (2-2)th current monitor 423 operates so as to limit the current flowing through the (2-2)th current control unit 424 in accordance with the current flowing through the second LED block 420. The intermediate circuit 403 is identical in configuration to the intermediate circuit 402, and includes an LED block containing a plurality of LEDs, two current monitors for detecting current flowing through the LED block, and two current control units whose currents are limited by the respective current monitors.

The LED driving circuit 10 further includes a current monitor 471 and a current control unit 472 in which the flowing current (the current flowing through the first LED block 410 and the second LED block 420 when the two LED blocks are connected in series) is limited by the current monitor 471; the current monitor 471 and the current control unit 472 are similar in function to the (2-3)th current monitor 136 and the (3-2)th current control unit 144 provided in the LED driving circuit 5 shown in FIG. 13, and are provided in order to prevent the occurrence of power loss due to an unbalanced condition that may occur when the connection of the LED blocks is switched to series and/or parallel.

Figure 28:
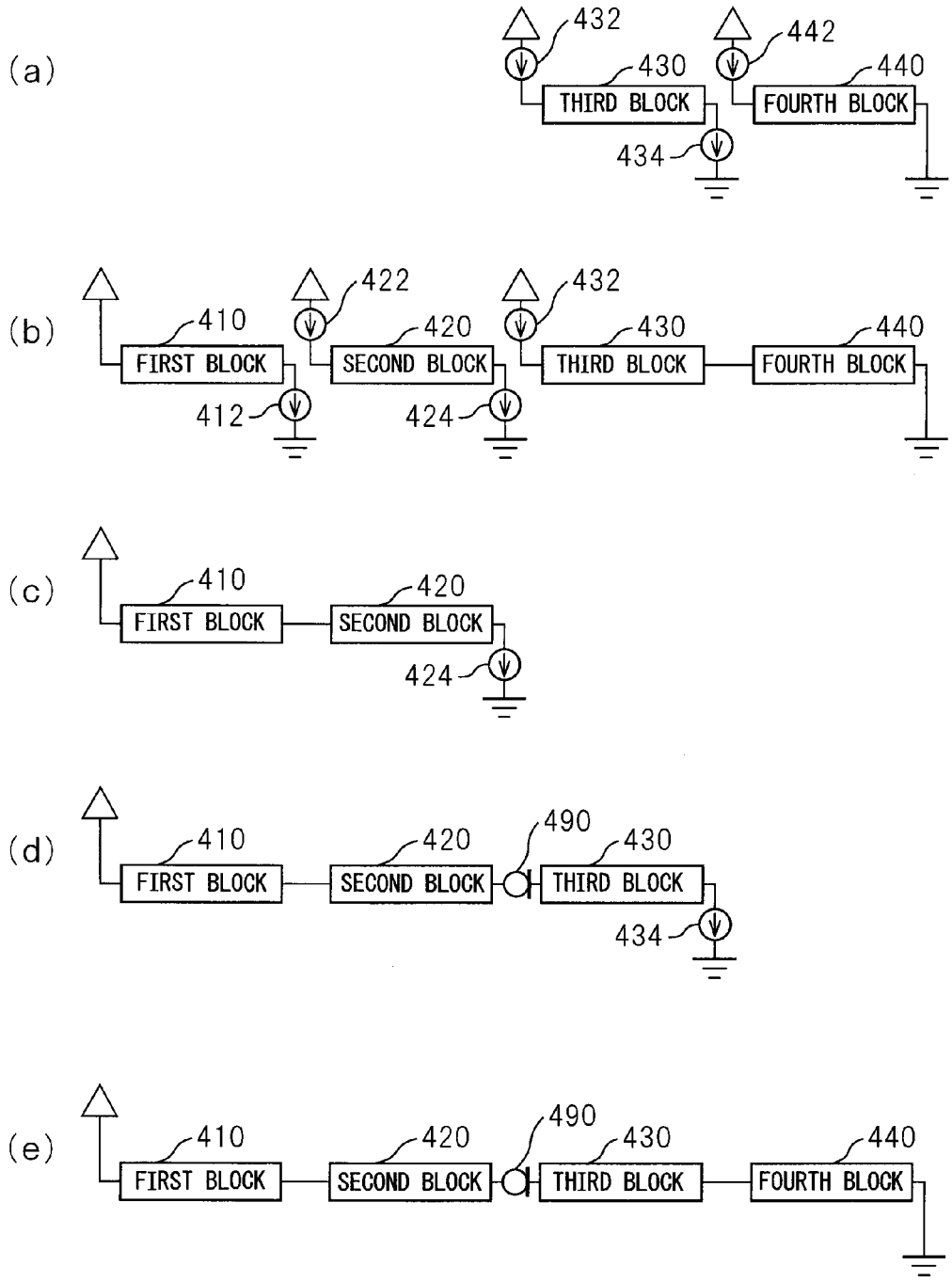
FIG. 28 is a diagram showing an example of an LED block switching sequence in the LED driving circuit 10 of FIG. 27.

FIG. 28 is a diagram showing an example of the LED block switching sequence in the LED driving circuit 10 of FIG. 27.

In FIG. 27, the method for switching the connection of the respective LED blocks in the start-point circuit 401, end-point circuit 404, and intermediate circuits 402 and 403 from parallel to series and/or vice versa in accordance with the output voltage of the full-wave rectification circuit 82 is essentially the same as that described in connection with the LED driving circuit 1, and the sequence for switching the respective LED blocks in accordance with the output voltage of the full-wave rectification circuit 82 will be described here with reference to FIG. 28. In the illustrated example, the first LED block 410 in the start-point circuit 401 contains 12 LEDs connected in series, the second LED block 420 in the intermediate circuit 402 contains 12 LEDs connected in series, the third LED block 430 in the intermediate circuit 403 contains six LEDs connected in series, and the fourth LED block 440 in the end-point circuit 404 contains six LEDs connected in series; that is, a total of 36 LEDs are contained in the LED driving circuit 10.

For example, at time T0 when the output voltage of the full-wave rectification circuit 82 is 0 (v), the LEDs contained in any of the first to fourth LED blocks 410 to 440 remain OFF.

The third and fourth LED blocks 430 and 440 each contain six LEDs connected in series; therefore, at time T1, for example, when a voltage approximately equal to a first forward voltage V1 ($6\times Vf=6\times 3.2=19.2$ (v)) is applied from the full-wave rectification circuit 82 to each of the third and fourth LED blocks 430 and 440, the LEDs contained in the third and fourth LED blocks 430 and 440 emit light (see FIG. 28(*a*)).

Next, at time T2, for example, when a voltage approximately equal to a second forward voltage V2 ($(6+6)\times 3.2=38.4$ (v)) is applied from the full-wave rectification circuit 82 to a series connection of the third LED block 430 and the fourth LED block 440 and to each of the first and second LED blocks 410 and 420, the LEDs contained in the respective LED blocks emit light (see FIG. 28(*b*)).

Next, at time T3, for example, when a voltage approximately equal to a third forward voltage V3 ($(12+12)\times 3.2=76.8$ (v)) is applied from the full-wave rectification circuit 82 to a series connection of the first LED block 410 and the second LED block 420, the LEDs contained in the respective LED blocks emit light (see FIG. 28(*c*)). When the output voltage is equal to or higher than the third forward voltage V3, the current monitor 471 holds the current control unit 472 in the OFF state to block the current passing through the current control unit 472.

If the third forward voltage V3 were also applied from the full-wave rectification circuit 82 to the series connection of the third LED block 430 and the fourth LED block 440, the LEDs contained in these LED blocks could be made to emit light. However, if the LEDs contained in the third and fourth LED blocks 430 and 440 were made to emit light with the third forward voltage V3, power loss would occur at the current limiting unit 432, as previously explained with reference to FIGS. 16(*b*) and 16(*d*). In view of this, in the LED driving circuit 10, the current monitor 471 operates in conjunction with the current control unit 472 and performs control so that the current will not flow into the third and fourth LED blocks 430 and 440.

Next, at time T4, for example, when a voltage approximately equal to a fourth forward voltage V4 ((12+12+6)×3.2=96.0 (v)) is applied from the full-wave rectification circuit 82 to a series connection of the first LED block 410, the second LED block 420, and the third LED block 430, the LEDs contained in the respective LED blocks emit light (see FIG. 28(*d*)). As the output voltage nears the fourth forward voltage V4, the diode 484 which has so far been reverse biased begins to be forward biased, and the current begins to flow into the third LED block 430. However, since the output voltage of the full-wave rectification circuit 82 is not sufficiently high, the current does not flow into the fourth LED block 440.

If the fourth forward voltage V4 were also applied from the full-wave rectification circuit 82 to the fourth LED block 440, the LEDs contained therein could be made to emit light. However, if the LEDs contained in the fourth LED block 440 were made to emit light with the fourth forward voltage V4, power loss would occur at the current limiting unit 442, as previously explained with reference to FIGS. 16(*b*) and 16(*d*). In view of this, in the LED driving circuit 10, the current monitor 471 operates in conjunction with the current control unit 472 and performs control so that the current will not flow into the fourth LED block 440.

Next, at time T5, for example, when a voltage approximately equal to a fifth forward voltage V5 ((12+12+6+6)×3.2=115.2 (v)) is applied from the full-wave rectification circuit 82 to a series connection of the first to fourth LED blocks 410 to 440, the LEDs contained in the respective LED blocks emit light (see FIG. 28(*e*)). As the output voltage nears the fifth forward voltage V5, the diode 483 which has so far been reverse biased begins to be forward biased, and the current begins to flow into the fourth LED block 440. However, when the output voltage is equal to or higher than the third forward voltage V3, the current monitor 471 holds the current control unit 472 in the OFF state to block the current passing through the current control unit 472.

In the LED driving circuit 10 shown in FIG. 27, the respective LED blocks are caused to emit light by repeatedly cycling through the states shown in FIGS. 28(*a*) to 28(*e*) in accordance with the output voltage of the full-wave rectification circuit 82. As earlier described, the current monitor 471 and the current control unit 472 work cooperatively to prevent the occurrence of an unbalanced condition and thus prevent the occurrence of power loss.

Figure 29:
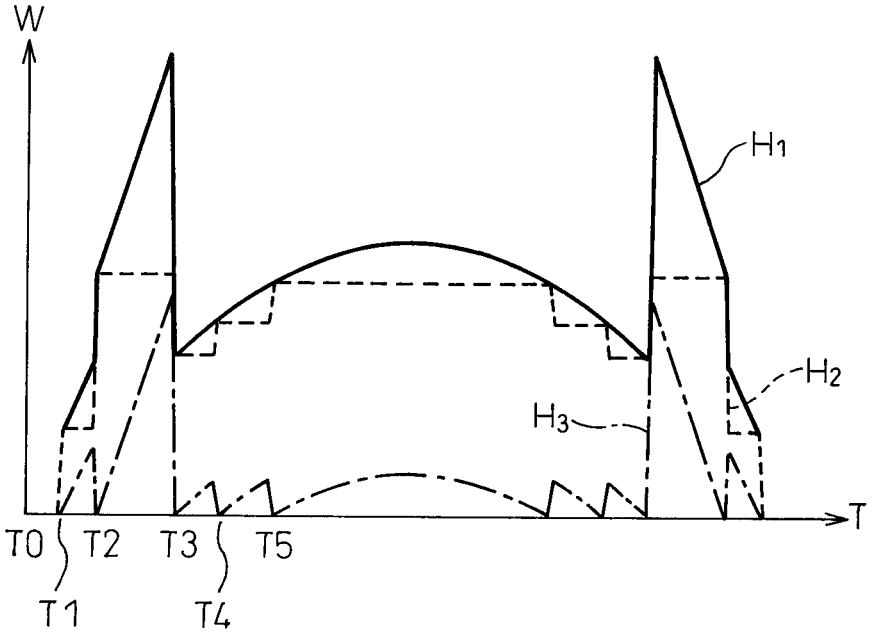
FIG. 29 is a diagram showing the input power, power consumption, and power loss of the LED driving circuit 10.

FIG. 29 is a diagram showing the input power, power consumption, and power loss of the LED driving circuit 10.

In FIG. 29, solid line $H_1$ indicates the input power to the LED driving circuit 10, dashed line $H_2$ indicates the power consumption of the LED driving circuit 10, and semi-dashed line $H_3$ indicates the power loss occurring in the LED driving circuit 10. From FIG. 29, the conversion efficiency of the LED driving circuit 10 of FIG. 27 is 82.3(%). In this way, with the LED driving circuit 10, since the current monitor 471 and the current control unit 472 cooperatively perform control to turn off the third LED block 430 and/or the fourth LED block 440 with proper timing, it becomes possible to reduce the power loss and enhance the conversion efficiency of the LED driving circuit.

Figure 30:
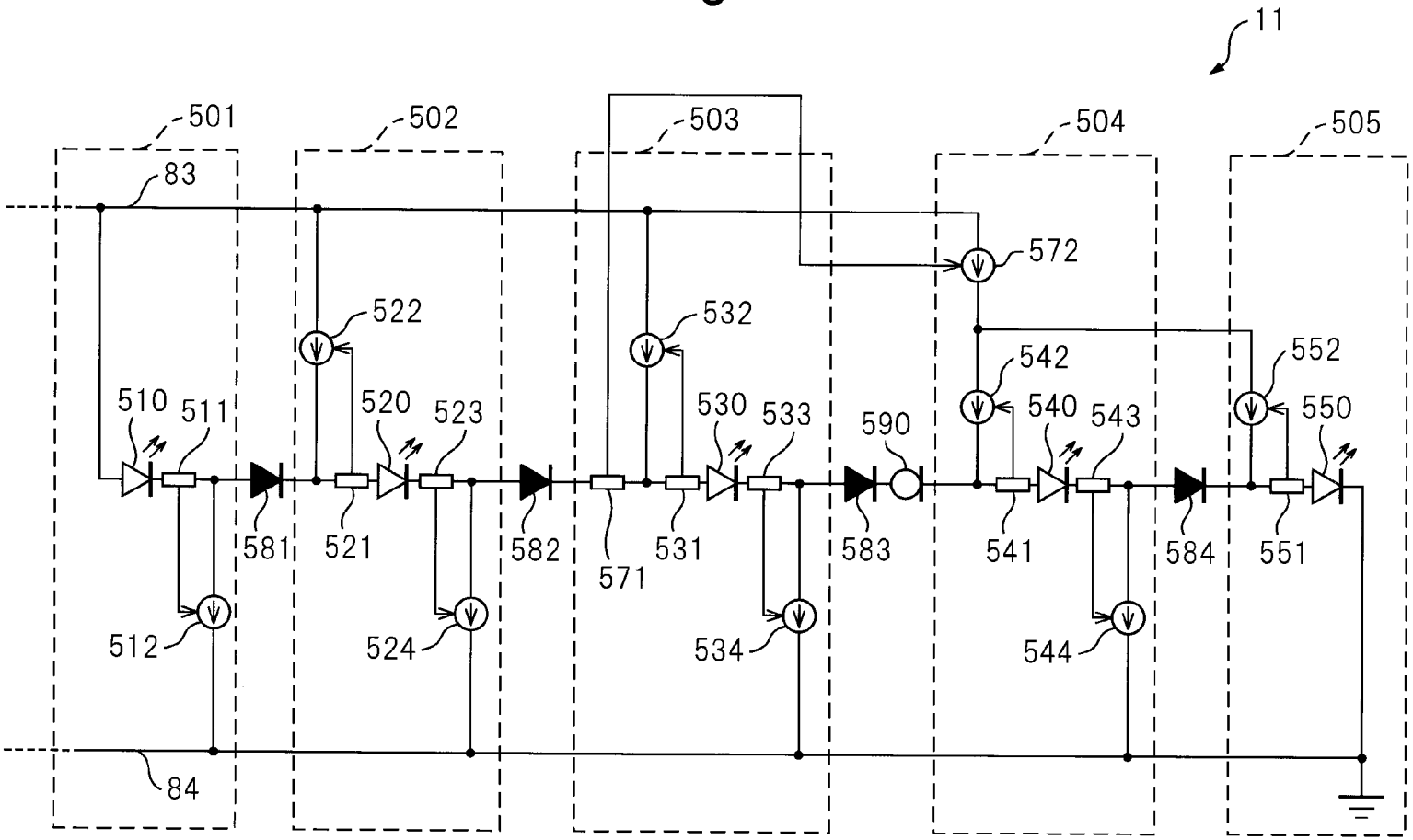
FIG. 30 is a diagram schematically illustrating the configuration of yet another alternative LED driving circuit 11.

FIG. 30 is a diagram schematically illustrating the configuration of yet another alternative LED driving circuit 11.

In the LED driving circuit 11 shown in FIG. 30, the AC commercial power supply (100 VAC) 80, the pair of connecting terminals 81 for connection to the AC commercial power supply 80, and the full-wave rectification circuit 82 shown in FIG. 13 are omitted for simplicity, but it is to be understood that the positive power supply output 83 and the negative power supply output 84 are connected to the full-wave rectification circuit 82 not shown. The LED driving circuit 11 includes a start-point circuit 501, three intermediate circuits 502 to 504, and an end-point circuit 505, and further includes reverse current preventing diodes 581 to 584 and a current regulative diode 590 which are inserted between the respective circuits.

The start-point circuit 501, similarly to the start-point circuit 120 shown in FIG. 13, includes a first LED block 510 containing a plurality of LEDs, a first current monitor 511 for detecting current flowing through the first LED block 510, and a first current control unit 512. The first current monitor 511 operates so as to limit the current flowing through the first current control unit 512 in accordance with the current flowing through the first LED block 510.

The end-point circuit 505, similarly to the end-point circuit 140 shown in FIG. 13, includes a fifth LED block 550 containing a plurality of LEDs, a fifth current monitor 551 for detecting current flowing through the fifth LED block 550, and a fifth current control unit 552. The fifth current monitor 551 operates so as to limit the current flowing through the fifth current control unit 552 in accordance with the current flowing through the fifth LED block 550.

The intermediate circuit 502, similarly to the intermediate circuit 130 shown in FIG. 13, includes a second LED block 520 containing a plurality of LEDs, a (2-1)th current monitor 521 and a (2-2)th current monitor 523 for detecting current flowing through the second LED block 520, a (2-1)th current control unit 522, and a (2-2)th current control unit 524. The (2-1)th current monitor 521 performs control so as to limit the current flowing through the (2-1)th current control unit 522 in accordance with the current flowing through the second LED block 520, while the (2-2)th current monitor 523 operates so as to limit the current flowing through the (2-2)th current control unit 524 in accordance with the current flowing through the second LED block 520. Each of the other intermediate circuits 503 and 504 is identical in configuration to the intermediate circuit 502, and includes an LED block containing a plurality of LEDs, two current monitors for detecting current flowing through the LED block, and two current control units whose currents are limited by the respective current monitors.

The LED driving circuit 11 further includes a current monitor 571 and a current control unit 572 in which the flowing current (the current flowing through the first, second, and third LED blocks 510, 520, and 530 when these LED blocks are connected in series) is limited by the current monitor 571; the current monitor 571 and the current control unit 572 are similar in function to the (2-3)th current monitor 136 and the (3-2)th current control unit 144 provided in the LED driving circuit 5 shown in FIG. 13, and are provided in order to prevent the occurrence of power loss due to an unbalanced condition that may occur when the connection of the LED blocks is switched to series and/or parallel.

Figure 31:
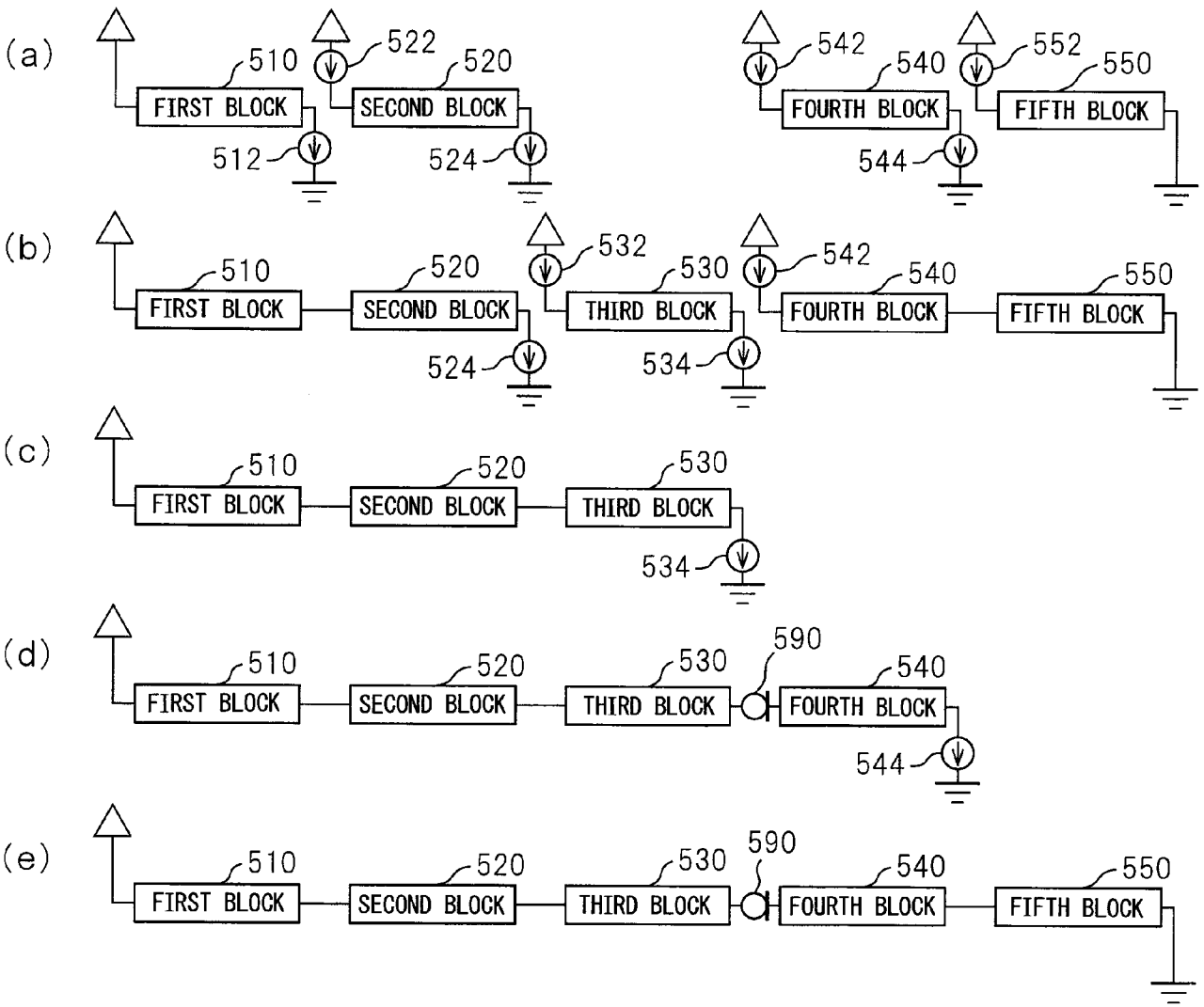
FIG. 31 is a diagram showing an example of an LED block switching sequence in the LED driving circuit 11 of FIG. 30.

FIG. 31 is a diagram showing an example of the LED block switching sequence in the LED driving circuit 11 of FIG. 30.

In FIG. 30, the method for switching the connection of the respective LED blocks in the start-point circuit 501, end-point circuit 505, and intermediate circuits 502 to 504 from parallel to series and/or vice versa in accordance with the output voltage of the full-wave rectification circuit 82 is essentially the same as that described in connection with the LED driving circuit 1, and the sequence for switching the respective LED blocks in accordance with the output voltage of the full-wave rectification circuit 82 will be described here with reference to FIG. 31. In the illustrated example, the first LED block 510 in the start-point circuit 501 contains six LEDs connected in series, the second LED block 520 in the intermediate circuit 502 contains six LEDs connected in series, the third LED block 530 in the intermediate circuit 503 contains 12 LEDs connected in series, the fourth LED block 540 in the intermediate circuit 504 contains six LEDs connected in series, and the fifth LED block 550 in the end-point circuit 505 contains six LEDs connected in series; i.e., a total of 36 LEDs are contained in the LED driving circuit 11.

For example, at time T0 when the output voltage of the full-wave rectification circuit 82 is 0 (v), the LEDs contained in any of the first to fifth LED blocks 510 to 550 remain OFF.

The first, second, fourth, and fifth LED blocks 510, 520, 540, and 550 each contain six LEDs connected in series; therefore, at time T1, for example, when a voltage approximately equal to a first forward voltage V1 (6×Vf=6×3.2=19.2 (v)) is applied from the full-wave rectification circuit 82 to each of the first, second, fourth, and fifth LED blocks 510, 520, 540, and 550, the LEDs contained in each of the first, second, fourth, and fifth LED blocks 510, 520, 540, and 550 emit light (see FIG. 31(*a*)).

Next, at time T2, for example, when a voltage approximately equal to a second forward voltage V2 ((6+6)×3.2=38.4 (v)) is applied from the full-wave rectification circuit 82 to a series connection of the first and second LED blocks 510 and 520, the third LED block 530 as a single LED block, and a series connection of the fourth and fifth LED blocks 540 and 550, respectively, the LEDs contained in the respective LED blocks emit light (see FIG. 31(*b*)).

Next, at time T3, for example, when a voltage approximately equal to a third forward voltage V3 ((6+6+12)×3.2=76.8 (v)) is applied from the full-wave rectification circuit 82 to a series connection of the first, second, and third LED blocks 510, 520, and 530, the LEDs contained in the respective LED blocks emit light (see FIG. 31(*c*)). When the output voltage is equal to or higher than the third forward voltage V3, the current monitor 571 holds the current control unit 572 in the OFF state to block the current passing through the current control unit 572.

If the third forward voltage V3 were also applied from the full-wave rectification circuit 82 to the series connection of the fourth LED block 540 and the fifth LED block 550, the LEDs contained in these LED blocks could be made to emit light. However, if the LEDs contained in the fourth and fifth LED blocks 540 and 550 were made to emit light with the third forward voltage V3, power loss would occur at the (4-1)th current limiting unit 542, as previously explained with reference to FIGS. 16(*b*) and 16(*d*). In view of this, in the LED driving circuit 11, the current monitor 571 operates in conjunction with the current control unit 572 and performs control so that the current will not flow into the fourth and fifth LED blocks 540 and 550.

Next, at time T4, for example, when a voltage approximately equal to a fourth forward voltage V4 ((6+6+12+6)×3.2=96.0 (v)) is applied from the full-wave rectification circuit 82 to a series connection of the first, second, third, and fourth LED blocks 510, 520, 530, and 540, the LEDs contained in the respective LED blocks emit light (see FIG. 31(*d*)). As the output voltage nears the fourth forward voltage V4, the diode 583 which has so far been reverse biased begins to be forward biased, and the current begins to flow into the fourth LED block 540. However, since the output voltage of the full-wave rectification circuit 82 is not sufficiently high, the current does not flow into the fifth LED block 550.

If the fourth forward voltage V4 were also applied from the full-wave rectification circuit 82 to the fifth LED block 550, the LEDs contained therein could be made to emit light. However, if the LEDs contained in the fifth LED block 550 were made to emit light with the fourth forward voltage V4, power loss would occur at the current limiting unit 552, as previously explained with reference to FIGS. 16(*b*) and 16(*d*). In view of this, in the LED driving circuit 11, the current monitor 571 operates in conjunction with the current control unit 572 and performs control so that the current will not flow into the fifth LED block 550.

Next, at time T5, for example, when a voltage approximately equal to a fifth forward voltage V5 ((6+6+12+6+6)×3.2=115.2 (v)) is applied from the full-wave rectification circuit 82 to a series connection of the first to fifth LED blocks 510 to 550, the LEDs contained in the respective LED blocks emit light (see FIG. 31(*e*)). As the output voltage nears the fifth forward voltage V5, the diode 584 which has so far been reverse biased begins to be forward biased, and the current begins to flow into the fifth LED block 550. However, when the output voltage is equal to or higher than the third forward voltage V3, the current monitor 571 holds the current control unit 572 in the OFF state to block the current passing through the current control unit 572.

In the LED driving circuit 11 shown in FIG. 30, the respective LED blocks are caused to emit light by repeatedly cycling through the states shown in FIGS. 31(*a*) to 31(*e*) in accordance with the output voltage of the full-wave rectification circuit 82. As earlier described, the current monitor 571 and the current control unit 572 work cooperatively to prevent the occurrence of an unbalanced condition and thus prevent the occurrence of power loss.

Figure 32:
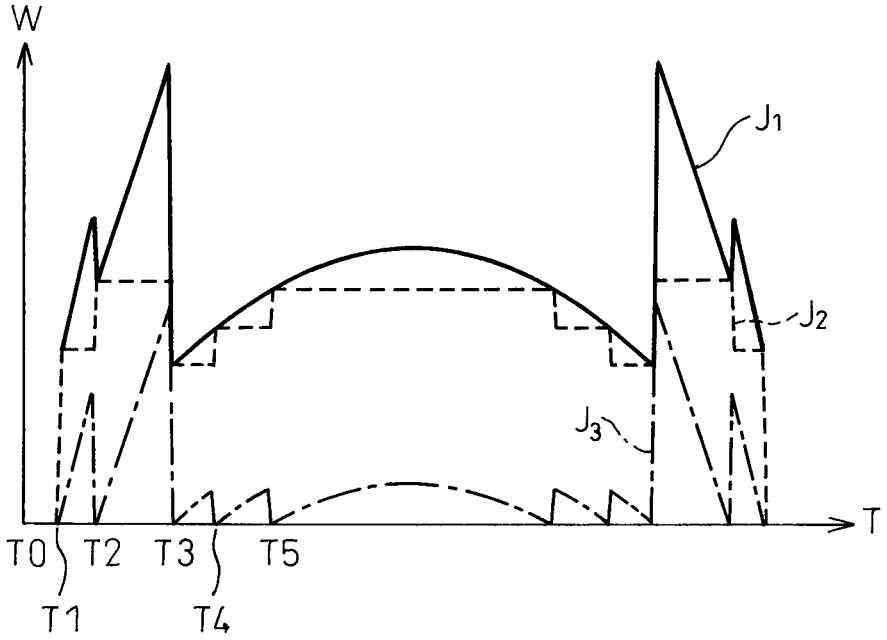
FIG. 32 is a diagram showing the input power, power consumption, and power loss of the LED driving circuit 11.

FIG. 32 is a diagram showing the input power, power consumption, and power loss of the LED driving circuit 11.

In FIG. 32, solid line $J_1$ indicates the input power to the LED driving circuit 11, dashed line $J_2$ indicates the power consumption of the LED driving circuit 11, and semi-dashed line $J_3$ indicates the power loss occurring in the LED driving circuit 11. From FIG. 32, the conversion efficiency of the LED driving circuit 11 of FIG. 30 is 81.9(%). In this way, with the LED driving circuit 11, since the current monitor 571 and the current control unit 572 cooperatively perform control to turn off the third LED block 530 and/or the fifth LED block 550 with proper timing, it is possible to reduce the power loss and enhance the conversion efficiency of the LED driving circuit.

The above has described the LED driving circuits 5 to 11 each comprising a start-point circuit, an end-point circuit, and a plurality of intermediate circuits, each of which includes an LED block containing a different number of LEDs. However, the number of intermediate circuits and the number of LEDs contained in each circuit are only illustrative and are not limited to the examples shown in the LED driving circuits 5 to 11 described above.

Each of the LED driving circuits described above can be used in such applications as LED lighting equipment such as an LED lamp, a liquid crystal television display that uses LEDs as backlight, and lighting equipment for PC screen backlighting.

In the present specification, the phrase "connected in parallel" means that major current paths are formed so as to be connected in parallel, and includes the case where a minuscule amount of current flows through series-connected current paths. Similarly, in the present specification, the phrase "connected in series" means that major current paths are formed so as to be connected in series, and includes the case where a minuscule amount of current flows through parallel-connected current paths.

What is claimed is:

1. An LED driving circuit comprising:

a rectifier having a positive power supply output and a negative power supply output;

a first circuit which is connected to said rectifier, and which includes a first LED array, a first current detection unit for detecting current flowing through said first LED array, and a first current control unit for controlling current flowing from said first LED array to said negative power supply output in accordance with said current detected by said first current detection unit; and a second circuit which is connected to said rectifier, and which includes a second LED array, a second current detection unit for detecting current flowing through said second LED array, and a second current control unit for controlling current flowing from said positive power supply output to said second LED array in accordance with said current detected by said second current detection unit, and wherein:

a current path connecting said first LED array and said second LED array in parallel relative to said rectifier and a current path connecting said first LED array and said second LED array in series relative to said rectifier are formed in accordance with an output voltage of said rectifier.

2. The LED driving circuit according to claim 1, further comprising an intermediate circuit which is disposed between said first circuit and said second circuit, and which includes a third LED array, a third current detection unit for detecting current flowing into said third LED array, a third current control unit for controlling current flowing from said positive power supply output to said third LED array in accordance with said current detected by said third current detection unit, a fourth current detection unit for detecting current flowing out of said third LED array, and a fourth current control unit for controlling current flowing from said third LED array to said negative power supply output in accordance with said current detected by said fourth current detection unit.

3. The LED driving circuit according to claim 2, wherein a plurality of said intermediate circuits are disposed between said first circuit and said second circuit.

4. The LED driving circuit according to claim 2, further comprising a reverse current preventing diode for said third LED array in said intermediate circuit.

5. The LED driving circuit according to claim 2, further comprising reverse current preventing diodes disposed between said first LED array, said second LED array, and said third LED array, respectively.

6. The LED driving circuit according to claim 1, further comprising a current regulating unit disposed between said first circuit and said second circuit.

7. The LED driving circuit according to claim 6, wherein said current regulating unit is a current regulative diode, a high power resistor, or a constant current circuit.

8. The LED driving circuit according to claim 1, further comprising:

a third LED array connected to said rectifier;

a detection unit which detects current flowing through two adjacent LED arrays selected from among said first, second, and third LED arrays when said two adjacent LED arrays are connected in series; and a current limiting unit which, based on a detection result from said detection unit, limits current flowing from said rectifier to the other one of said first, second, and third LED arrays.

9. The LED driving circuit according to claim 8, wherein in order to prevent any LED arrays having different impedances from being connected in parallel relative to said rectifier, said current limiting unit limits the current flowing to said other one of said first, second, and third LED arrays.

10. The LED driving circuit according to claim 8, wherein a current path connecting said first, second, and third LED arrays in parallel relative to said rectifier and a current path connecting said two adjacent LED arrays selected from among said first, second, and third LED arrays in series relative to said rectifier are formed in accordance with the output voltage of said rectifier.

11. The LED driving circuit according to claim 8, wherein said second circuit further includes a third current control unit for controlling current flowing from said second LED array to said negative power supply output in accordance with said current detected by said second current detection gait, said LED driving circuit further comprising:

a third circuit which includes said third LED array, a third current detection unit for detecting current flowing through said third LED array, and a fourth current control unit for controlling current flowing from said positive power supply output to said third LED array in accordance with said current detected by said third current detection unit.

12. The LED driving circuit according to claim 11, further comprising current regulating units disposed between said first LED array, said second LED array, and said third LED array, respectively.

13. The LED driving circuit according to claim 12, wherein said current regulating units are current regulative diodes, high power resistors, or constant current circuits.

14. The LED driving circuit according to claim 1, further comprising a smoothing unit inserted between said positive power supply output and said negative power supply output.

* * * * *

UNITED STATES PATENT AND TRADEMARK OFFICE

CERTIFICATE OF CORRECTION

PATENT NO. : 8,933,636 B2
APPLICATION NO. : 13/576627
DATED : January 13, 2015
INVENTOR(S) : Shunji Egawa et al.

It is certified that error appears in the above-identified patent and that said Letters Patent is hereby corrected as shown below:

Claims

Claim 11, col. 38, line 36, "said second current detection gait" should read --said second current detection unit--.

Signed and Sealed this
Twentieth Day of October, 2015

Michelle K. Lee

Michelle K. Lee
*Director of the United States Patent and Trademark Office*